US010716385B2

(12) United States Patent
Thulin et al.

(10) Patent No.: US 10,716,385 B2
(45) Date of Patent: Jul. 21, 2020

(54) PACKAGE FOR CONSUMER PRODUCTS

(71) Applicant: The Procter & Gamble Company, Cincinnati, OH (US)

(72) Inventors: Nathaniel David Thulin, Hebron, KY (US); Justin Alan Ellsworth, Liberty Township, OH (US); Nathan Daniel Grubbs, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 16/162,548

(22) Filed: Oct. 17, 2018

(65) Prior Publication Data

US 2019/0110576 A1 Apr. 18, 2019

(30) Foreign Application Priority Data

Oct. 18, 2017 (EP) ..... 17197052

(51) Int. Cl.

| | |
|---|---|
| ***B43K 21/08*** | (2006.01) |
| ***A45D 40/04*** | (2006.01) |
| ***B65D 83/00*** | (2006.01) |
| ***B65D 25/20*** | (2006.01) |
| ***A45D 40/12*** | (2006.01) |
| *A45D 40/00* | (2006.01) |

(52) U.S. Cl.

CPC ..... *A45D 40/04* (2013.01); *A45D 40/12* (2013.01); *B65D 25/205* (2013.01); *B65D 83/0011* (2013.01); *A45D 2040/0012* (2013.01); *A45D 2200/055* (2013.01)

(58) Field of Classification Search

CPC ..... A45D 40/02; A45D 40/04; A45D 40/12; B65D 83/0011; B65D 83/0033

USPC ..... 401/68, 75

See application file for complete search history.

(56) References Cited

U.S. PATENT DOCUMENTS

| | | | | |
|---|---|---|---|---|
| 7,389,894 | B2 | 6/2008 | Danne et al. | |
| 8,096,724 | B2 * | 1/2012 | Bolander | A45D 40/04 206/229 |
| 8,388,249 | B2 * | 3/2013 | Groh | B65D 83/0011 401/175 |
| 9,795,206 | B2 | 10/2017 | Ellsworth | |
| 9,820,551 | B2 * | 11/2017 | Ellsworth | A45D 40/12 |
| 9,867,445 | B2 | 1/2018 | Ellsworth | |
| 10,315,832 | B2 * | 6/2019 | Ellsworth | A45D 34/04 |
| 2016/0174683 | A1 | 6/2016 | Ellsworth | |
| 2016/0174684 | A1 | 6/2016 | Ellsworth | |
| 2016/0174685 | A1 | 6/2016 | Ellsworth | |
| 2016/0174686 | A1 | 6/2016 | Ellsworth | |
| 2016/0174687 | A1 | 6/2016 | Ellsworth | |
| 2018/0086541 | A1 | 3/2018 | Ellsworth | |
| 2019/0110575 | A1 | 4/2019 | Thulin | |

OTHER PUBLICATIONS

International Search Report, dated Nov. 21, 2018 (13 pages).

* cited by examiner

*Primary Examiner* — Jennifer C Chiang
(74) *Attorney, Agent, or Firm* — Kathleen Y. Carter

(57) ABSTRACT

A dispensing package comprising one or more jackets, a screw assembly, and a movable elevator platform; the screw assembly comprising a spindle comprising two external thread portions, which allows for a quick first turn.

15 Claims, 32 Drawing Sheets

PACKAGE FOR CONSUMER PRODUCTS

CROSS REFERENCE TO RELATED APPLICATION

This application claims the benefit of EP Application 17197052.8, filed Oct. 18, 2017, the substance of which is incorporated herein by reference.

FIELD OF THE INVENTION

The present invention relates to packages for consumer care products. The packages are particularly suited for antiperspirant and/or deodorant products, but can equally be employed for other types of consumer care products.

The dispensing package for consumer care products includes a longitudinal axis; one or more jackets, wherein the one or more jackets comprise a first end, a second end opposite the first end; a screw assembly; and a movable elevator platform.

BACKGROUND OF THE INVENTION

The consumer products industry is continually releasing a variety of new and improved consumer products. As such, the consumer products industry is continually providing to the consumers a wide variety of product packages to dispense and deliver this ever-growing variety of products.

The antiperspirant and/or deodorant product is normally introduced into the dispensing package itself, the movable elevator platform being in its lowermost position. When the dispensing package is normally filled from above so an empty space namely a dead space is unavoidably formed in the upper part of the dispensing package during the filling process. This empty space is typically function of the height of the dispensing package and optionally by the curvature of the applicator. In addition, the empty space can also be caused by the product, i.e. the volume of product can decrease after filling, for example through air bubbles which escape after the filling process.

Because of the empty space between the outlet opening and the product, the operating button has to be repeatedly operated several times before the dispensing package is used for the first time to deliver to the consumer the first dose of the dispensed product.

There is still a need for improved consumer product packages that can serve as dispensing and delivery packages for multiple products, in order to get more easily and quicker the first dose of the dispensed product without comprising the precise dosing delivering of the dispensed product.

SUMMARY OF THE INVENTION

A dispensing package 100 is provided and comprises:

a longitudinal axis L;

one or more jackets (200, 110), wherein the one or more jackets (200, 110) comprise a first end 260, a second end 250 opposite the first end 260;

a screw assembly 330; and a movable elevator platform 320; wherein the screw assembly 330 comprises: a screw base disposed adjacent to the first end 260 and rotatably associated with the one or more jackets (200, 110); a spindle 332 that supports external threads 333, wherein the spindle 332 extends from the screw base 331 through the first end 260 into the one or more jackets (200, 110) coaxial to the longitudinal axis L of the dispensing package 100.

The spindle 332 comprises: a first external thread portion 335 having a first pitch P1; and a second external thread portion 337 having a second pitch P2; wherein the second pitch P2 is larger than the first pitch P1.

The movable elevator platform 320 is movably engaged with the spindle 332 of the screw assembly 330 and comprises a coupling sleeve 325 having an inner surface 550, wherein the coupling sleeve 325 is coaxial to the longitudinal axis L of the dispensing package 100, wherein the coupling sleeve 325 supporting internal threads has: a first internal thread portion 530 having a first pitch p1; and a second internal non-threaded portion 535, wherein the second internal non-threaded portion 535 comprises one or more cross-thread features 536, preferably selected from the group consisting of a smooth surface, horizontal ribs, vertical ribs and combinations thereof.

The first external thread portion 335 of the screw assembly 330 can engage with the first internal thread portion 530 of the movable elevator platform 320 along the inner surface 550 of the movable elevator platform 320 such that the first pitch p1 of the first internal thread portion 530 and the first pitch P1 of the first external thread portion 335 are the same;

The external threads of the second external thread portion 337 of the screw assembly 330 can cross-thread with the one or more cross-thread features 536 of the second internal non-threaded portion 535 of the movable elevator platform 320 along the inner surface 550 of the movable elevator platform 320.

Alternatively, a dispensing package 100 is provided and comprises:

a longitudinal axis L;

one or more jackets (200, 110), wherein the one or more jackets (200, 110) comprise a first end 260, a second end 250 opposite the first end 260;

a screw assembly 330; and a movable elevator platform 320; wherein the screw assembly 330 comprises: a screw base disposed adjacent to the first end 260 and rotatably associated with the one or more jackets (200, 110); a spindle 332 that supports external threads 333, wherein the spindle 332 extends from the screw base 331 through the first end 260 into the one or more jackets (200, 110) coaxial to the longitudinal axis L of the dispensing package 100.

The spindle 332 comprises: a first external thread portion 335 having a first pitch P1; and a second external thread portion 337 having a second pitch P2; wherein the second pitch P2 is larger than the first pitch P1.

The movable elevator platform 320 is movably engaged with the spindle 332 of the screw assembly 330 and comprises a coupling sleeve 325 having an inner surface 550, wherein the coupling sleeve 325 is coaxial to the longitudinal axis L of the dispensing package 100, wherein the coupling sleeve 325 supporting internal threads has: a first internal thread portion 530 having a first pitch p1; a second internal non-threaded portion 535; a third internal thread portion 540 comprising one or a plurality of internal threads, wherein the second internal non-threaded portion 535 is between the first and the third internal thread portions (530, 540).

The first external thread portion 335 of the screw assembly 330 can engage with the first internal thread portion 530 of the movable elevator platform 320 along the inner surface 550 of the movable elevator platform 320 such that the first pitch p1 of the first internal thread portion 530 and the first pitch P1 of the first external thread portion 335 are the same.

The second external thread portion 337 of the screw assembly 330 can engage with the third internal thread portion 540 of the movable elevator platform 320 along the inner surface 550 of the movable elevator platform 320.

The one or more jackets may comprise an outer jacket 200 and a product chamber 110; wherein the outer jacket comprises a top opening 250 and a bottom opening 260; wherein the product chamber 110 is disposed within the outer jacket 200; and wherein the product chamber 110 comprises a top opening 160 and a bottom opening 170.

The external threads 333 of the spindle 332 and/or the internal threads of the coupling sleeve 325 may be helical threads which are continuous and/or interrupted.

BRIEF DESCRIPTION OF THE DRAWINGS

While the specification concludes with claims particularly pointing out and distinctly claiming the present invention, it is believed that the same will be better understood from the following description read in conjunction with the accompanying drawings in which:

Figure 1:
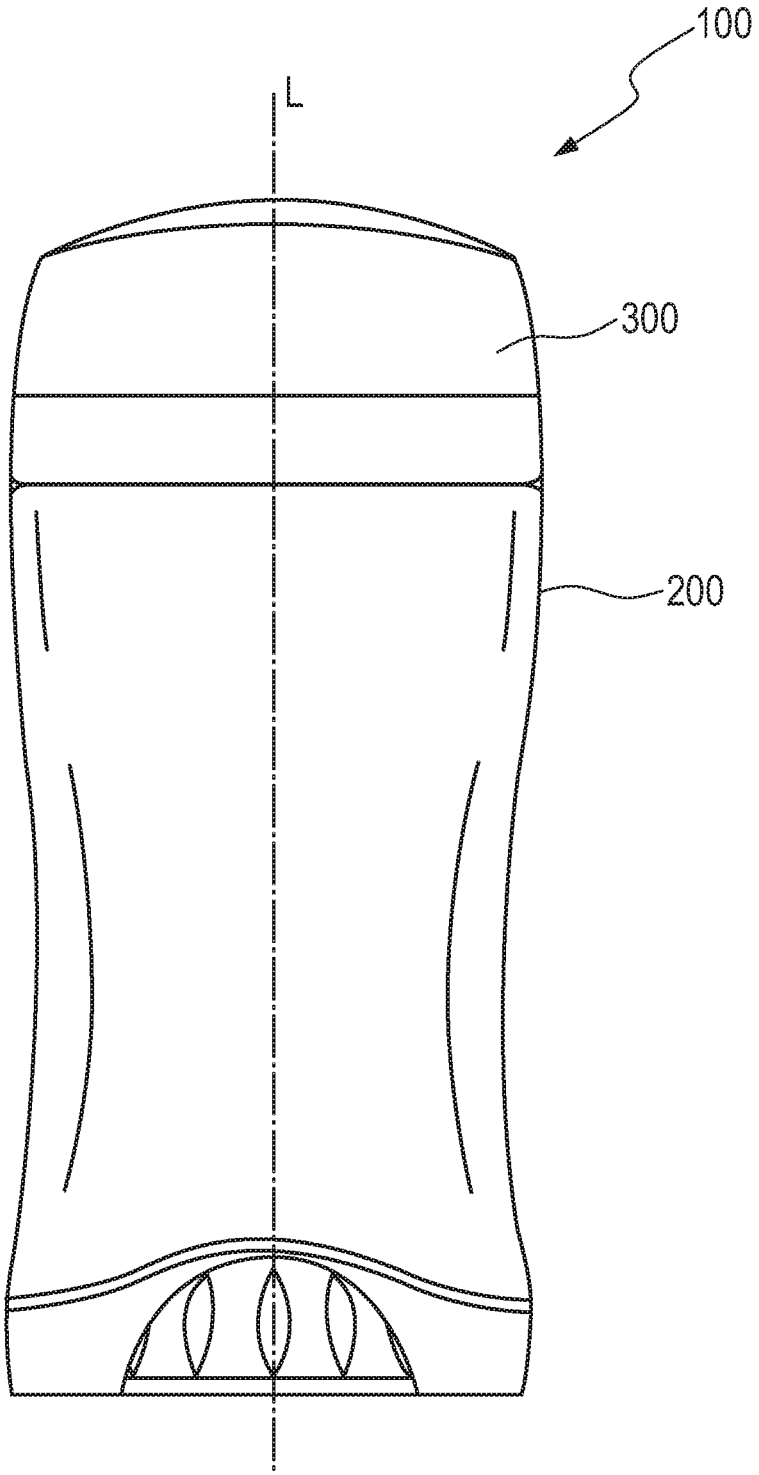
FIG. 1 is a front view of a dispensing package for consumer care products shown and described herein.

It should be noted that these figures are diagrammatic and not drawn to scale. Relative dimensions and proportions of parts of these figures have been shown exaggerated or reduced in size, for the sake of clarity and convenience in the drawings.

DETAILED DESCRIPTION OF THE INVENTION

Definitions and General

In this document, including in all embodiments of all aspects of the present invention, the following definitions apply unless specifically stated otherwise.

The present invention can comprise, consist of, or consist essentially of the essential elements and limitations of the invention described herein, as well any of the additional or optional ingredients, components, or limitations described herein.

"Comprise", "comprising", and "comprises" as used herein are open ended terms, each specifying the presence of what follows, e.g., a component, but not precluding the presence of other features, e.g., elements, steps or components known in the art, or disclosed herein.

"Consumer care product", as used herein, also referred to as the "product", refers to any consumer care product including but not limited to beauty care products, personal care products, household care products, health care products, pet care products and the like.

A "plurality" as used herein means more than one.

"Cross-threading" as used herein means screwing together two threaded pieces without aligning the threads correctly and/or one piece may not have any threads at all but one or more features selected from the group consisting of a smooth surface, vertical ribs, horizontal ribs, similar features and combinations thereof; through which a mating set of threads can "cut" through to enable the intended screw pitch to function.

"Lead" as used herein is the distance along the spindle axis for the screw assembly or along the coupling sleeve axis (both axis being parallel to the longitudinal axis of the dispensing package), that is covered by one complete revolution of the screw.

"Second non-threaded portion of the coupling sleeve" as used herein means that the coupling sleeve comprises a second portion free of internal threads.

"Pitch" as used herein is the distance from the crest of one thread to the next crest.

"Major diameter" as used herein is for threads, the larger of two extreme diameters delimiting the height of the thread profile, as a cross-sectional view if taken in a plane containing the axis of the threads. For a spindle of a screw assembly, the major diameter is the outside diameter. In other words, the major diameter for the threads of the spindle is the diameter across the crests of the threads. The major diameter for the internal threads of the coupling sleeve is the diameter across the roots of the internal threads.

"Minor diameter" as used herein is for threads, is the lower extreme diameter of the threads. In other words, the minor diameter for the threads of the spindle is the diameter across the roots of the threads. The major diameter for the internal threads of the coupling sleeve is the diameter across the crests of the internal threads.

"Pitch diameter" as used herein is for threads, internal or external, is the diameter of a cylindrical surface, axially concentric to the thread, which intersects the thread flanks at equidistant points, when viewed in a cross-sectional plane containing the axis of the thread, the distance between these points being exactly one half the pitch distance.

"Torque" as used herein is a rotational force.

Herein, the axis of the external threads of the spindle and the axis of the internal threads of the coupling sleeve are coaxial with the longitudinal axis of the dispensing package.

General Description of the Dispensing Package

A dispensing package 100 is provided and comprises a longitudinal axis L. FIG. 1 is a front elevation of a dispensing package for consumer care products as fully assembled according to the invention. The dispensing package 100 comprises an outer cap 300 and a jacket 200. The dispensing package 100 comprises one or more jackets (200, 110), wherein the one or more jackets (200, 110) comprises a first end 260, and a second end 250 opposite to the first end 260.

Figure 2A:
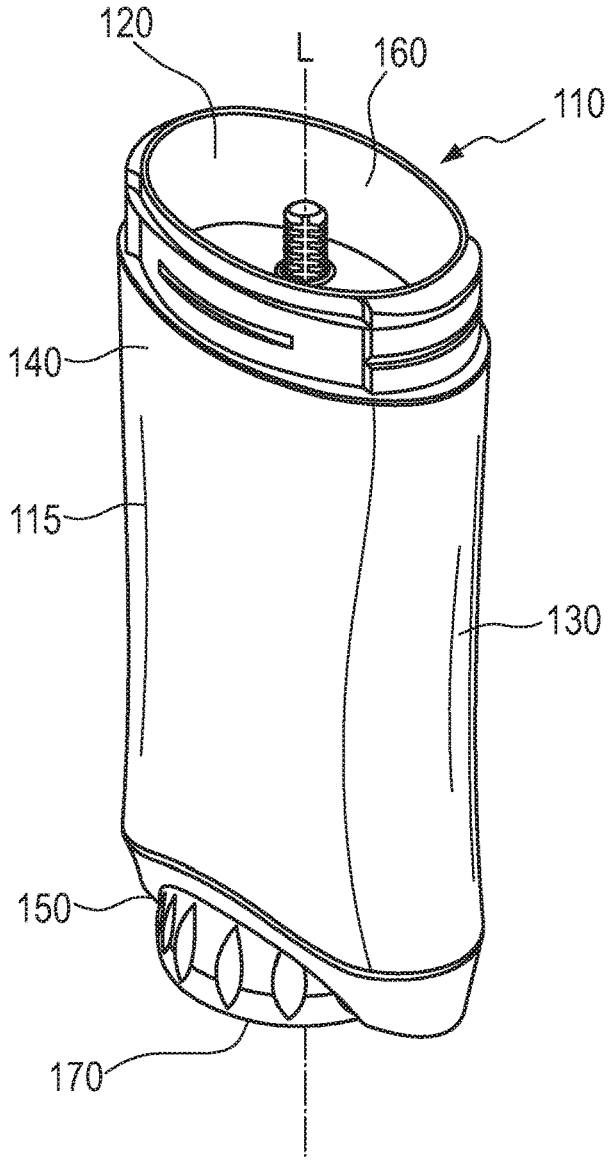
FIG. 2A is a front perspective view of the dispensing package having one single jacket, being a chamber product.

The dispensing package 100 may comprise one single jacket, wherein the one jacket is a product chamber 110, as shown in FIG. 2A. The product chamber 110 may at least partially surround and support a consumer care product. The product chamber 110 may comprise a side wall 115 having an inner surface 120, an outer surface 130, an upper dispensing end 140, a lower end 150, a top opening 160, wherein the consumer care product can move up and outward, and a bottom opening 170.

The one single jacket 110 may comprise an internal space which is defined by the internal surface 120 of the side wall 115, the upper dispensing end 140 and the lower end 150.

Figure 2B:
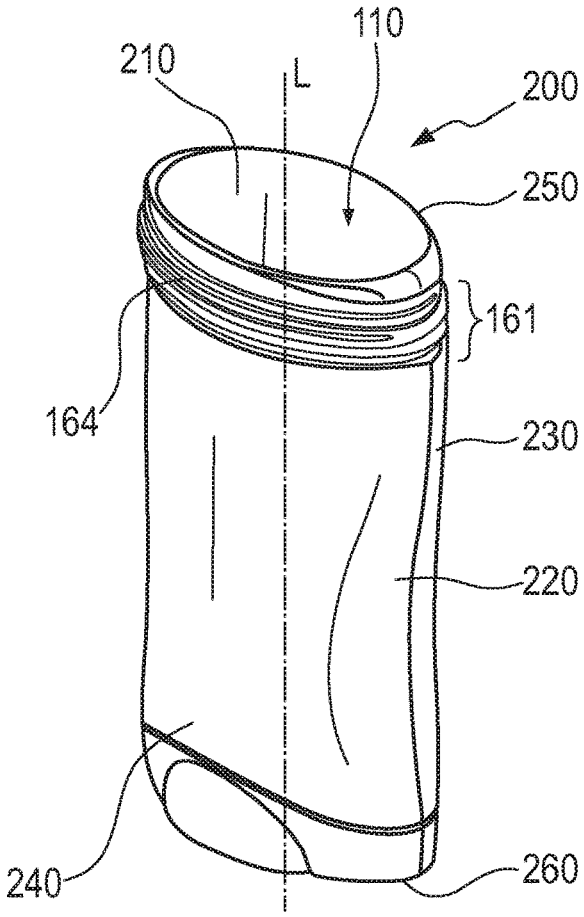
FIG. 2B is a front perspective view of another dispensing package having an outer jacket and a product chamber.

Alternatively, the one or more jackets may comprise an outer jacket 200 and a product chamber 110, as shown in FIG. 2B. The outer jacket may comprise a top opening 250 and a bottom opening 260. The product chamber 110 may be disposed within the outer jacket 200 and may comprise a top opening 160 and a bottom opening 170.

Figure 3A:
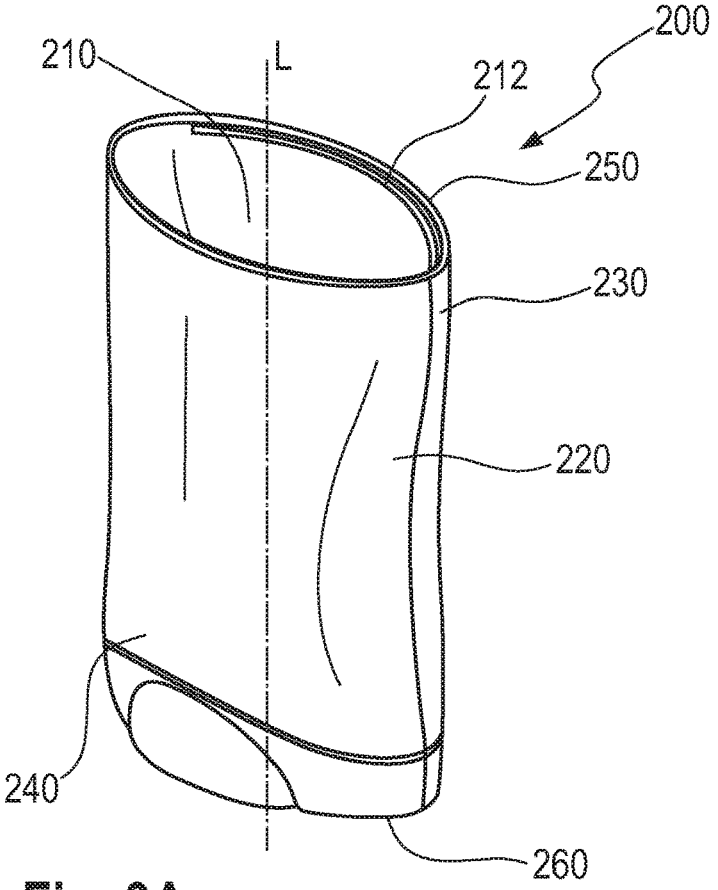
FIG. 3A is a front perspective view of the outer jacket of another dispensing package of FIG. 2B.

As shown in FIG. 3A, the dispensing package 100 may comprise an outer jacket 200 further comprising at least one wall having an inside surface 210 that at least partially surrounds and further supports the product chamber 110. The outer jacket 200 may further comprise an outside surface 220, an upper end 230, a lower end 240, a top opening 250, a bottom opening 260. The top opening 250 allows the consumer care product being dispensed via the product chamber 110 outside the outer jacket 200.

The inside surface 210 of the outer jacket 200 may comprise at least one rib 212 as shown in FIG. 3A, or any other conventional means of engagement with the product chamber 110. For example, in FIG. 3A, the rib 212 on the inner surface of the outer jacket 200 can engage with a groove 164 in a top ridged opening 161 (FIG. 3B) of the product chamber 110 in order to keep the product chamber 110 engaged with the outer jacket 200.

Figure 3B:
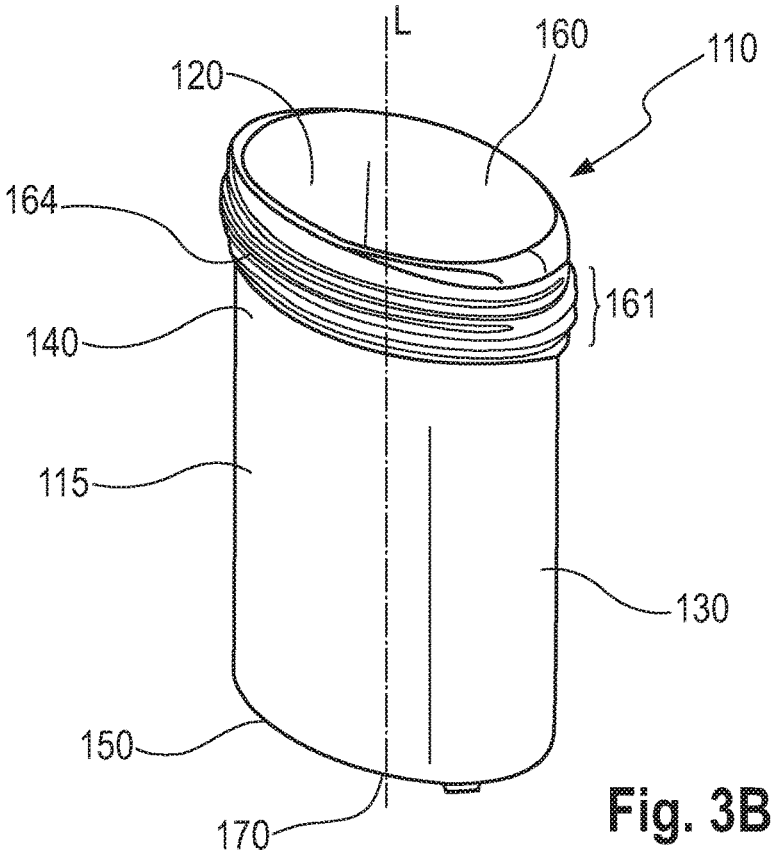
FIG. 3B is a front perspective view of the product chamber of another dispensing package of FIG. 2B.

As shown in FIG. 3B, the dispensing package 100 may comprise a product chamber 110 that at least partially surrounds and supports a consumer care product. The product chamber 110 may comprise a side wall 115 having an inner surface 120, an outer surface 130, an upper dispensing end 140, a lower end 150, a top opening 160, wherein the consumer care product can move up and outward, a top ridged opening 161 comprising a plurality of grooves 164, and a bottom opening 170.

The chamber 110 may comprise an internal space which is defined by the internal surface 120 of the side wall 115, the upper dispensing end 140 and the lower end 150.

The consumer care product may be in the form of a solid, a semi-solid, liquid, gel, mousse or the like. The consumer care product may be held within the surrounding walls, particularly the inner surface 120 of the product chamber 110. The consumer care product may be dispensed from the top opening 160 and the top ridged opening 161, both located at the dispensing end 140 of the product chamber 110.

Figure 4:
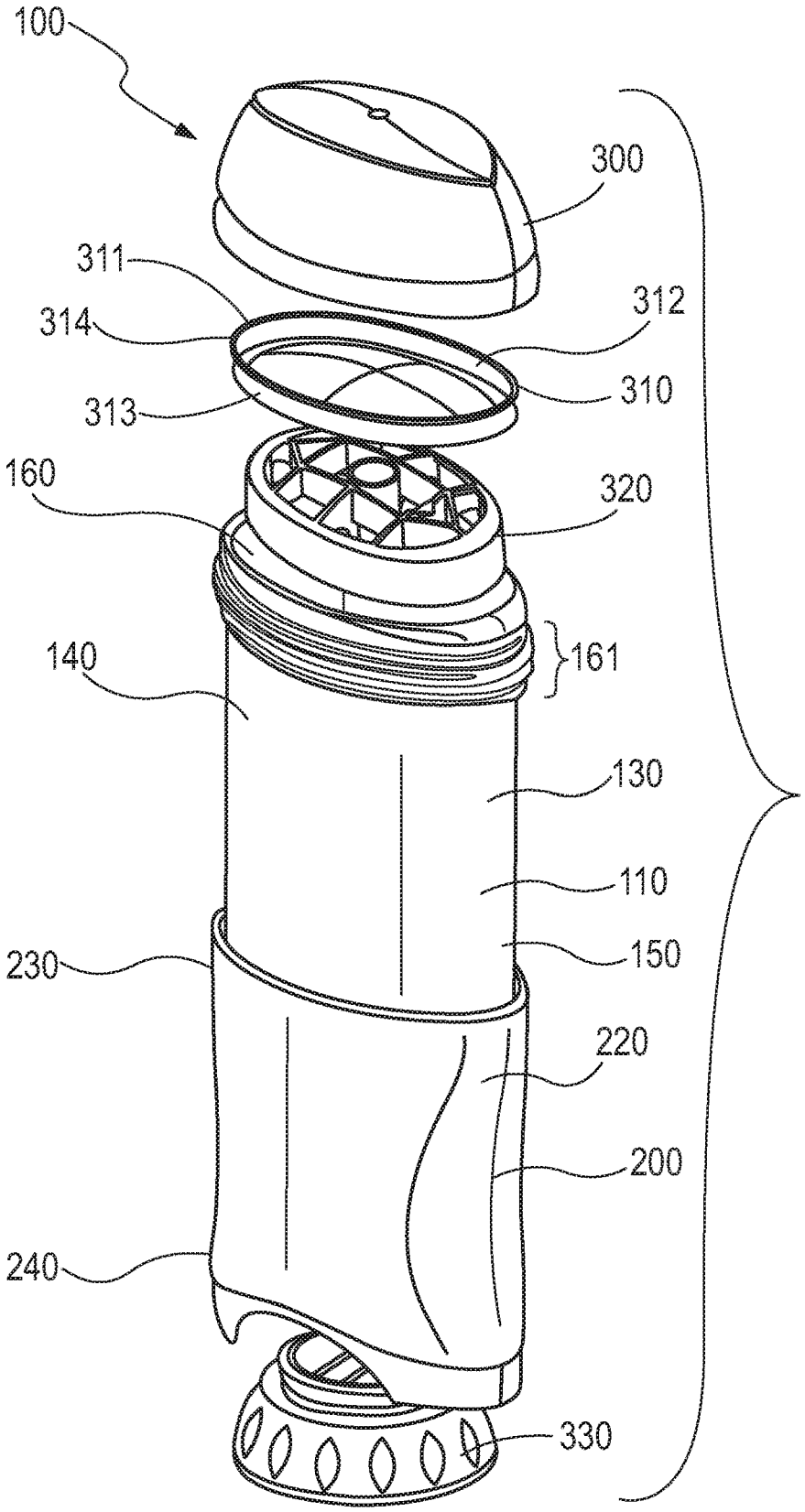
FIG. 4 is an exploded perspective view of FIG. 1 of a dispensing package for consumer care products shown and described herein, illustrating some of the individual components and having a form suitable for bottom filling.

FIG. 4 is an exploded perspective view of FIG. 1 of a dispensing package 100 for consumer care products. In that case, the dispensing package 100 may comprise an outer jacket 200, a product chamber 110 and other individual components such as a screw assembly 330, a movable elevator platform 320, a seal component 310 (or a perforated dome cover 370 instead), and an outer cap 300.

Figure 5:
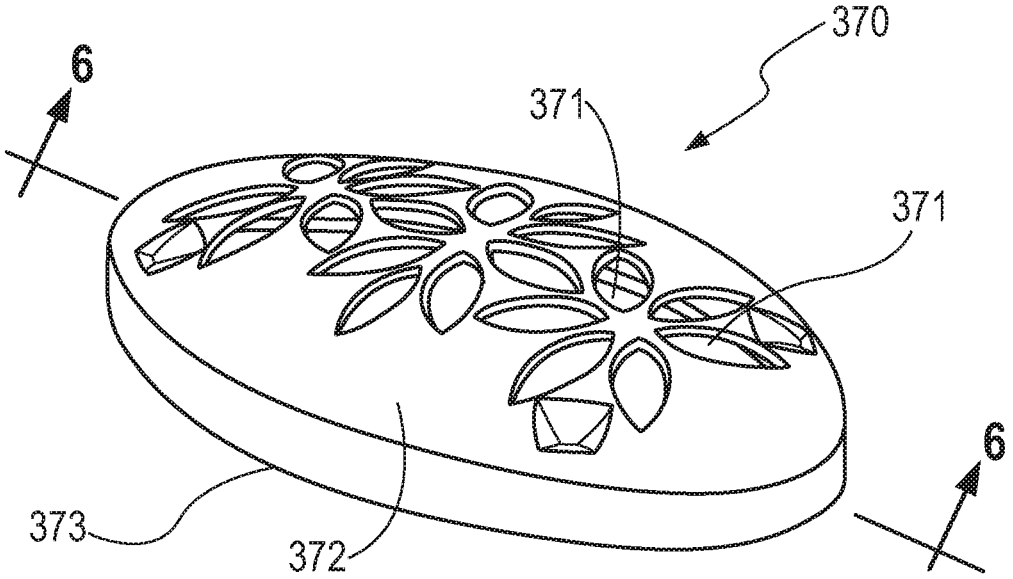
FIG. 5 is a front perspective view of a perforated dome cover of the dispensing package as shown and described herein.
Figure 6:
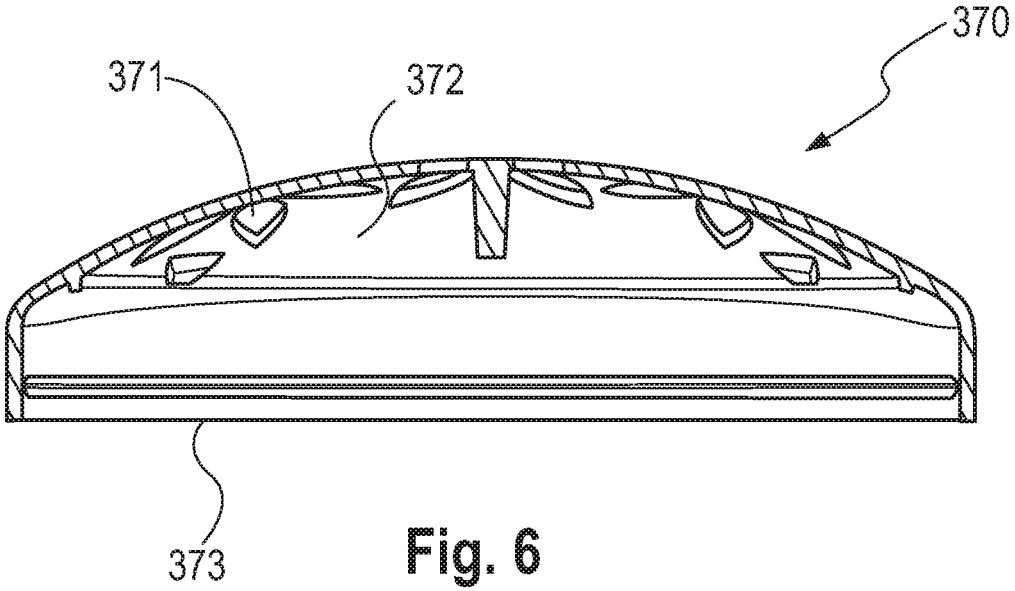
FIG. 6 is a cross-sectional front view of the perforated dome cover taken along the major axis of 6-6 of FIG. 5.

The top opening 160 of the product chamber 110 may optionally comprise an upwardly facing perforated dome cover 370, as shown for instance in FIGS. 5 and 6, which may be integrally formed with the product chamber 110 or be a separate member that is formed separately and then attached to the product chamber 110. The perforated dome cover 370 may be generally useful for compositions with rheology, hardness, and/or melting profiles that are considered gels or semi-solids. The perforated dome cover 370 may extend outwardly from and completely surround the periphery of the top opening 160 and/or the top ridged opening 161 of the product chamber 110.

FIG. 6 is a cross-sectional front view of an example of the perforated dome cover 370 taken along a major axis of 6-6 of FIG. 5.

The perforated dome cover 370 may be a convex surface, may have a rigid surface, having a plurality of apertures 371 extending through the thickness of the perforated dome cover, and through which consumer care product is extruded and flows to the intended site of application on the skin. The perforated dome cover 370 thus may have a convex configuration that extends away or protrudes from the product chamber 110.

In an alternative to the perforated dome cover 370, the top opening 160 may comprise a seal component 310 as shown in FIG. 4. The seal component 310 may be generally a separate member that is attached to the product chamber 110. The seal component 310 may be generally useful for consumer care products with rheologies that are considered to be solids whereby the consumer removes the seal component prior to first use of the product. The seal component 310 thus can function to protect the solid product from degradation or damage during manufacture and storage of the dispensing package 100. The seal component 310 can also serve as a seal to prevent leakage when the dispensing package 100 is filled from the bottom with a molten liquid composition. This can allow the molten liquid composition forming for example into a dome-like shape as it is cooled.

Benefit of the Present Invention

In the dispensing package 100, the movable elevator platform 320 is initially located in the product chamber 110 at the proximity of the lower end 150, i.e. the lowermost position. The dispensing package 100 can be filled from the top opening 160 of the product chamber 110, especially when the consumer care product is liquid such as a liquid cream. However, during the filing process, an empty space can be formed at the proximity of the top opening 160 of the product chamber 110. The formation of the empty space can be due to the height, and the shape of the dispensing package 100. The empty space can result also from the product in which air bubbles have been generated during the filing process. At the end, because of the empty space between the consumer care product and the top opening 160 of the product chamber 110, for instance between the consumer care product and the dome cover 370, the consumer needs to turn several times a screw base 331 of the screw assembly 330 to get the first dose of the consumer care product out of the product chamber through for instance, the apertures 371 of the dome cover 370.

It has been found that the actuation of the dispensing package 100 for the first time can be simplified for the consumer by providing a movable elevator platform 320 having internal threads that can cross-thread and/or match the threads of a spindle 332 of the screw assembly 330. With the different aspects as described hereinafter, the movable elevator platform 320 can be displaced upwards in the product chamber 110 in order to dispense the first dose of the consumer care product to the consumer. Although having new features enabling the faster movement of the platform 320 upwards, the dispensing package can still allow the consumer dosing with accuracy the consumer care product he needs.

The dispensing package 100 comprises a screw assembly 330. The screw assembly 330 comprises a screw base 331 disposed adjacent to the first end 260 of the one or more jackets (200, 110), preferably the bottom opening 260 of the outer jacket or the bottom opening 170 of the product chamber 110. The screw assembly 330 is rotatably associated with the one or more jackets (200, 110). The screw assembly 330 includes a spindle 332 that supports external threads 333. The threads may be typically helical. Other forms of threads may be selected from the group consisting of a trapezoidal thread, a saw-tooth thread, a metric isothread, a Withworth thread, a rounded thread, and combinations thereof. The external threads 333 of the spindle 332 may be continuous or interrupted.

The spindle 332 extends from the screw base 331 through the first end 260 of the one or more jackets (200, 110), into the one or more jackets (200, 110) coaxial to the longitudinal axis L of the dispensing package 100. Hence, the spindle 332 may be attached to the screw base 331. Alternatively, the spindle 332 may form with the screw base 331 one single piece.

The spindle 332 comprises a first external thread portion 335 having a first pitch P1; and a second external thread portion 337 having a second pitch P2. The second pitch P2 is larger than the first pitch P1. The second external thread portion 337 may be preferably located at the proximity of the screw base 331 of the screw assembly 330.

The first pitch P1 may range from 0.025 inch to 0.200 inch (from 0.635 mm to 5.08 mm), preferably from 0.030 inch to 0.150 inch (from 0.762 mm to 3.81 mm), more preferably from 0.050 inch to 0.125 inch (from 1.27 mm to 3.175 mm).

The second pitch P2 may range from 0.150 inch to 0.750 inch (from 3.81 mm to 19.05 mm), preferably from 0.175 inch to 0.600 inch (from 4.445 to 15.24 mm), more preferably from 0.200 inch to 0.500 inch (from 5.08 mm to 12.7 mm).

The dispensing package 100 comprises a movable elevator platform 320 which is movably engaged with the spindle 332 of the screw assembly 330. In other words, the movable elevator platform is designed for linear displacement along the spindle 332 by rotation of the spindle 332 in the internal space of the chamber 110 thereof. The movable elevator platform 320 comprises a coupling sleeve 325 having an inner surface 550. The coupling sleeve 325 may be preferably a central opening of the movable elevator platform 320 defining the inner surface 550. The coupling sleeve 325 is coaxial to the longitudinal axis L of the dispensing package 100. The coupling sleeve 325 supports internal threads having a first internal thread portion 530 having a first pitch p1 and a second internal non-threaded portion 535.

The internal threads of the first internal thread portion 530 may be typically helical. Other forms of internal threads may be selected from the group consisting of a trapezoidal internal thread, a saw-tooth internal thread, a metric internal isothread, a Withworth internal thread, a rounded internal thread, and combinations thereof. The internal threads of the movable elevator platform 320 may be continuous or interrupted.

The second internal non-threaded portion 535 comprises one or more cross-thread features 536. The second internal non-threaded portion 535 may preferably comprise a cylindrical shape comprising one or more cross-thread features 536.

The one or more cross-thread features 536 may be selected from the group consisting of a smooth surface, horizontal ribs, vertical ribs and combinations thereof.

A smooth surface may be a surface having a smooth finish produced for instance by surface grinding.

The one or more cross-thread features 536 may comprise a plurality of horizontal ribs located at the second internal non-threaded portion 535. The plurality of horizontal ribs may protrude outwards the coupling sleeve 325 in a direction perpendicular to the longitudinal axis L. The plurality of horizontal ribs may preferably comprise a plurality of opposite horizontal ribs, or may more preferably form a plurality of circular ribs parallel to each other, protruding and extending outwards the coupling sleeve 325 in a direction perpendicular to the longitudinal axis L.

The one or more cross-thread features 536 may comprise a plurality of vertical ribs located at the second internal non-threaded portion 535. The plurality of vertical ribs may protrude outwards of the coupling sleeve 325 in a direction perpendicular to the longitudinal axis L and extend in a direction parallel to the longitudinal axis L. The plurality of vertical ribs may be parallel to each other in a direction parallel to the longitudinal axis L. The plurality of vertical ribs may comprise a plurality of opposite vertical ribs arranged by pairs and surrounding outwardly the coupling sleeve 325.

The first external thread portion 335 of the screw assembly 330 can engage with the first internal thread portion 530 of the movable elevator platform 320 along the inner surface 550 of the movable elevator platform 320 such that the first pitch p1 of the first internal thread portion 530 and the first pitch P1 of the first external thread portion 335 are the same.

The first pitch p1 may range from 0.025 inch to 0.200 inch (from 0.635 mm to 5.08 mm), preferably from 0.030 inch to 0.150 inch (from 0.762 mm to 3.81 mm), more preferably from 0.050 inch to 0.125 inch (from 1.27 mm to 3.175 mm).

The external threads of the second external thread portion 337 of the screw assembly 330 can cross-thread with the one or more cross-thread features 536 of the second internal non-threaded portion 535 of the movable elevator platform 320 along the inner surface 550 of the movable elevator platform 320.

The movable elevator platform 320 comprises internal threads in the first internal thread portion 530. The internal threads of the first internal thread portion 530 have the same pitch as the external threads of the first external thread portion 335 of the spindle 332. Hence, the spindle 332 and the movable elevator platform 332 are matching together when the first external thread portion 335 of the screw assembly 330 is engaged with the first internal thread portion 530 of the movable elevator platform 320.

The external threads of the second external thread portion 337 of the screw assembly 330 can cross-thread with the one or more cross-thread features 536 of the second internal non-threaded portion 535 of the movable elevator platform 320 along the inner surface 550 of the movable elevator platform 320.

Figure 7:
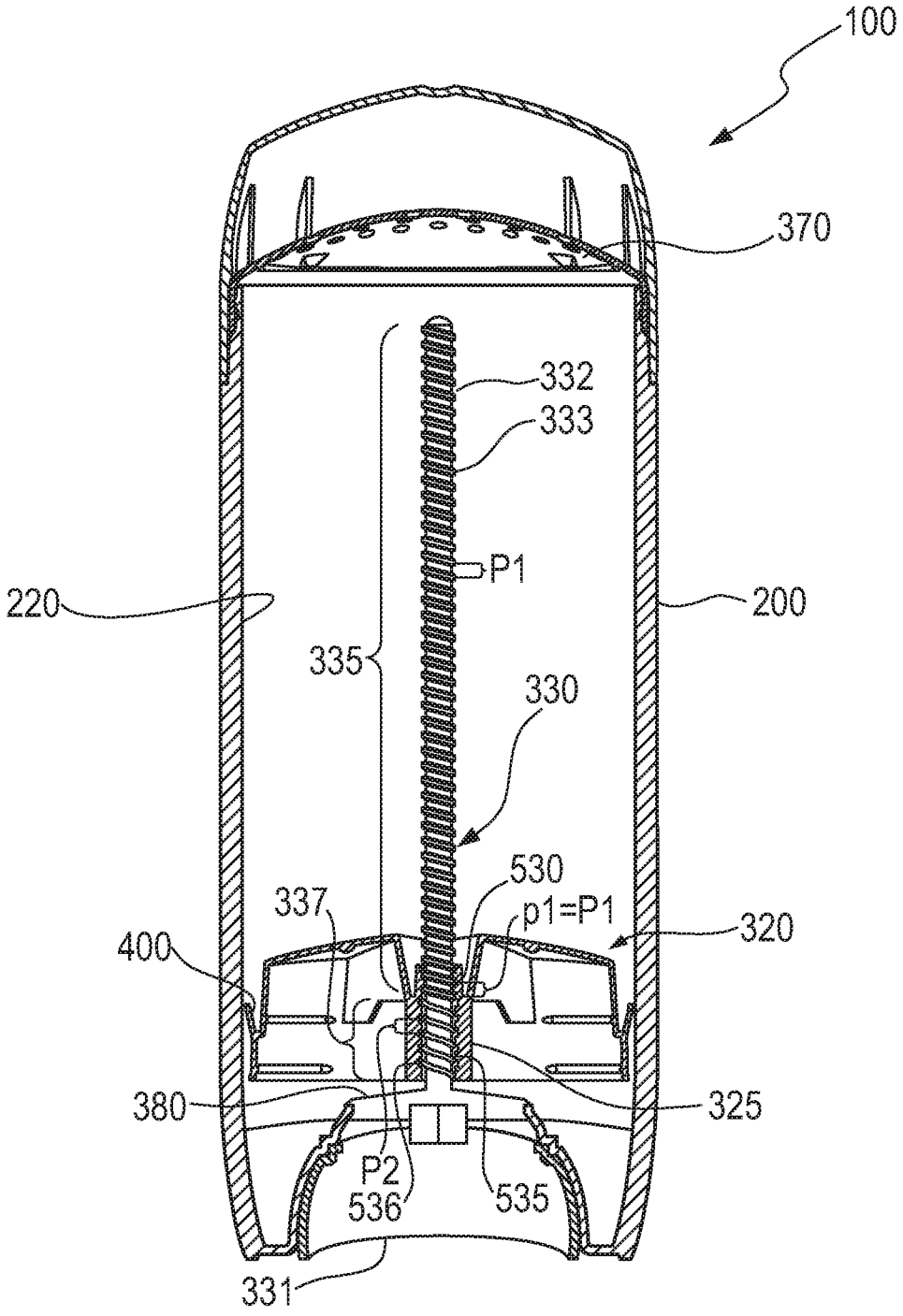
FIG. 7 is a cross sectional view of a dispensing package according to one or more aspects.
Figure 8:
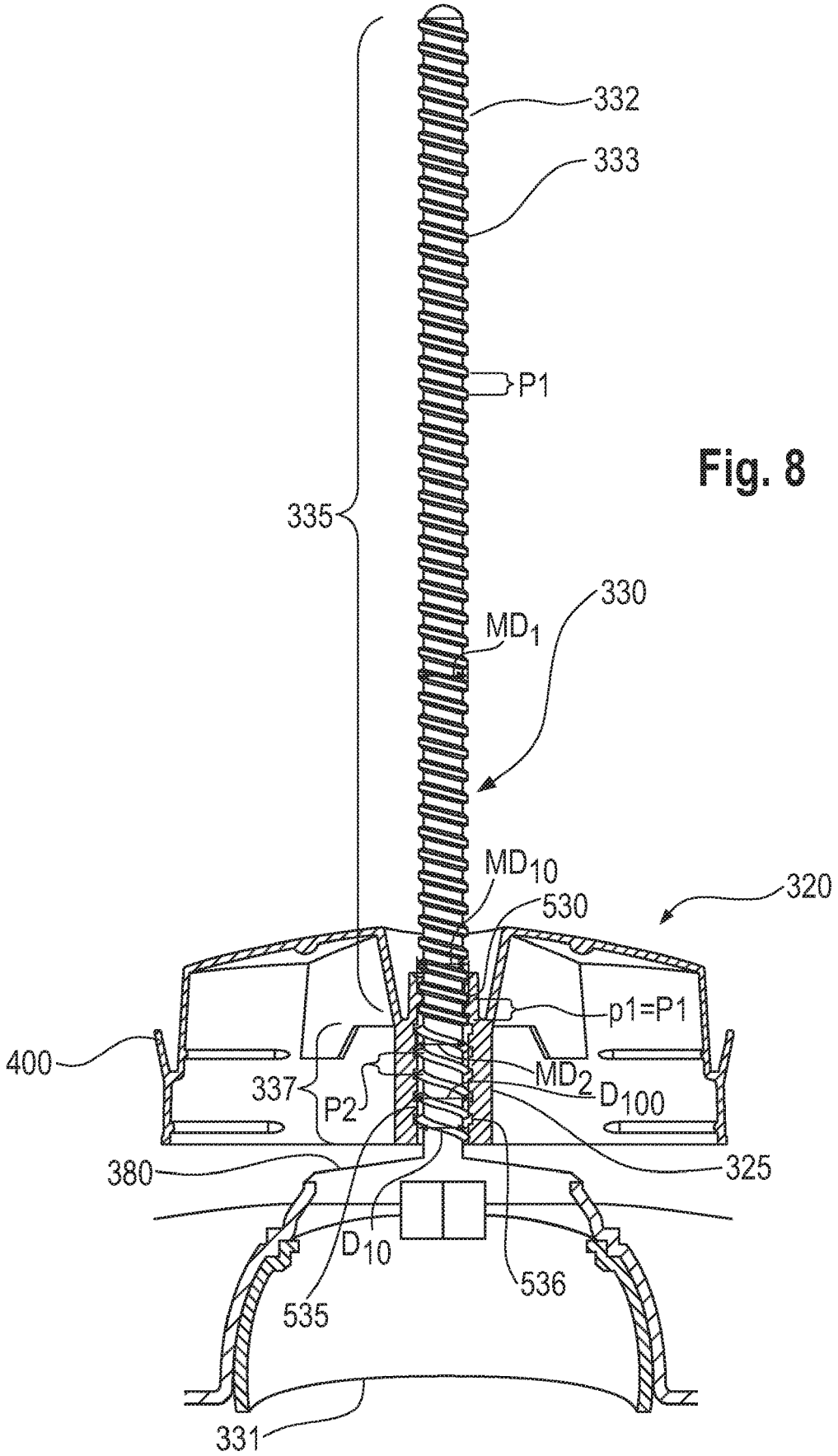
FIG. 8 is a detail, cross sectional view of a screw assembly engaged with a movable elevator platform of the dispensing package of FIG. 7.

As shown in FIG. 7 and FIG. 8, the spindle 332 may comprise a first external thread portion 335 having a first pitch P1; and a second external thread portion 337 having a second pitch P2. However, the movable elevator platform 320 may comprise a coupling sleeve 325 having internal threads having a first internal thread portions 530, and a second internal non-threaded portion 535. The first internal thread portions 530 has internal threads having the same pitch P1 as the one of the first external thread portion 335 of the spindle 332.

The second internal non-threaded portion 535 comprises one or more cross-thread features 536. The second internal non-threaded portion 535 comprises a cylindrical shape comprising one or more cross-thread features 536.

As shown in FIG. 7 and FIG. 8, the one or more cross-thread features 536 are horizontal ribs. Alternatively, the one or more cross-thread features 536 may be vertical ribs, a smooth surface, similar features able to cross-thread with the external threads of the second external thread portion 337 of the screw assembly 330, and any combinations thereof.

In that case, when a user is actuating the screw base 331 of the screw assembly 330 (the operating button for the user), i.e. when a rotational force is applied to the screw base 331 by a user, the screw assembly 330, including the spindle 332, rotates causing the threads 330 to rotate within the coupling sleeve 325 and moving the movable elevator platform 320 in a linear direction along the longitudinal axis L of the dispensing package 100.

The external threads of the second external thread portion 337 cross-thread with the one or more cross-thread features 536 of the second internal non-threaded portion 535. For instance, in FIG. 7 and FIG. 8, the external threads of the second external thread portion 337 cross-thread with the horizontal ribs 536 of the second internal non-threaded portion 535. The internal threads of the first internal thread portion 530 of the movable elevator platform 320 can engage with the external threads of the first external thread portion 335. A s the coupling sleeve 325 of the movable elevator platform 320 comprises internal threads, the platform 320 when moving in a linear direction along the longitudinal axis L of the dispensing package 100, is stabilized and the risk of having the platform 320 rocking is also prevented while delivering the first dose as quick as possible.

Furthermore, as illustrated in FIG. 7, and FIG. 8, the dispensing package 100 may comprise a spindle 332 comprising a first external thread portion 335 having a major diameter $MD_1$; and a second external thread portion 337 having a major diameter $MD_2$. The major diameter $MD_2$ of the second external thread portion 337 is larger than the major diameter $MD_1$ of the first external thread portion 335. The dispensing package 100 may also comprise a movable elevator platform 320 comprising a coupling sleeve 325 wherein the first internal thread portion 530 has a major diameter $MD_{10}$; and wherein the second internal non-threaded portion 535 has a diameter $D_{10}$. The diameter $D_{10}$ is the diameter of the coupling sleeve at the second internal non-threaded portion 535 having no cross-thread features 536. The diameter $D_{10}$ can be measured at the intersection between a plane and the second internal non-threaded portion 535 having no cross-thread features 536; wherein the plane is perpendicular to the longitudinal axis L.

The diameter $D_{10}$ is equal to the major diameter $MD_{10}$.

As set out hereinbefore, the second internal non-threaded portion 535 may preferably comprise a cylindrical shape. The diameter $D_{10}$ of the second internal non-threaded portion 535 can be measured from the diameter of any cylindric section of the second internal non-threaded portion 535 having no cross-thread features 536, wherein the cylindric section is the intersection between a plane and the second internal non-threaded portion 535; wherein the plane is perpendicular to the longitudinal axis L.

The one or more cross-thread features 536 of the second internal non-threaded portion 535 has a diameter $D_{100}$ which is larger than the diameter $D_{10}$.

The one or more cross-thread features 536 may comprise a plurality of horizontal ribs located at the second internal non-threaded portion 535. The plurality of horizontal ribs may protrude outwards the coupling sleeve 325 in a direction perpendicular to the longitudinal axis L. The plurality of horizontal ribs may preferably comprise a plurality of opposite horizontal ribs, or may more preferably form a plurality of circular ribs parallel to each other, protruding and extending outwards the coupling sleeve 325 in a direction perpendicular to the longitudinal axis L. The diameter $D_{100}$ of the one or more cross-thread features 536, being preferably a plurality of horizontal ribs, may be the distance of two opposite horizontal ribs measured in in a direction perpendicular to the longitudinal axis L.

The one or more cross-thread features 536 may comprise a plurality of vertical ribs located at the second internal non-threaded portion 535. The plurality of vertical ribs may protrude outwards of the coupling sleeve 325 in a direction perpendicular to the longitudinal axis L and extend in a direction parallel to the longitudinal axis L. The plurality of vertical ribs may be parallel to each other in a direction parallel to the longitudinal axis L. The plurality of vertical ribs may comprise a plurality of opposite vertical ribs arranged by pairs and surrounding outwardly the coupling sleeve 325. The diameter $D_{100}$ of the one or more cross-thread features 536, being preferably a plurality of vertical ribs, may be the distance of two opposite vertical ribs measured in in a direction perpendicular to the longitudinal axis L.

In that case, the external threads of the first external thread portion 335 of the spindle 332 can engage with the internal threads of the first internal thread portion 530 of the movable elevator platform 320. Also, the external threads of the second external thread portion 337 of the spindle 332 can cross-thread with the one or more cross-thread features 536 of the second internal non-threaded portion 535 along the inner surface 550 of the coupling sleeve 325 of the movable elevator platform 320. The overall advantage is to gain the fast first dose experience of the consumer care product for the consumer by achieving it with relatively less number of rotations of the screw assembly 331 until the consumer care product is delivered to the consumer. Also, the necessary control of the dosing of the consumer care product can be enabled such that the consumer does not over dose in an undesirable manner.

The preferred execution as illustrated in FIG. 7 and FIG. 8 can be manufactured as followed. In that case, the spindle 332 has one single major diameter that matches with the single major diameter of the coupling sleeve 325 of the platform 320. Indeed, the coupling sleeve 325 of the movable elevator platform 320 can be made with one single screw having one single diameter being equal to the major diameter $MD_{10}$ and the pitch of value P1 (the pitch P1 of the first external thread portion 335 of the spindle 332) for making the first internal thread portion 530. The second internal non-threaded portion 535 can be made by molding the corresponding coupling sleeve without internal threads but with the corresponding cross-thread features.

The major diameter $MD_1$ of the first external thread portion 335 may be smaller than the major diameter $MD_{10}$ of the respective first internal thread portion 530. The major diameter $MD_2$ second external thread portion 337 of the spindle 332 may be typically larger than the diameter $D_{10}$ of the second internal non-threaded portion 535 of the coupling sleeve 325 and smaller than the diameter $D_{100}$ of the one or more cross-thread features 536 of the second internal non-threaded portion 535.

The major diameter $MD_1$ of the first external thread portion 335 may be preferably slightly smaller than the major diameter $MD_{10}$ of the respective first internal thread portion 530. The major diameter $MD_2$ of the second external thread portion 337 of the spindle 332 may be preferably slightly larger than the diameter $D_{10}$ of the second internal non-threaded portion 535 of the coupling sleeve 325 and slightly smaller than the diameter $D_{100}$ of the one or more cross-thread features 536 of the second internal non-threaded portion 535. Hence, having the major diameter $MD_1$ slightly smaller than the major diameter $MD_{10}$ can help to reduce the friction of the first external thread portion 335 of the spindle 332 with the first internal thread portion 530 of the coupling sleeve 325. Having the major diameter $MD_2$ slightly larger than the diameter $D_{10}$ can help to enable the cross-threading action between the external threads of the second external thread portion 337 of the spindle 332 and the one or more cross-thread features 536 of the second internal non-threaded portion 535 of the coupling sleeve 325.

Alternatively, the dispensing package may comprise the spindle 332 wherein the first external thread portion 335 has a major diameter $MD_1$ and wherein the second external thread portion 337 has a major diameter $MD_2$. The major diameter $MD_2$ of the second external thread portion 337 may be larger than the major diameter $MD_1$ of the first external thread portion 335.

The dispensing package may comprise the coupling sleeve 325 of the movable elevator platform 320, wherein the first internal thread portion 530 has a major diameter $MD_{10}$ and wherein the second internal non-threaded portion 535 has a diameter $D_{20}$. The diameter $D_{20}$ is the diameter of the coupling sleeve at the second internal non-threaded portion 535 having no cross-thread features 536. The diameter $D_{20}$ can be measured at the intersection between a plane and the second internal non-threaded portion 535 having no cross-thread features 536; wherein the plane is perpendicular to the longitudinal axis L. In that case, the diameter $D_{20}$ of the second internal non-threaded portion 535 may be larger than the major diameter $MD_{10}$ of the first internal thread portion 530. The one or more cross-thread features 536 of the second internal non-threaded portion 535 has a diameter $D_{200}$ which is larger than the diameter $D_{20}$.

As set out hereinbefore, the second internal non-threaded portion 535 may preferably comprise a cylindrical shape. The diameter $D_{20}$ of the second internal non-threaded portion 535 can be also measured from the diameter of any cylindric section of the second internal non-threaded portion 535 having no cross-thread features 536, wherein the cylindric section is the intersection between a plane and the second internal non-threaded portion 535; wherein the plane is perpendicular to the longitudinal axis L.

In that case, the external threads of the first external thread portion 335 of the spindle 332 can engage with the internal threads of the first internal thread portion 530 of the movable elevator platform 320. Also, the external threads of the second external thread portion 337 of the spindle 332 can cross-thread with the one or more cross-thread features 536 the second internal non-threaded portion 535 of the movable elevator platform 320, as shown as an example in FIGS. 9 and 10.

Preferably, the major diameter of external threads may be typically smaller than the major diameter of the internal threads. Hence, the major diameter $MD_1$ of the first external thread portion 335 of the spindle 332 may be smaller than the major diameter $MD_{10}$ of the first internal thread portion 530 of the coupling sleeve 325. Also, the major diameter $MD_2$ of the second external thread portion 337 of the spindle 332 may be typically larger than the diameter $D_{20}$ of the second internal non-threaded portion 535 of the coupling sleeve 325 and smaller than the diameter $D_{200}$ of the one or more cross-thread features 536 of the second internal non-threaded portion 535.

Having a relatively larger diameter $MD_2$ of the one or more cross-thread features 536 of the second internal non-threaded portion 535 with regard to the respective diameter $D_{20}$ of the second internal non-threaded portion 535 can help to cross-thread the one or more cross-thread features 536 of the second internal non-threaded portion 535 with the external threads of the second external thread portion 337. Then, having a relatively larger diameter $D_{20}$ of the second internal non-threaded portion 535 with regard to the respective major diameter $MD_{10}$ of the first internal thread portion 530 can help to displace relatively faster the movable elevator platform 320 upwards in the product chamber 110 in order to dispense the first dose of the consumer care product to the consumer towards the top opening 160 of the product chamber 110. More preferably, the major diameter of external threads may be slightly smaller than the major diameter of the internal threads. Hence, the major diameter $MD_1$ of the first external thread portion 335 of the spindle 332 may be slightly smaller than the major diameter $MD_{10}$ of the first internal thread portion 530 of the coupling sleeve 325. Also, the major diameter $MD_2$ of the second external thread portion 337 of the spindle 332 may be slightly larger than the diameter $D_{20}$ of the second internal non-threaded portion 535 of the coupling sleeve 325 and slightly smaller than the diameter $D_{200}$ of the one or more cross-thread features 536 of the second internal non-threaded portion 535. Hence, having the major diameter $MD_1$ slightly smaller than the major diameter $MD_{10}$; and having the major diameter $MD_2$ slightly larger than the diameter $D_{20}$ but slightly smaller than the diameter $D_{200}$ of the one or more cross-thread features 536 can help to reduce the friction of the first external thread portion 335 of the spindle 332 with the first internal thread portion 530 of the coupling sleeve 325; and enable the cross-threading action by increasing the friction between the second external thread portion 337 of the spindle 332 and the one or more cross-thread features 536 of the second internal non-threaded portion 535 of the coupling sleeve 325.

When cross-threading is needed, i.e. in the case when the external threads of the second external thread portion 337 cross-thread with the one or more cross-thread features 536 of the second internal non-threaded portion 535, it may be most beneficial to the user to have as little rotational torque as possible. This can be best managed by making the cross-threading features of the external threads of the second external thread portion 337 and the one or more cross-thread features 536 of the second internal non-threaded portion 535 readily prone to cross thread. A number of ways to minimize the rotational torque may include the use of a softer material to be cross threaded and a harder material doing the cross-threading.

The one or more cross-thread features 536 of the second internal non-threaded portion 535 may comprise a material having a first flexural modulus. The external threads of the second external thread portion 337 may comprise a material having a second flexural modulus. The first flexural modulus may be equal or less that the second flexural modulus. This will enable the external threads of the second external thread portion 337 of the spindle 332 to readily cross-thread the one or more cross-thread features 536 of the second internal non-threaded portion 535 of the movable elevator platform 320 and ensure an optimized balance of lower torque with correctly functioning elevator movement.

Other examples of how the cross-threading can be optimized may include having thinner widths, thicknesses, or cross-sectional areas of the external threads of the second external thread portion 337 cross-threading with the one or more cross-thread features 536 of the second internal non-threaded portion 535. Hence, the resistance to being cross threaded can be minimized while still enabling the movable elevator platform 320 to translate at the rate desired; typically at the second pitch P2 rate.

The cross-threading interaction may be achieved by allowing either the movable elevator platform 320 or the spindle 332 to cross thread each other interchangeably as desired. For this, the external threads of the second external thread portion 337 of the spindle 332 may be more or less stiff than the one or more cross-thread features 536 of the second internal non-threaded portion 535 of the movable elevator platform 320 for optimizing consumer rotational torque.

Figure 11:
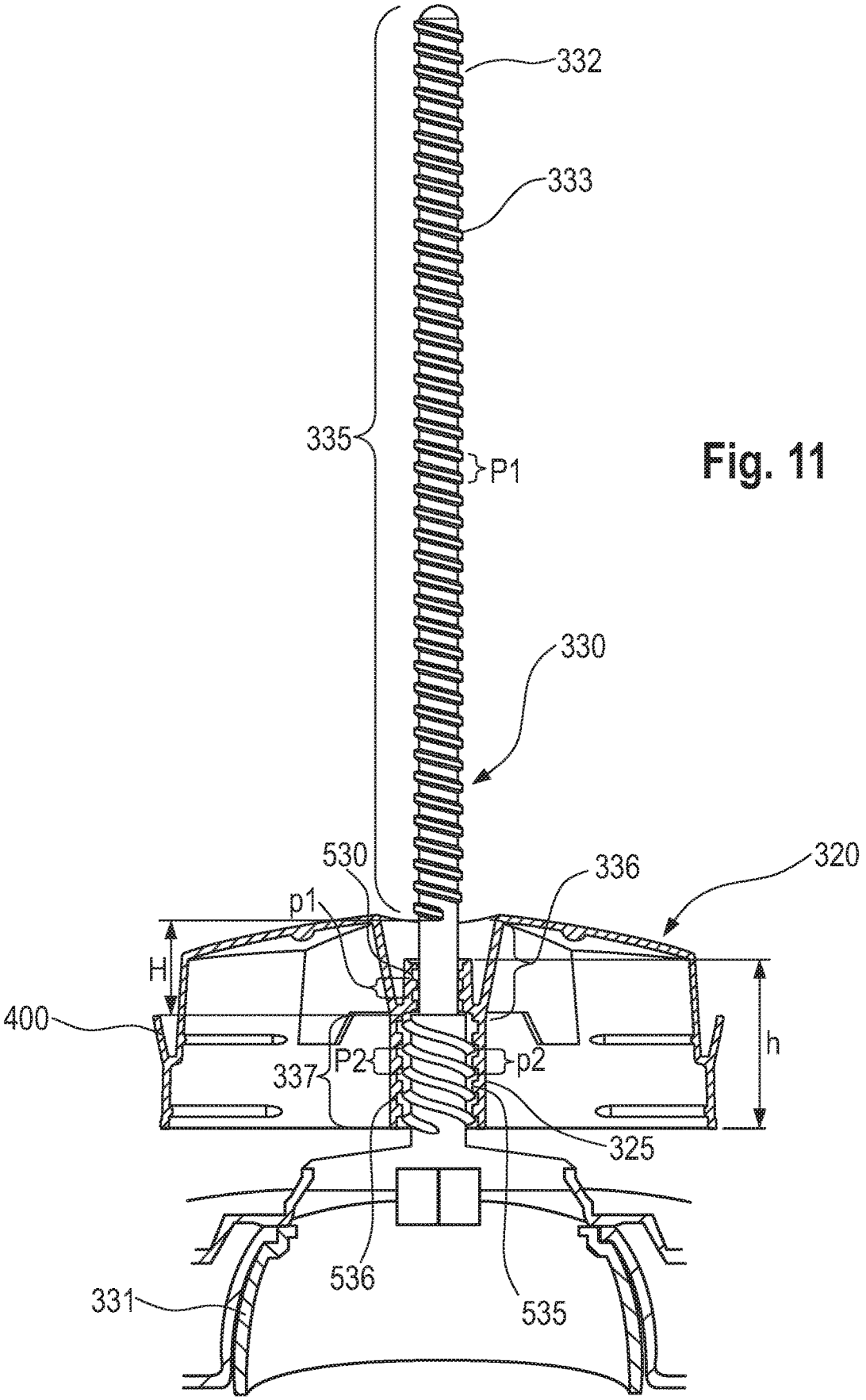
FIG. 11 is a detail, cross sectional view of a screw assembly engaged with a movable elevator platform of the dispensing package according to one or more aspects.

Furthermore, the screw assembly 330 may comprise a spindle 332 including a third non-threaded portion 336 located between the first external thread portion 335 and the second external thread portion 337, as shown in FIG. 11 for illustrating an example.

All embodiments described hereinbefore, for instance in FIGS. 7-10 may preferably include a third non-threaded portion 336 located between the first external thread portion 335 and the second external thread portion 337.

In FIG. 11, the movable elevator platform 320 is located at the proximity of the first end 260 of the jacket, i.e. the bottom opening 260 of the outer jacket or the bottom opening 170 of the product chamber 110. The second external thread portion 337 of the spindle 332 is engaged with the second internal non-threaded portion 535 of the coupling sleeve 325.

When the user applies some torque at the screw base 331 of the screw assembly 330, the spindle 332 rotates which causes the movable elevator platform 320 to advance in a linear direction along the longitudinal axis L of the dispensing package 100. In FIG. 11, the spindle 332 has a third non-threaded portion 336 which is exaggerated in terms of height. When the second external thread portion 337 of the spindle 332 is almost disengaging with the one or more cross-thread features 536 of the second internal non-threaded portion 535 of the coupling sleeve 325, the first external thread portion 335 of the spindle 332 starts engaging with the first internal thread portion 530 of the coupling sleeve 325. The empty space has been overcome at this stage. The first dose of the consumer care product has been then delivered. Now, when the user continues actuating the screw base 331 of the screw assembly 330, further dose will be provided in an accurate manner, in part due to the first pitch P1 of the first external thread portion 335. The presence of the third non-threaded portion 336 allows avoiding the external threads of the respective first and second external thread portions 335, 337 engaging with the corresponding internal threads of the first internal thread portion 530 and with the one or more cross-thread features 536 of the second internal non-threaded portion 535, at the same time. The third non-threaded portion 336 can help to avoid the spindle 332 rotating without no advancement of the platform 320 in a linear direction along the longitudinal axis L of the dispensing package 100 towards the top opening 160 of the product chamber 110.

The third non-threaded portion 336 may have preferably a height H as measured along the longitudinal axis L. The coupling sleeve 325 of the movable elevator platform 320 may have a height h as measured along the longitudinal axis L. The height h of the coupling sleeve 325 comprises, or may preferably consist of the height of the first internal thread portion 530 and the second internal non-threaded portion 535. The height H of the third non-threaded portion 336 may be above the second pitch P2 of the second external thread portion 337 of the spindle 332 and less than the height h of the coupling sleeve 325 of the movable elevator 320.

The height H of the third non-threaded portion 336 may range from 0.1 inch to 1 inch (from 2.54 mm to 25.4 mm), preferably from 0.2 inch to 0.8 inch (from 5.08 mm to 20.32 mm), more preferably from 0.25 inch to 0.75 inch (from 6.35 mm to 19.05 mm).

Alternatively, the dispensing package 100 comprises a screw assembly 330. The screw assembly 330 comprises a screw base 331 disposed adjacent to the first end 260 of the one or more jackets (200, 110), preferably the bottom opening 260 of the outer jacket or the bottom opening 170 of the product chamber 110. The screw assembly 330 is rotatably associated with the one or more jackets (200, 110). The screw assembly 330 includes a spindle 332 that supports external threads 333. The threads may be typically helical. Other forms of threads may be selected from the group consisting of a trapezoidal thread, a saw-tooth thread, a metric isothread, a Withworth thread, a rounded thread, and combinations thereof. The external threads 333 of the spindle 332 may be continuous or interrupted.

The spindle 332 extends from the screw base 331 through the first end 260 of the one or more jackets (200, 110), into the one or more jackets (200, 110) coaxial to the longitudinal axis L of the dispensing package 100. Hence, the spindle 332 may be attached to the screw base 331. Alternatively, the spindle 332 may form with the screw base 331 one single piece.

The spindle 332 comprises a first external thread portion 335 having a first pitch P1; and a second external thread portion 337 having a second pitch P2. The second pitch P2 is larger than the first pitch P1. The second external thread portion 337 may be preferably located at the proximity of the screw base 331 of the screw assembly 330.

The first pitch P1 may range from 0.025 inch to 0.200 inch (from 0.635 mm to 5.08 mm), preferably from 0.030 inch to 0.150 inch (from 0.762 mm to 3.81 mm), more preferably from 0.050 inch to 0.125 inch (from 1.27 mm to 3.175 mm).

The second pitch P2 may range from 0.150 inch to 0.750 inch (from 3.81 mm to 19.05 mm), preferably from 0.175 inch to 0.600 inch (from 4.445 to 15.24 mm), more preferably from 0.200 inch to 0.500 inch (from 5.08 mm to 12.7 mm).

The dispensing package 100 comprises a movable elevator platform 320 which is movably engaged with the spindle 332 of the screw assembly 330. In other words, the movable elevator platform is designed for linear displacement along the spindle 332 by rotation of the spindle 332 in the internal space of the chamber 110 thereof. The movable elevator platform 320 comprises a coupling sleeve 325 having an inner surface 550. The coupling sleeve 325 may be preferably a central opening of the movable elevator platform 320 defining the inner surface 550. The coupling sleeve 325 is coaxial to the longitudinal axis L of the dispensing package 100. The coupling sleeve 325 supports internal threads having a first internal thread portion 530 having a first pitch p1, a second internal non-threaded portion 535 and a third internal thread portion comprising one or a plurality of internal threads. The second internal non-threaded portion 535 is between the first and the third internal thread portions (530, 540). The second internal non-threaded portion 535 may preferably comprise a cylindrical shape. The second internal non-threaded portion 535 may preferably not comprise any cross-thread features as defined hereinbefore for the first alternatives.

The internal threads may be typically helical. Other forms of internal threads may be selected from the group consisting of a trapezoidal internal thread, a saw-tooth internal thread, a metric internal isothread, a Withworth internal thread, a rounded internal thread, and combinations thereof. The internal threads of the movable elevator platform 320 may be continuous or interrupted.

The first external thread portion 335 of the screw assembly 330 can engage with the first internal thread portion 530 of the movable elevator platform 320 along the inner surface 550 of the movable elevator platform 320 such that the first pitch p1 of the first internal thread portion 530 and the first pitch P1 of the first external thread portion 335 are the same.

The second external thread portion 337 of the screw assembly 330 can engage with the third internal thread portion 540 of the movable elevator platform 320 along the inner surface 550 of the movable elevator platform 320.

The third internal thread portion 540 may preferably comprise, more preferably consist of one internal thread. The one internal thread of the third internal thread portion 540 may be preferably a continuous or interrupted helical internal thread, more preferably a continuous or interrupted round internal thread.

Figure 12:
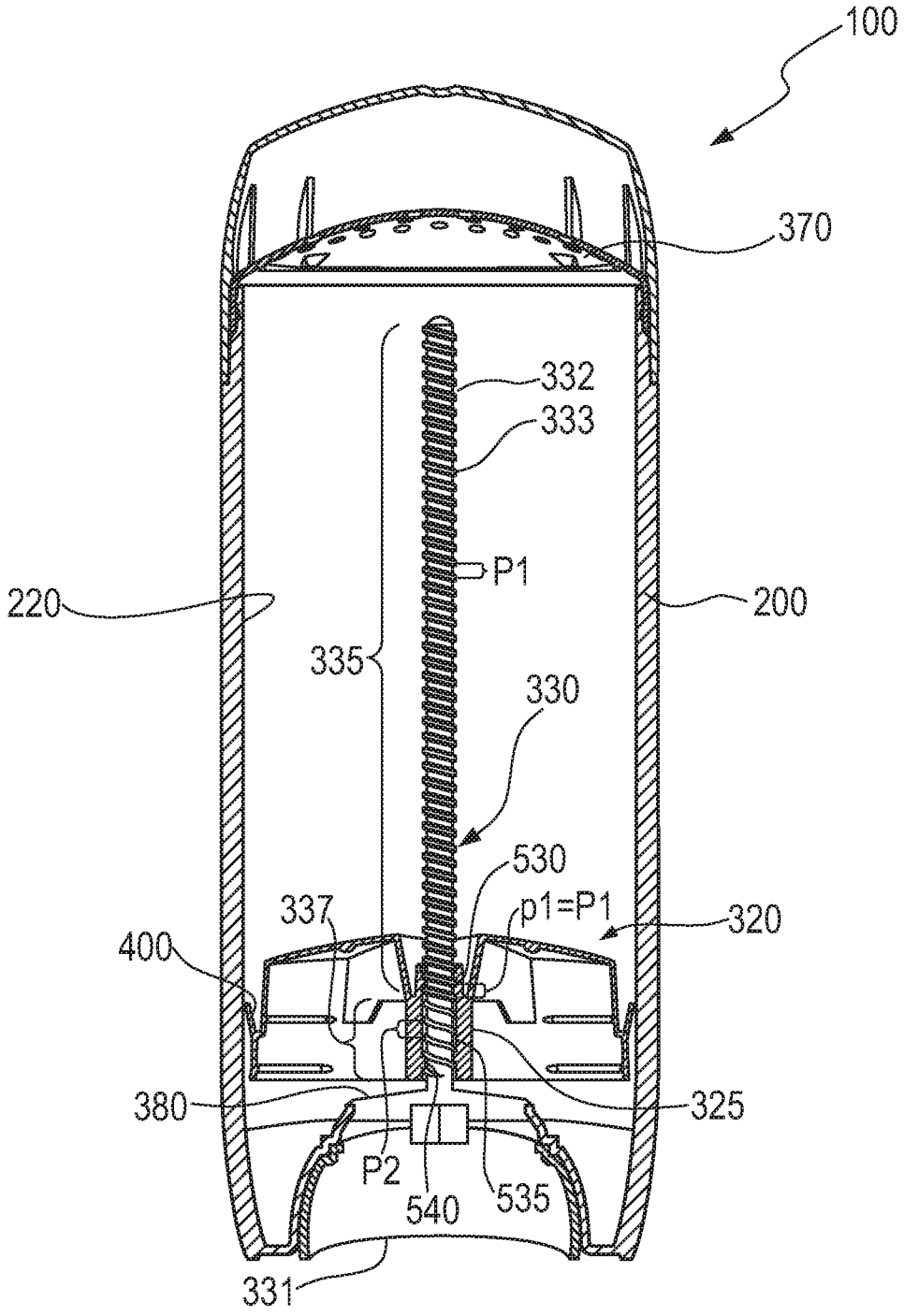
FIG. 12 is a cross sectional view of another dispensing package according to one or more aspects.
Figure 13:
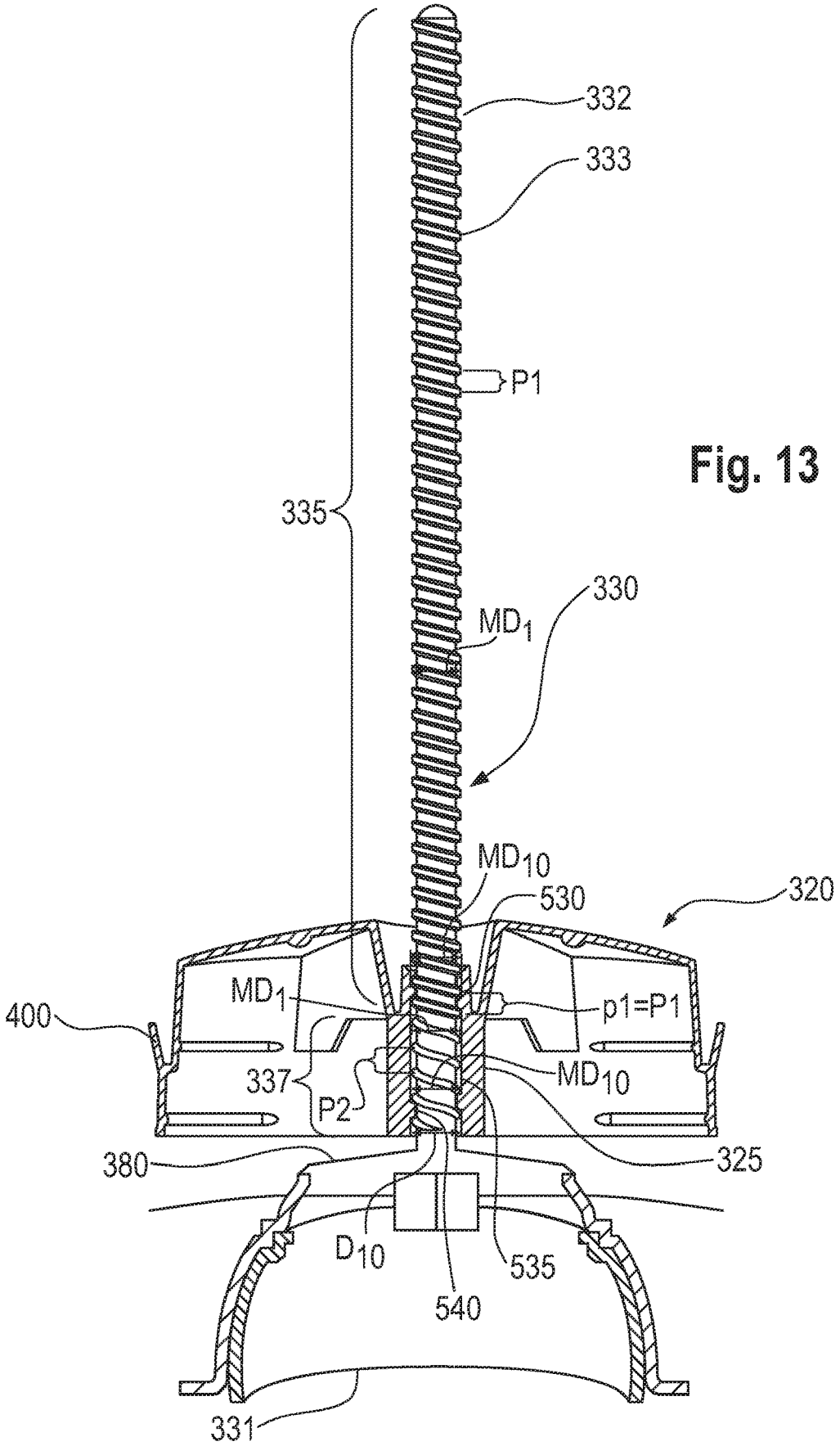
FIG. 13 is a detail, cross sectional view of a screw assembly engaged with a movable elevator platform of the dispensing package of FIG. 12.
Figure 14:
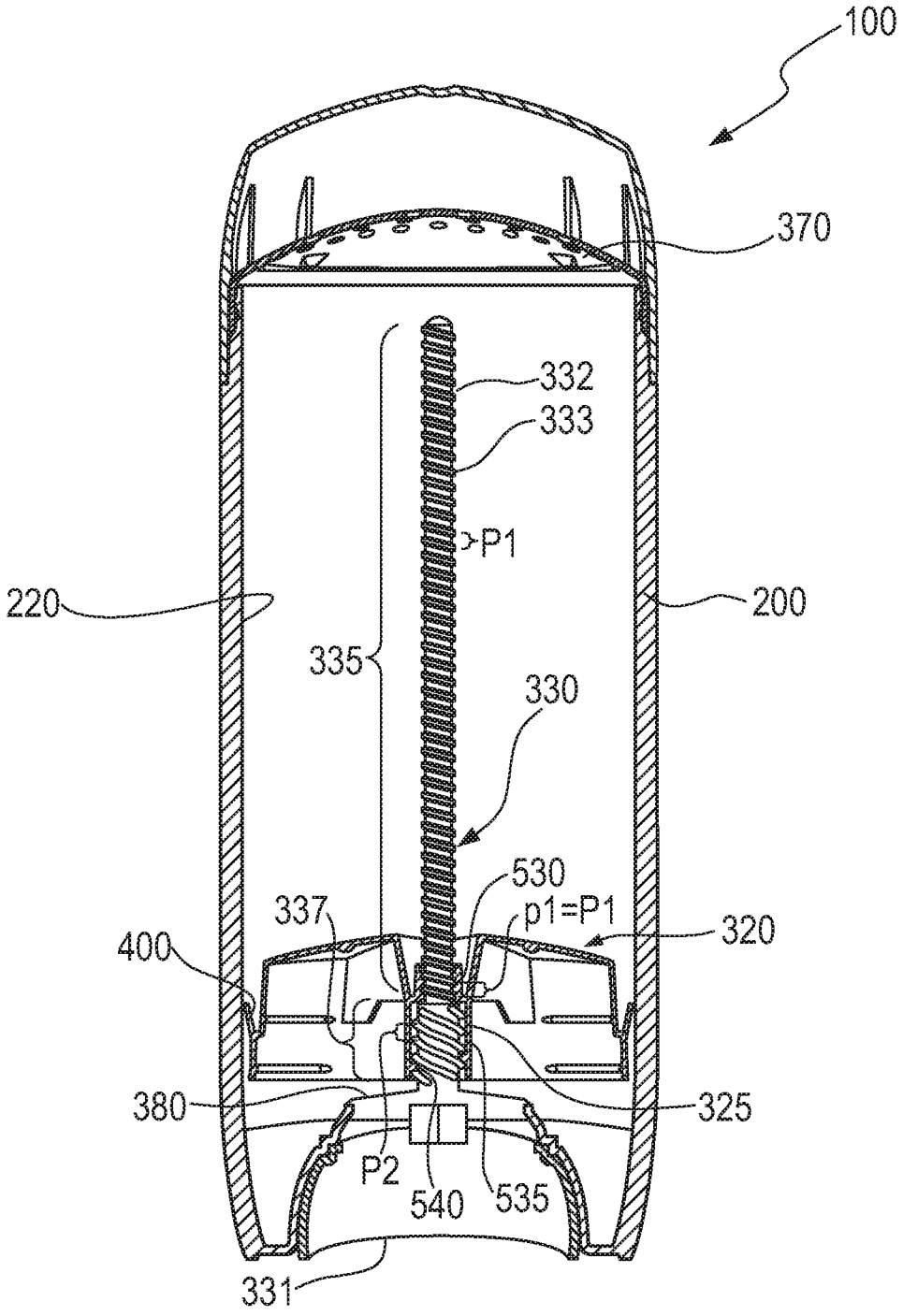
FIG. 14 is a cross sectional view of another dispensing package according to one or more aspects.

As shown in an example in FIGS. 12 and 13, the spindle 332 may comprise a first external thread portion 335 having a first pitch P1; and a second external thread portion 337 having a second pitch P2. The second pitch P2 is larger than the first pitch P1. However, the movable elevator platform 320 may comprise a coupling sleeve 325 having internal threads having a first internal thread portion 530 having the same pitch P1 as the one of the first external thread portion 335 of the spindle 332, a second internal non-threaded portion 535, preferably with no cross-thread features, and a third internal thread portion 540 comprising one internal thread.

In that case, when a user is actuating the screw base 331 of the screw assembly 330 (the operating button for the user), i.e. when a rotational force is applied to the screw base 331 by a user, the screw assembly 330, including the spindle 332, rotates causing the threads 330 to rotate within the coupling sleeve 325 and moving the movable elevator platform 320 in a linear direction along the longitudinal axis L of the dispensing package 100 towards the top opening 160 of the product chamber 110. First, the external threads of the second external thread portion 337 of the spindle 332 engages with the one internal thread of the third internal thread portion 540. When the external threads of the second external thread portion 337 of the spindle 332 engages with the one internal thread of the third internal thread portion 540, the movable elevator platform 320 is propelled as if tapped or matching threads were also included in the third internal thread portion 540 of the coupling sleeve 325. The overall advantage is to gain the fast first dose experience of the consumer care product for the consumer. During the engagement between the external threads of the second external thread portion 337 of the spindle 332 and the one internal thread of the third internal thread portion 540, relatively low torque is required.

Also, the third internal thread portion 540 of the coupling sleeve 325 requires to be manufactured using an unscrewing core having one thread which is preferred in manufacturing.

Furthermore, as illustrated in FIG. 12, and FIG. 13, the dispensing package 100 may comprise a spindle 332 comprising a first external thread portion 335 having a major diameter $MD_1$; and a second external thread portion 337 also having the major diameter $MD_1$. The dispensing package 100 may also comprise a movable elevator platform 320 comprising a coupling sleeve 325 wherein the first internal thread portion 530 has a major diameter $MD_{10}$; and wherein the third internal thread portion 540 has also the major diameter $MD_{10}$.

The second internal non-threaded portion 535 may have a diameter $D_{10}$ which is equal to the major diameter $MD_{10}$. However, as the first and second external thread portion (335, 337) of the spindle 332 have the same major diameter $MD_1$, the external threads of the second external thread portion 337 of the spindle 332 cannot engage with the second internal non-threaded portion 535 as the external threads of the second external thread portion 337 do not tap with the inner surface of the second internal non-threaded portion 535. In other words, the second internal non-threaded portion 535 does not comprise any internal threads or cross-thread features able to engage with the external threads of the second external thread portion 337 of the spindle 332.

In that case, the external threads of the first external thread portion 335 of the spindle 332 can engage with the internal threads of the first internal thread portion 530 of the movable elevator platform 320. Also, the external threads of the second external thread portion 337 of the spindle 332 can engage with the third internal thread portion 540 along the inner surface 550 of the coupling sleeve 325 of the movable elevator platform 320. In other words, the third internal thread portion 540 along the inner surface 550 of the coupling sleeve 325 of the movable elevator platform 320 can engage with the second external thread portion 337 and then with the first external thread portion 335 of the spindle 332 to displace the movable elevator platform 320 in a linear direction along the longitudinal axis L of the dispensing package 100 towards the top opening 160 of the product chamber 110.

Hence, the spindle 332 may comprise one single major diameter $MD_1$, as well as the coupling sleeve 325 may comprise one single diameter being equal to the major diameter $MD_{10}$. Also, it is preferred that each of the major diameter $MD_1$ of the first external thread portion 335 and the second external thread portion 337 of the spindle 332 may be typically smaller than each of the major diameter $MD_{10}$ of the respective first internal thread portion 530 and the third internal thread portion 540 of the coupling sleeve 325.

Here, the actuation of the screw assembly 330 requires less torque to be applied by the consumer. The screw assembly is then easier to turn.

The execution as illustrated in FIG. 12 and FIG. 13 is also relatively easy to manufacture. In that case, the spindle 332 has one single major diameter that matches with the single major diameter of the coupling sleeve 325 of the platform 320. Indeed, the coupling sleeve 325 of the movable elevator platform 320 can be made with one single screw having one single diameter being equal to the major diameter $MD_{10}$ and the pitch of value P1 (the pitch P1 of the first external thread portion 335 of the spindle 332) for making the first internal thread portion 530. The second internal non-threaded portion 535 together with the third internal thread portion 540 having one internal thread can be made by molding the corresponding coupling sleeve using a core comprising the one internal thread feature. The core may preferably have a cylindrical shape with a diameter equal to the major diameter $MD_{10}$.

Each of the major diameter $MD_1$ of the first external thread portion 335 and the second external thread portion 337 of the spindle 332 may be typically smaller than each of the major diameter $MD_{10}$ of the respective first internal thread portion 530 and the third internal thread portion 540 of the coupling sleeve 325.

Each of the major diameter $MD_1$ of the first external thread portion 335 and the second external thread portion 337 of the spindle 332 may be slightly smaller than each of the major diameter $MD_{10}$ of the respective first internal thread portion 530 and the third internal thread portion 540 of the coupling sleeve 325. Hence, having the major diameter $MD_1$ slightly smaller than the major diameter $MD_{10}$ can help to increase the friction between the first external thread portion 335 of the spindle 332 and the first internal thread portion 530 of the coupling sleeve 325; and the friction between the second external thread portion 337 of the spindle 332 and the third internal thread portion 540 of the coupling sleeve 325.

Alternatively, the dispensing package may comprise the spindle 332 wherein the first external thread portion 335 has a major diameter $MD_1$ and wherein the second external thread portion 337 has a major diameter $MD_2$. The major diameter $MD_2$ of the second external thread portion 337 may be larger than the major diameter $MD_1$ of the first external thread portion 335.

The dispensing package may comprise the coupling sleeve 325 of the movable elevator platform 320, wherein the first internal thread portion 530 has a major diameter $MD_{10}$; and wherein the third internal thread portion 540 has a major diameter $MD_{20}$.

The major diameter $MD_{20}$ of the third internal thread portion 540 may be larger than the major diameter $MD_{10}$ of the first internal thread portion 530.

The second internal non-threaded portion 535 may have a diameter $D_{20}$, which may be equal to the major diameter $MD_{20}$ of the third internal thread portion 540. However, as the second external thread portion 337 of the spindle 332 having the major diameter $MD_2$ smaller than the major diameter $MD_{20}$ of the third internal thread portion 540, the external threads of the second external thread portion 337 of the spindle 332 cannot engage with the second internal non-threaded portion 535 having no cross-thread features, as the external threads of the second external thread portion 337 do not tap with the inner surface of the second internal non-threaded portion 535.

Figure 15:
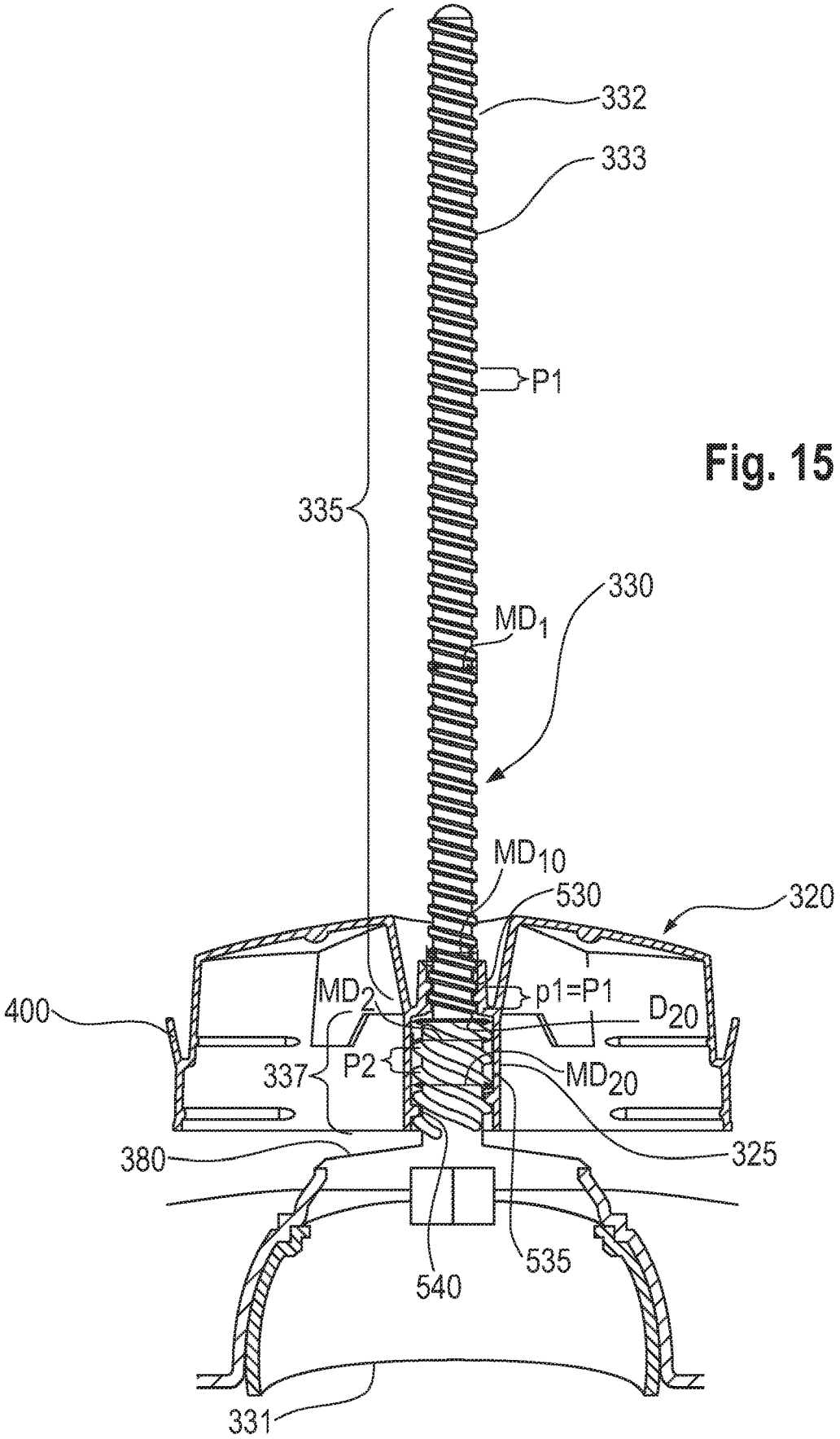
FIG. 15 is a detail, cross sectional view of a screw assembly engaged with a movable elevator platform of the dispensing package of FIG. 14.

In that case, the external threads of the first external thread portion 335 of the spindle 332 can engage with the internal threads of the first internal thread portion 530 of the movable elevator platform 320. Also, the external threads of the second external thread portion 337 of the spindle 332 can engage with the third internal thread portion 540 of the movable elevator platform 320, as shown as an example in FIGS. 15 and 16. In other words, the third internal thread portion 540 along the inner surface 550 of the coupling sleeve 325 of the movable elevator platform 320 can engage with the second external thread portion 337 and then with the first external thread portion 335 of the spindle 332 to displace the movable elevator platform 320 in a linear direction along the longitudinal axis L of the dispensing package 100 towards the top opening 160 of the product chamber 110.

Preferably, the major diameter of external threads may be typically smaller than the major diameter of the internal thread portions. Hence, the major diameter $MD_1$ of the first external thread portion 335 of the spindle 332 may be smaller than the major diameter $MD_{10}$ of the first internal thread portion 530 of the coupling sleeve 325. Also, the major diameter $MD_2$ of the second external thread portion 337 of the spindle 332 may be smaller than the major diameter $MD_{20}$ of the third internal thread portion 540 of the coupling sleeve 325.

Having a relatively larger major diameter $MD_{20}$ of the third internal thread portion 540 and a relatively larger major diameter $MD_2$ of the second external thread portion 337 with regard to the respective major diameter $MD_{10}$ of the first internal thread portion 530 and the major diameter $MD_1$ of the first external thread portion 335 can help to displace relatively faster the movable elevator platform 320 upwards in the product chamber 110 in order to dispense the first dose of the consumer care product to the consumer.

More preferably, the major diameter of external threads may be slightly smaller than the major diameter of the internal thread portions. Hence, the major diameter $MD_1$ of the first external thread portion 335 of the spindle 332 may be slightly smaller than the major diameter $MD_{10}$ of the first internal thread portion 530 of the coupling sleeve 325. Also, the major diameter $MD_2$ of the second external thread portion 337 of the spindle 332 may be slightly smaller than the major diameter $MD_{20}$ of the third internal thread portion 540 of the coupling sleeve 325. Hence, having the major diameter $MD_1$ slightly smaller than the major diameter $MD_{10}$; and having the major diameter $MD_2$ slightly smaller than the major diameter $MD_{20}$ can help to increase the friction of the first external thread portion 335 of the spindle 332 with the first internal thread portion 530 of the coupling sleeve 325; and the second external thread portion 337 of the spindle 332 with the third internal thread portion 540 of the coupling sleeve 325.

Alternatively, as set out hereinabove, the coupling sleeve 325 supports internal threads having a first internal thread portion 530 having a first pitch p1, a second internal non-threaded portion 535 and a third internal thread portion comprising one or a plurality of internal threads. The second internal non-threaded portion 535 is between the first and the third internal thread portions (530, 540).

The first external thread portion 335 of the screw assembly 330 can engage with the first internal thread portion 530 of the movable elevator platform 320 along the inner surface 550 of the movable elevator platform 320 such that the first pitch p1 of the first internal thread portion 530 and the first pitch P1 of the first external thread portion 335 are the same.

The second external thread portion 337 of the screw assembly 330 can engage with the third internal thread portion 540 of the movable elevator platform 320 along the inner surface 550 of the movable elevator platform 320.

The third internal thread portion 540 may preferably comprise a plurality of internal threads. The third internal thread portion 540 may have a second pitch p2. The second external thread portion 337 of the screw assembly 330 may engage with the third internal thread portion 540 of the movable elevator platform 320 along the inner surface 550 of the movable elevator platform 320, such that the second pitch p2 of the third internal thread portion 540 is comprised between the first pitch P1 of the first external thread portion 335 and the second pitch P2 of the second external thread portion 337.

The first pitch p1 may range from 0.025 inch to 0.200 inch (from 0.635 mm to 5.08 mm), preferably from 0.030 inch to 0.150 inch (from 0.762 mm to 3.81 mm), more preferably from 0.050 inch to 0.125 inch (from 1.27 mm to 3.175 mm).

The second pitch p2 may range from 0.150 inch to 0.750 inch (from 3.81 mm to 19.05 mm), preferably from 0.175 inch to 0.600 inch (from 4.445 to 15.24 mm), more preferably from 0.200 inch to 0.500 inch (from 5.08 mm to 12.7 mm).

The movable elevator platform 320 may comprise internal threads having first and third internal thread portions 530, 540. The internal threads of the first internal thread portion 530 may have the same pitch as the external threads of the first external thread portion 335 of the spindle 332. Hence, the spindle 332 and the movable elevator platform 332 are matching together when the first external thread portion 335 of the screw assembly 330 is engaged with the first internal thread portion 530 of the movable elevator platform 320.

The internal threads of the third internal thread portion 540 may have a pitch that can vary from the first pitch P1 of the first external thread portion 335 to the second pitch P2 of the second external thread portion 337.

The second external thread portion 337 of the screw assembly 330 may preferably engage with the third internal thread portion 540 of the movable elevator platform 320 along the inner surface 550 of the movable elevator platform 320 such that the second pitch p2 of the third internal thread portion 540 and the first pitch P1 of the first external thread portion 335 are the same.

The first pitch P1 may range from 0.025 inch to 0.200 inch (from 0.635 mm to 5.08 mm), preferably from 0.030 inch to 0.150 inch (from 0.762 mm to 3.81 mm), more preferably from 0.050 inch to 0.125 inch (from 1.27 mm to 3.175 mm).

The second pitch P2 may range from 0.150 inch to 0.750 inch (from 3.81 mm to 19.05 mm), preferably from 0.175 inch to 0.600 inch (from 4.445 to 15.24 mm), more preferably from 0.200 inch to 0.500 inch (from 5.08 mm to 12.7 mm).

The first pitch p1 as the second pitch p2 may therefore range from 0.025 inch to 0.200 inch (from 0.635 mm to 5.08 mm), preferably from 0.030 inch to 0.150 inch (from 0.762 mm to 3.81 mm), more preferably from 0.050 inch to 0.125 inch (from 1.27 mm to 3.175 mm).

Figure 16:
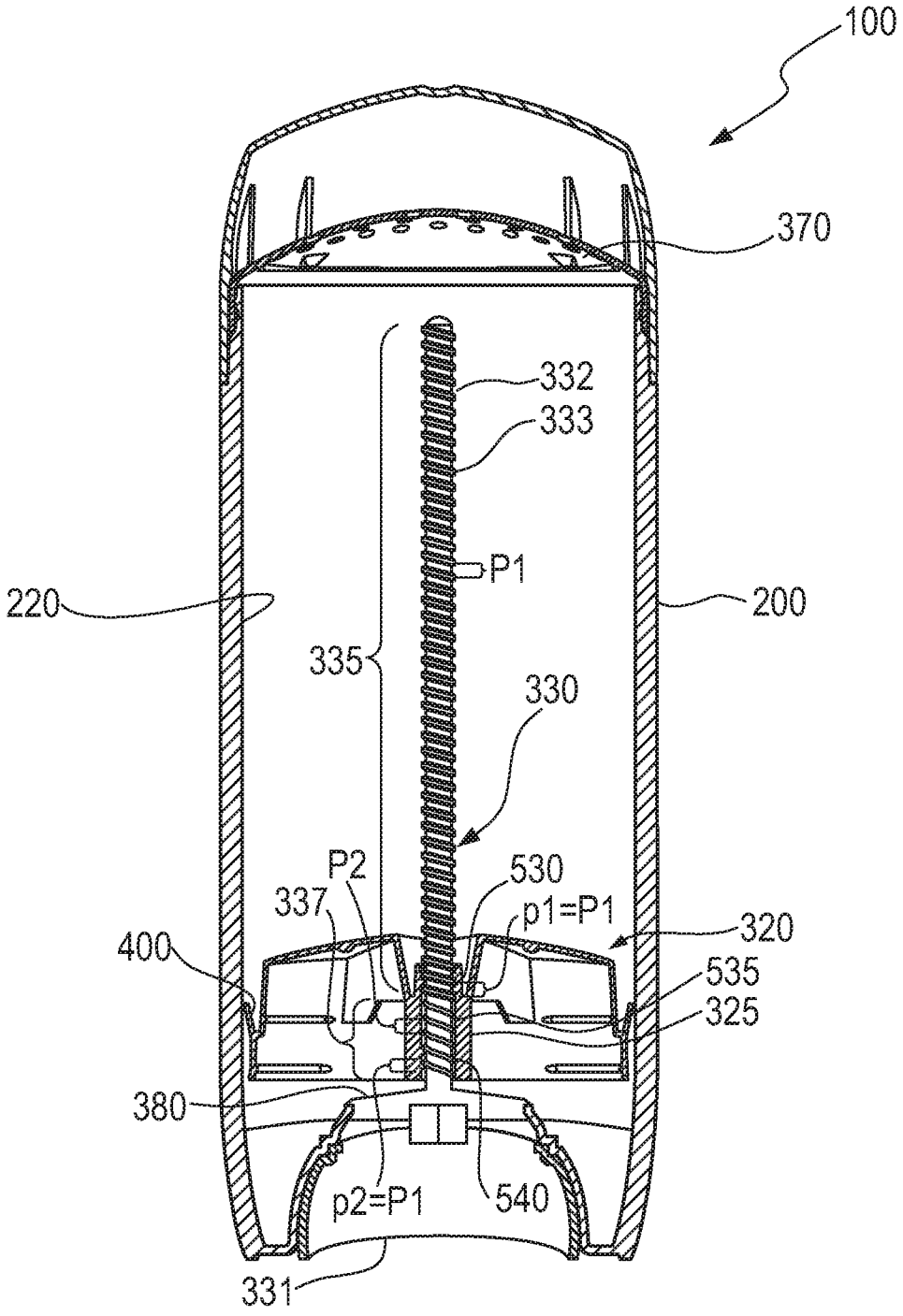
FIG. 16 is a cross sectional view of another dispensing package according to one or more aspects.
Figure 17:
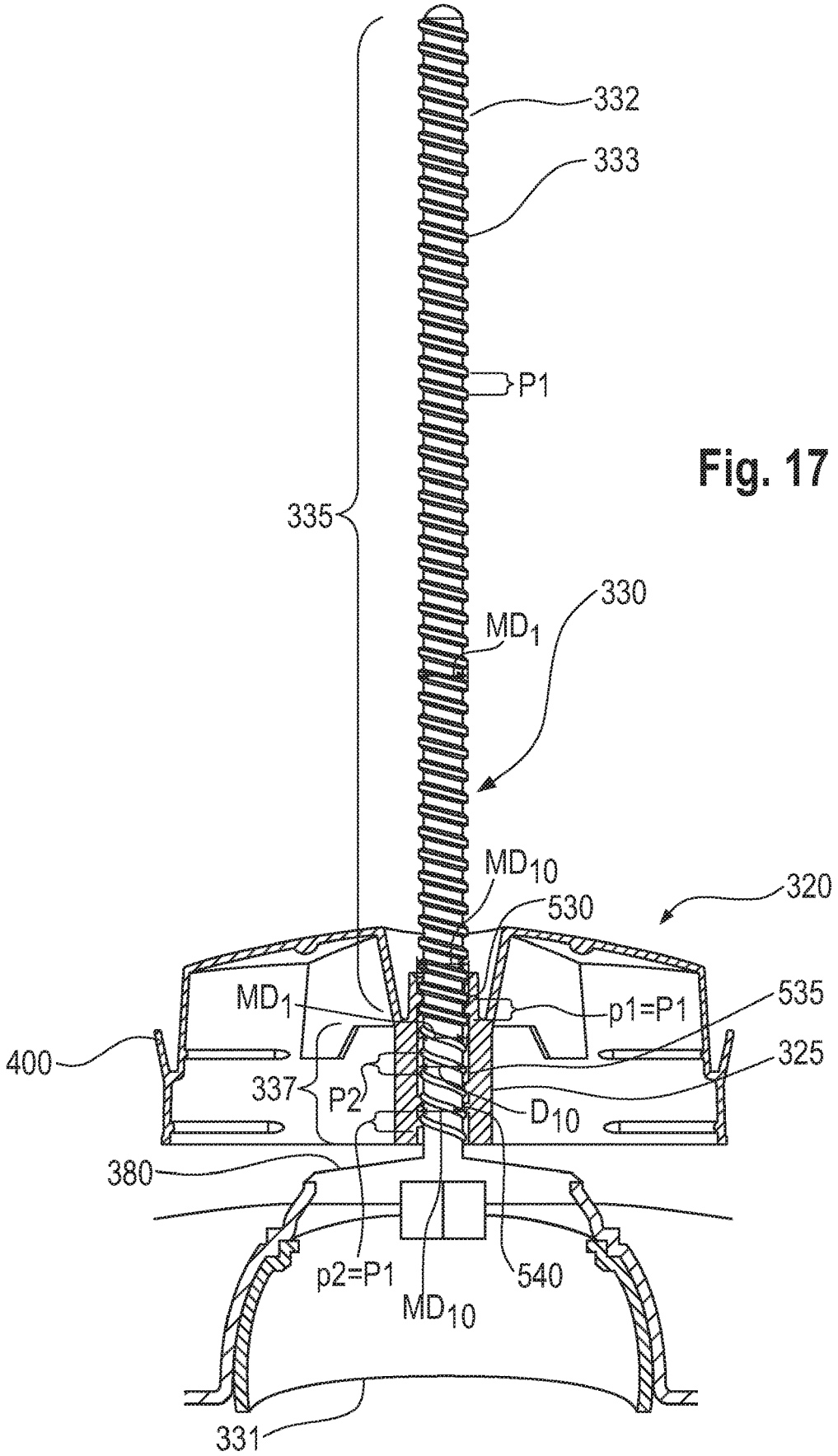
FIG. 17 is a detail, cross sectional view of a screw assembly engaged with a movable elevator platform of the dispensing package of FIG. 16.
Figure 20:
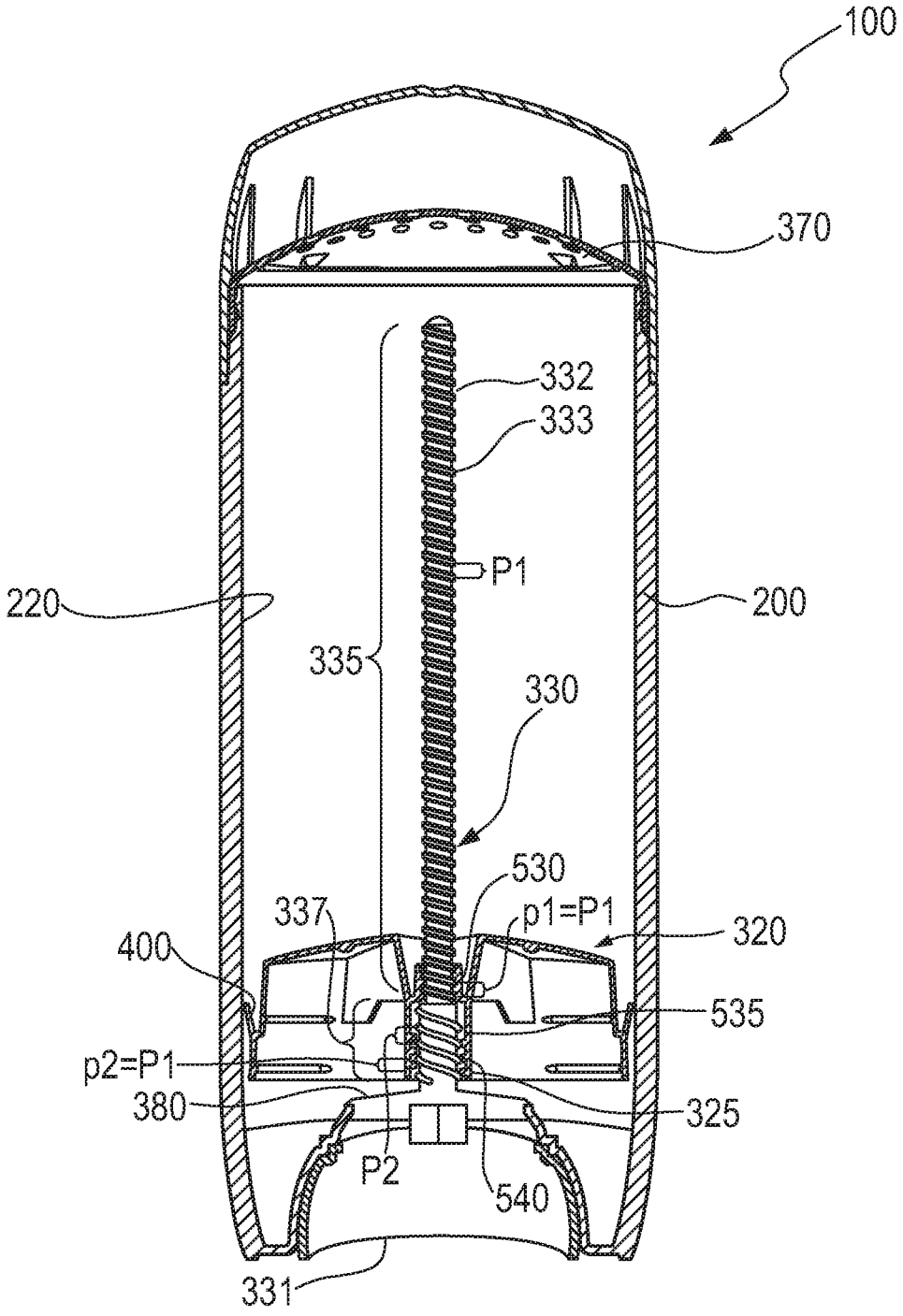
FIG. 20 is a cross sectional view of another dispensing package according to one or more aspects.
Figure 21:
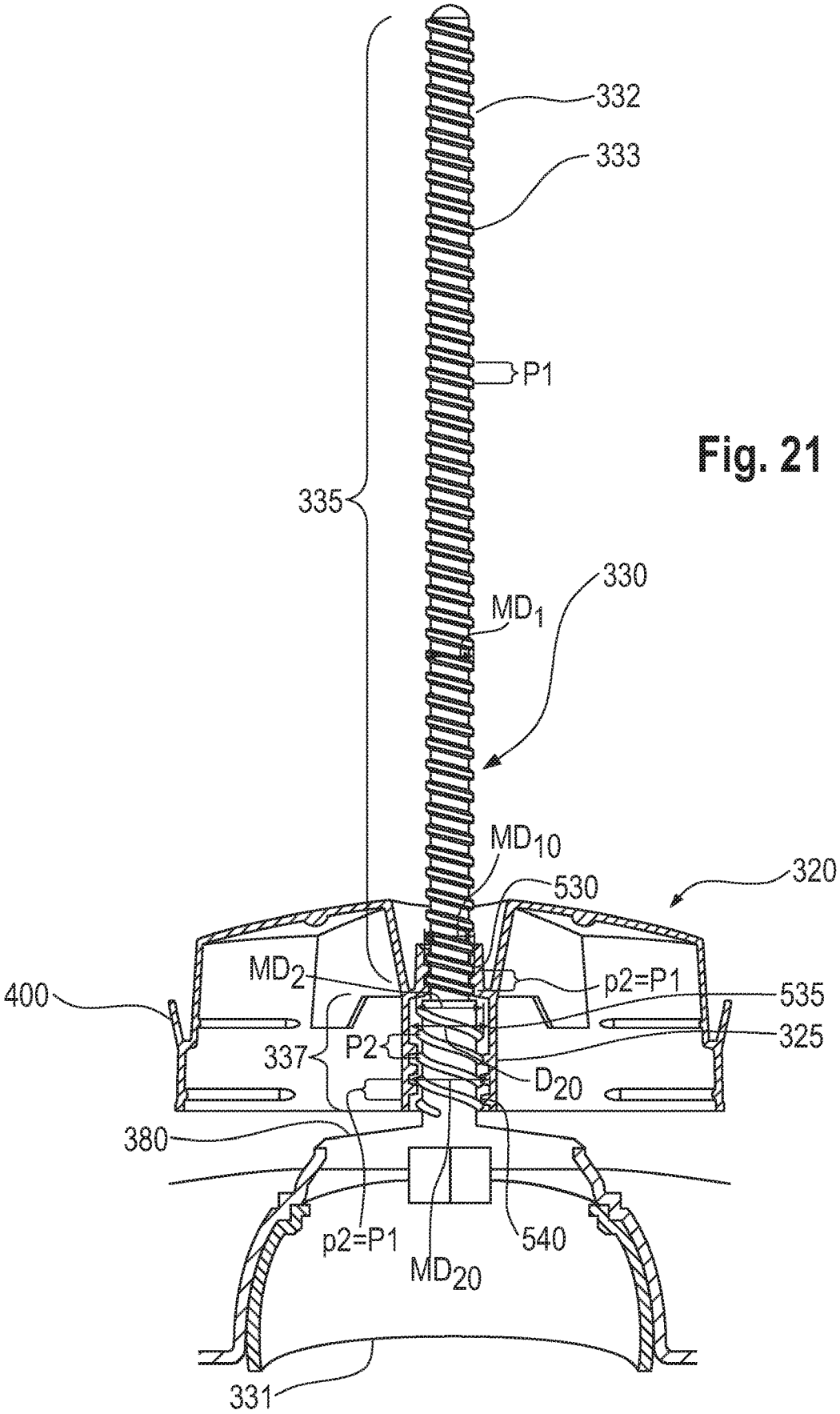
FIG. 21 is a detail, cross sectional view of a screw assembly engaged with a movable elevator platform of the dispensing package of FIG. 20.

As shown in FIGS. 16 and 17, also in FIGS. 20 and 21, the spindle 332 may comprise a first external thread portion 335 having a first pitch P1; and a second external thread portion 337 having a second pitch P2. However, the movable elevator platform 320 may comprise a coupling sleeve 325 having internal threads having first and third internal thread portions 530, 540 having the same pitch P1 as the one of the first external thread portion 335 of the spindle 332.

In that case, when a user is actuating the screw base 331 of the screw assembly 330 (the operating button for the user), i.e. when a rotational force is applied to the screw base 331 by a user, the screw assembly 330, including the spindle 332, rotates causing the threads 330 to rotate within the coupling sleeve 325 and moving the movable elevator platform 320 in a linear direction along the longitudinal axis L of the dispensing package 100.

First, because the third internal thread portion 540 of the movable elevator platform 320 has not the same pitch as the second external thread portion 337 of the spindle 332, the external threads of the second external thread portion 337 cross-thread with the internal threads of the third internal thread portion 540, and then with the second internal non-threaded portion 535. As the second pitch P2 of the second external thread portion 337 is larger than the first pitch P1 of the first external thread portion 335, the movable elevator platform 320 is moved with a greater advance towards the top opening 160 of the product chamber 110. Hence, the empty space can be overcome and the first dose of the consumer care product can be dispensed more quickly. As the coupling sleeve 325 of the movable elevator platform 320 comprises internal threads, the platform 320 when moving in a linear direction along the longitudinal axis L of the dispensing package 100, is stabilized and the risk of having the platform 320 rocking is also prevented.

In that preferred execution, because the external threads of the second external thread portion 337 of the spindle 332 cross-thread with the internal threads of the third internal thread portion 540 of the coupling sleeve 325, the user may slightly feel that he needs some more torque to rotate the screw base 331, however, the problem of the empty space is readily overcome though. In other words, when cross-threading together the second external thread portion 337 with the third internal thread portion 540, the second external thread portion 337 and the third internal thread portion 540 are engaged with each other without aligning the threads correctly. Therefore, the user may slightly feel that he needs some more torque to rotate the screw base 331.

When cross-threading is needed, i.e. in the case when the external threads of the second external thread portion 337 cross-thread with the internal threads of the third internal thread portion 540, it may be most beneficial to the user to have as little rotational torque as possible. This can be best managed by making the cross-threading features of the external threads of the second external thread portion 337 and the internal threads of the third internal thread portion 540 readily prone to cross thread. A number of ways to minimize the rotational torque may include the use of a softer material to be cross threaded and a harder material doing the cross-threading.

The internal threads of the third internal thread portion 540 may comprise a material having a first flexural modulus. The external threads of the second external thread portion 337 may comprise a material having a second flexural modulus. The first flexural modulus may be equal or less that the second flexural modulus. This will enable the external threads of the second external thread portion 337 of the spindle 332 to readily cross-thread the internal threads of the third internal thread portion 540 of the movable elevator platform 320 and ensure an optimized balance of lower torque with correctly functioning elevator movement.

Other examples of how the cross-threading can be optimized may include having thinner widths, thicknesses, or cross-sectional areas of the external threads of the second external thread portion 337 cross-threading with the internal threads of the third internal thread portion 540. Hence, the resistance to being cross threaded can be minimized while still enabling the movable elevator platform 320 to translate at the rate desired; typically at the second pitch P2 rate.

The cross-threading interaction may be achieved by allowing either the movable elevator platform 320 or the spindle 332 to cross thread each other interchangeably as desired. For this, the external threads of the second external thread portion 337 of the spindle 332 may be more or less stiff than the internal threads of the third internal thread portion 540 of the movable elevator platform 320 for optimizing consumer rotational torque.

To decrease the feeling that more torque is required to actuate the screw assembly for the first time, alternatively, the second external thread portion 337 of the screw assembly 330 may preferably engage with the third internal thread portion 540 of the movable elevator platform 320 along the inner surface 550 of the movable elevator platform 320 such that the second pitch p2 of the third internal thread portion 540 and the second pitch P2 of the second external thread portion 337 are the same.

The first pitch P1 may range from 0.025 inch to 0.200 inch (from 0.635 mm to 5.08 mm), preferably from 0.030 inch to 0.150 inch (from 0.762 mm to 3.81 mm), more preferably from 0.050 inch to 0.125 inch (from 1.27 mm to 3.175 mm).

The second pitch P2 may range from 0.150 inch to 0.750 inch (from 3.81 mm to 19.05 mm), preferably from 0.175 inch to 0.600 inch (from 4.445 to 15.24 mm), more preferably from 0.200 inch to 0.500 inch (from 5.08 mm to 12.7 mm).

The first pitch p1 may range from 0.025 inch to 0.200 inch (from 0.635 mm to 5.08 mm), preferably from 0.030 inch to 0.150 inch (from 0.762 mm to 3.81 mm), more preferably from 0.050 inch to 0.125 inch (from 1.27 mm to 3.175 mm).

The second pitch p2 may range from 0.150 inch to 0.750 inch (from 3.81 mm to 19.05 mm), preferably from 0.175 inch to 0.600 inch (from 4.445 to 15.24 mm), more preferably from 0.200 inch to 0.500 inch (from 5.08 mm to 12.7 mm).

Figure 18:
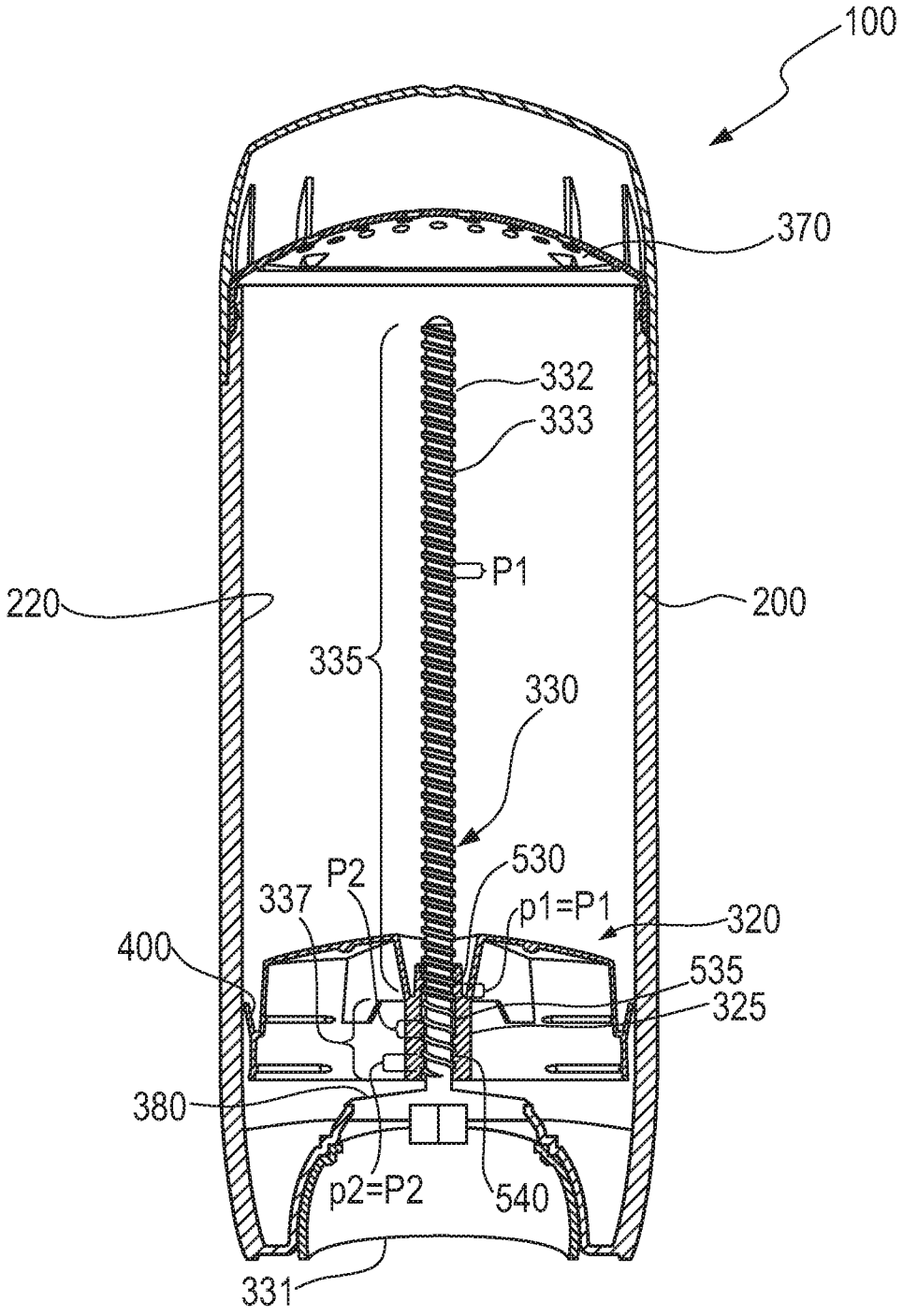
FIG. 18 is a cross sectional view of another dispensing package according to one or more aspects.
Figure 19:
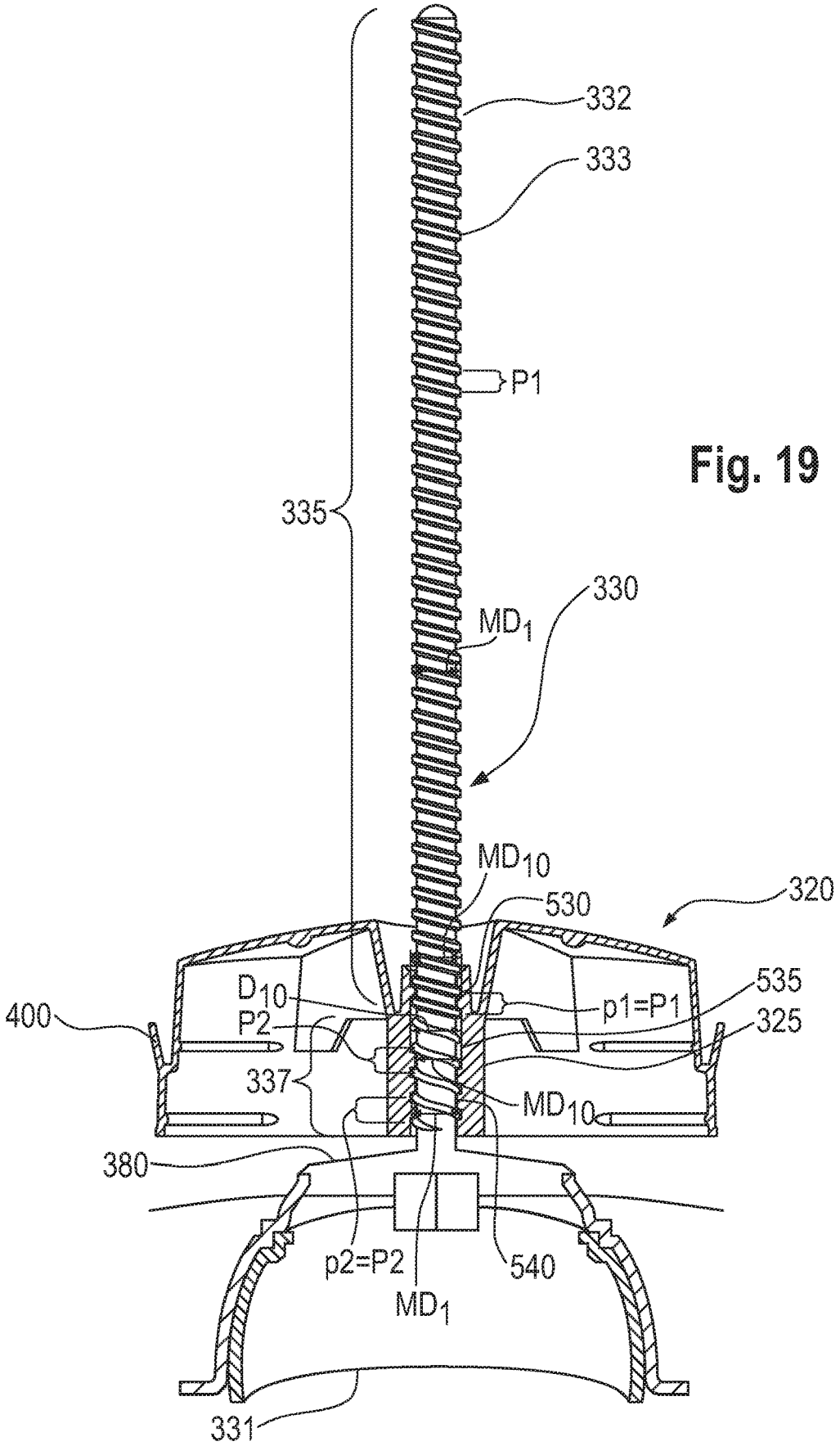
FIG. 19 is a detail, cross sectional view of a screw assembly engaged with a movable elevator platform of the dispensing package of FIG. 18.
Figure 22:
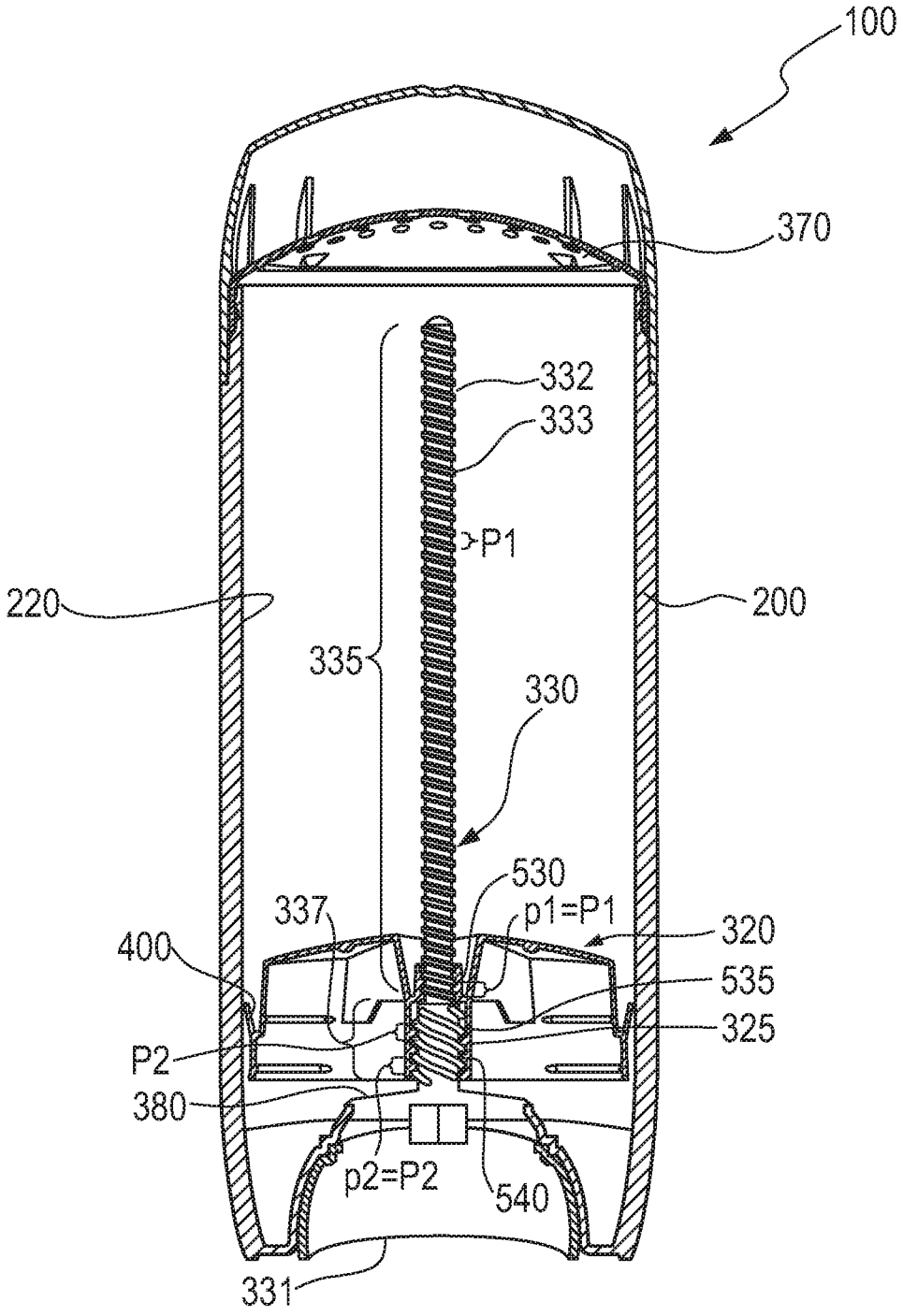
FIG. 22 is a cross sectional view of another dispensing package according to one or more aspects.
Figure 23:
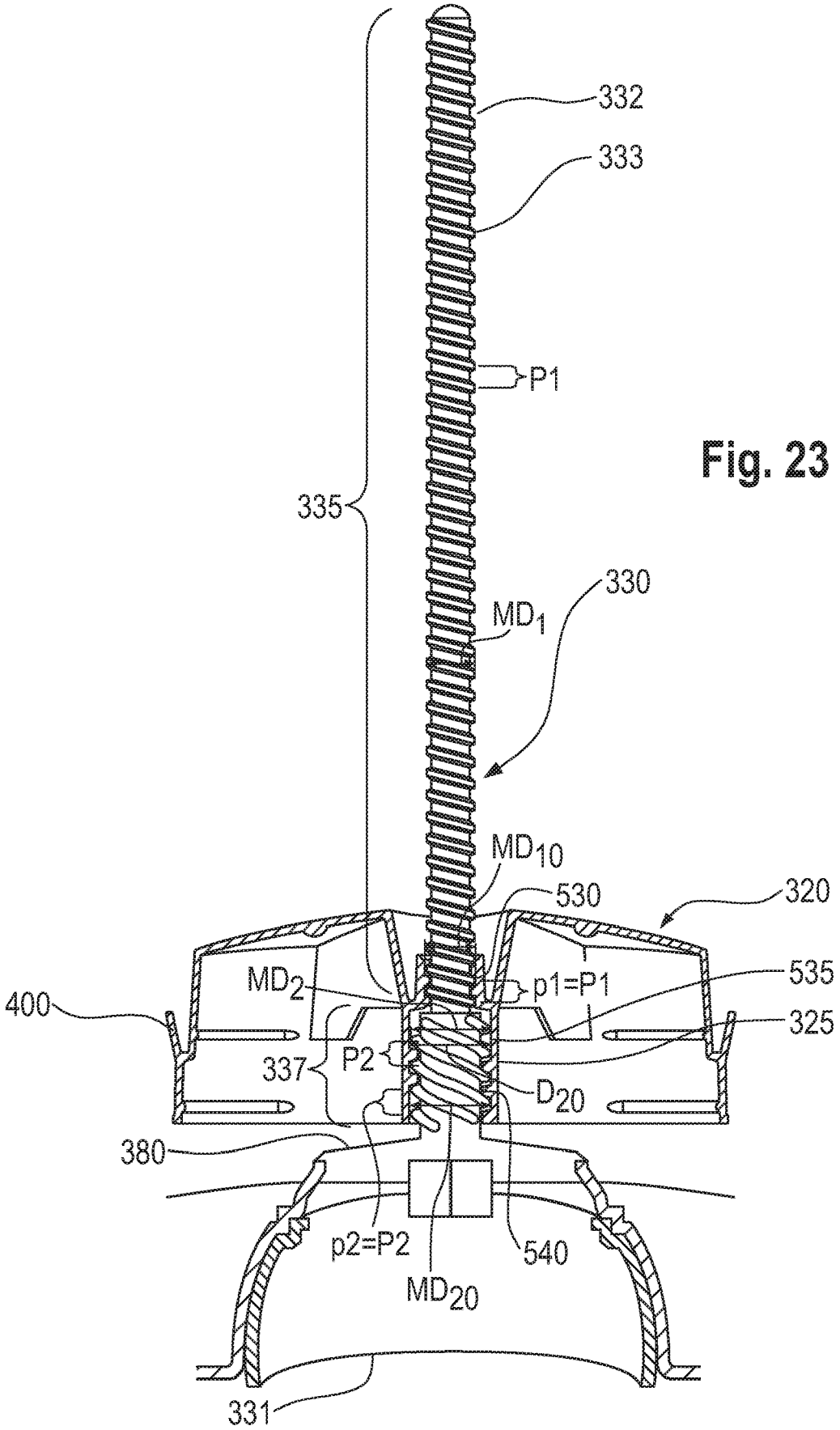
FIG. 23 is a detail, cross sectional view of a screw assembly engaged with a movable elevator platform of the dispensing package of FIG. 22.

As shown in FIGS. 18 and 19, and in FIGS. 22 and 23, the internal threads of the third internal thread portion 540 of the coupling sleeve 325 match with the external threads of the second external thread portion 337 (as p2=P2). Also, the internal threads of the first internal thread portion 530 of the coupling sleeve 325 match with the external threads of the first external thread portion 335 (as p1=P1). The movable elevator platform 320 first engages with the second external thread portion 337 of the spindle 332 and then with the first external thread portion 335 of the spindle 332 when the user continues applying a rotational force to the screw base 331. Because the respective portions of the spindle 332 match with the respective portions of the coupling sleeve 325, less torque is needed to be applied when actuating the screw base 331 of the screw assembly 330 for making advance the platform 320 in a linear direction along the longitudinal axis L of the dispensing package 100.

One skilled in the art can elaborate different kinds of spindles 332 able to engage with the respective movable elevator platforms 320 as long as:

- the second pitch P2 of the second external thread portion 337 is larger than the first pitch P1 of the first external thread portion 335;
- the first pitch p1 of the first internal thread portion 530 and the first pitch P1 of the first external thread portion 335 are the same; and
- the second pitch p2 of the third internal thread portion 540 is comprised between the first pitch P1 of the first external thread portion 335 and the second pitch P2 of the second external thread portion 337.

These features can advantageously help to displace quicker the movable elevator platform 320 upwards in the product chamber 110 in order to overcome the empty space while preventing any rocking of the platform 320 at the same time.

Furthermore, as illustrated in FIGS. 16 and 17, but also in FIG. 18 and FIG. 19 the dispensing package 100 may comprise a spindle 332 comprising a first external thread portion 335 having a major diameter $MD_1$; and a second external thread portion 337 also having the major diameter $MD_1$. The dispensing package 100 may also comprise a movable elevator platform 320 comprising a coupling sleeve 325 wherein the first internal thread portion 530 has a major diameter $MD_{10}$; and wherein the third internal thread portion 540 has the major diameter $MD_{10}$. In that case, the external threads of the first external thread portion 335 of the spindle 332 can engage with the internal threads of the first internal thread portion 530 of the movable elevator platform 320. Also, the external threads of the second external thread portion 337 of the spindle 332 can engage with the internal threads of the third internal thread portion 540 of the movable elevator platform 320. In other words, the third internal thread portion 540 along the inner surface 550 of the coupling sleeve 325 of the movable elevator platform 320 can engage with the second external thread portion 337 and then with the first external thread portion 335 of the spindle 332 to displace the movable elevator platform 320 in a linear direction along the longitudinal axis L of the dispensing package 100 towards the top opening 160 of the product chamber 110. Hence, the spindle 332 may comprise one single major diameter $MD_1$, as well as the coupling sleeve 325 may comprise one single diameter being equal to the major diameter $MD_{10}$.

The second internal non-threaded portion 535 may have a diameter $D_{10}$ which is equal to the major diameter $MD_{10}$. However, as the first and second external thread portion (335, 337) of the spindle 332 have the same major diameter $MD_1$, the external threads of the second external thread portion 337 of the spindle 332 cannot engage with the second internal non-threaded portion 535, having no cross-thread features, as the external threads of the second external thread portion 337 do not tap with the inner surface of the second internal non-threaded portion 535.

Here, the actuation of the screw assembly 330 requires less torque to be applied by the consumer. The screw assembly is then easier to turn.

The preferred execution as illustrated in FIG. 16 and FIG. 17 is also relatively easy to manufacture. In that case, the spindle 332 has one single major diameter that matches with the single diameter of the coupling sleeve 325 of the platform 320. Indeed, the coupling sleeve 325 of the movable elevator platform 320 can be made with one single screw having one single diameter being equal to the major diameter $MD_{10}$ and the pitch of value P1 (the pitch P1 of the first external thread portion 335 of the spindle 332) for the first and third internal thread portions (530, 540).

Alternatively, the coupling sleeve 325 of the movable elevator platform 320 can be made with one screw having one single major diameter $MD_{10}$ and the pitch of value P1 for the first internal thread portion 530. Then, the second internal non-threaded portion 535 and the third internal thread portion 540 can be made together with a core comprising a first portion, preferably comprising a cylindrical shape, having one single diameter being equal to the major diameter $MD_{10}$ with no internal threads for making the second internal non-threaded portion 535; and a second portion, preferably comprising a plurality of internal threads having the major diameter $MD_{10}$ and the pitch of value P1 for making the third internal thread portion 540.

Figure 9:
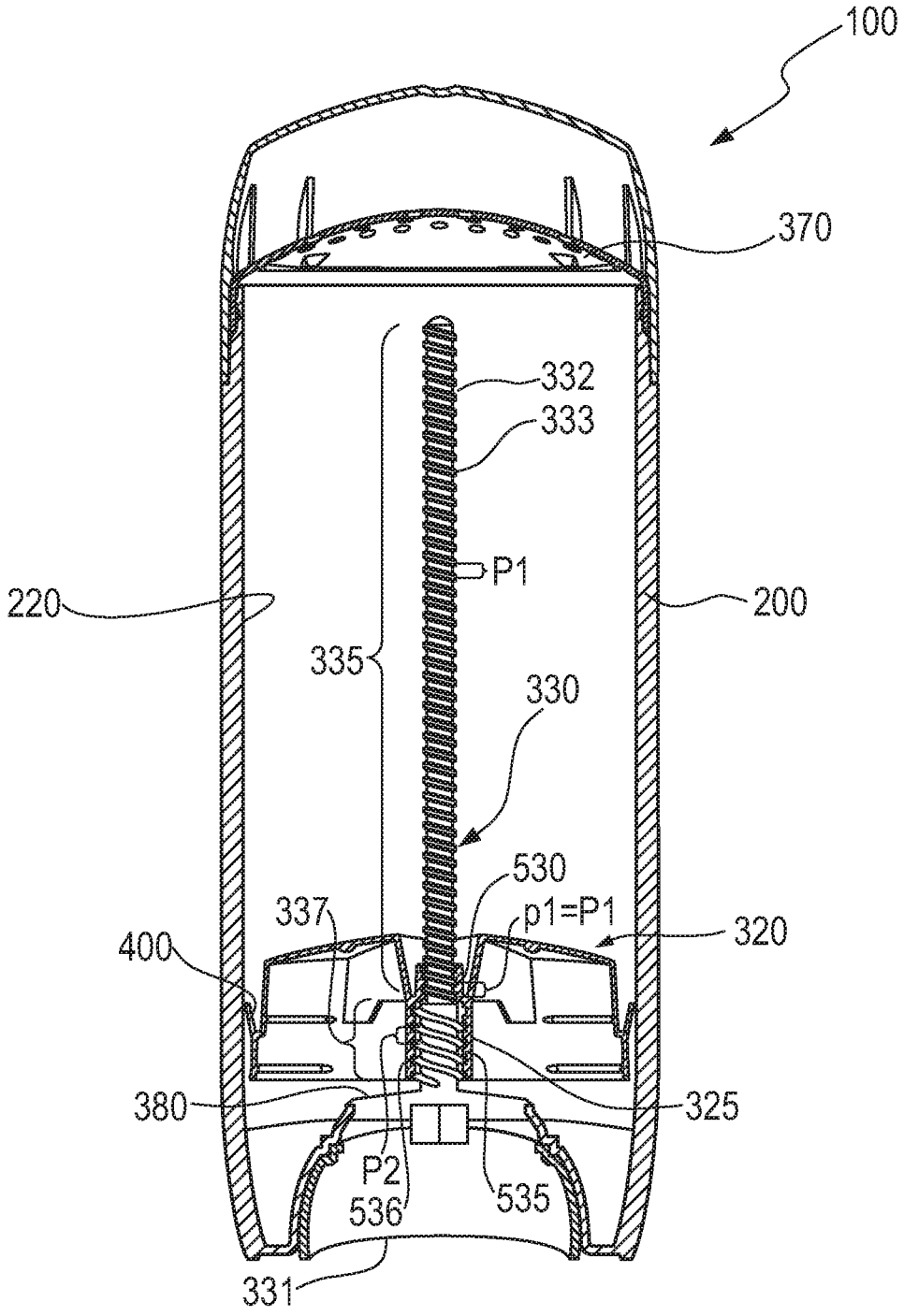
FIG. 9 is a cross sectional view of another dispensing package according to one or more aspects.
Figure 10:
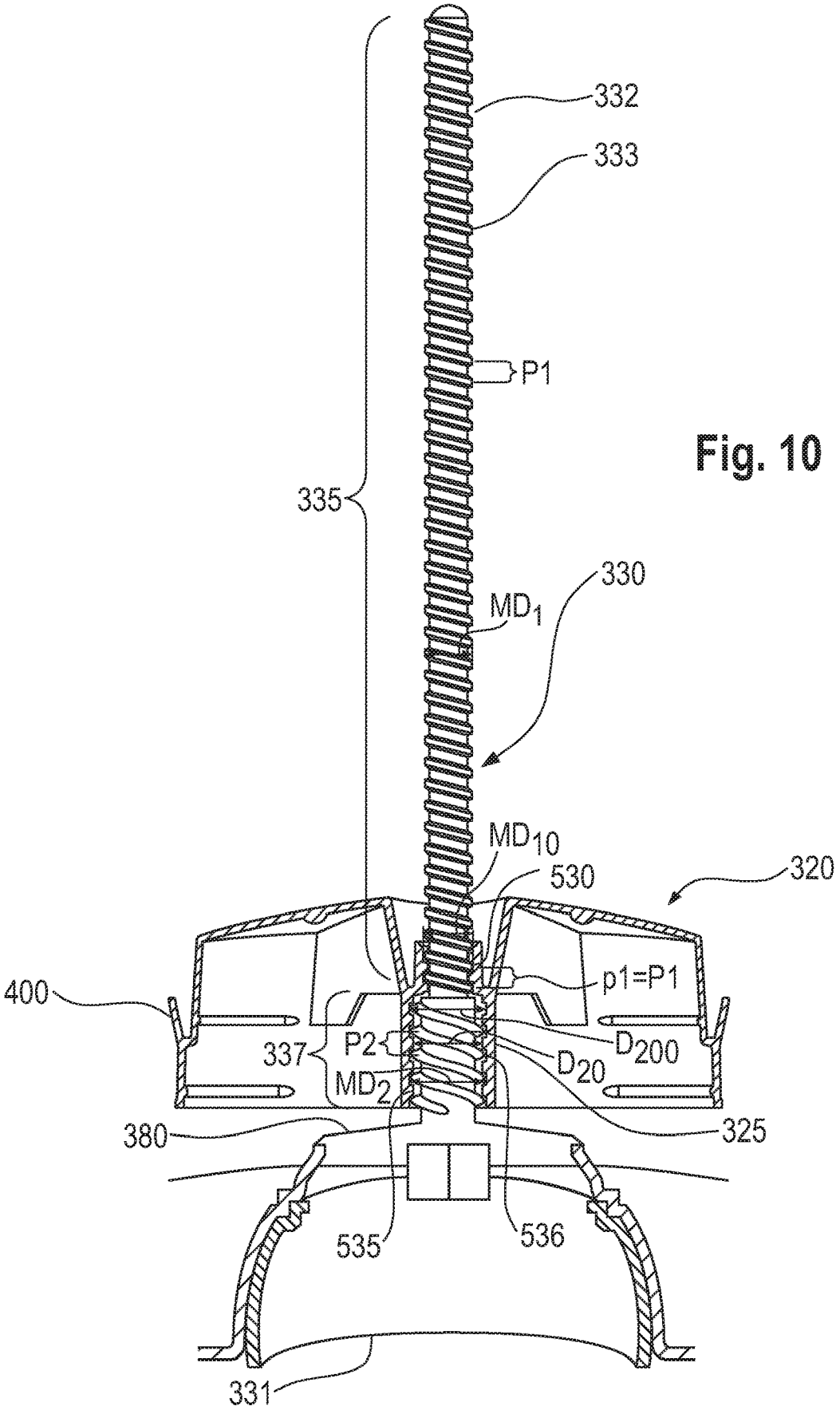
FIG. 10 is a detail, cross sectional view of a screw assembly engaged with a movable elevator platform of the dispensing package of FIG. 9.

When the second pitch p2 of the third internal thread portion 540 and the second pitch P2 of the second external thread portion 337 are the same, as shown for instance in FIG. 18 and FIG. 9, the external threads of the first external thread portion 335 match with the internal threads of the first internal thread portion 530. Also, the external threads of the second external thread portion 337 match with the internal threads of the third internal thread portion 540.

Preferably, when matching in this case, each of the major diameter $MD_1$ of the first external thread portion 335 and the second external thread portion 337 of the spindle 332 may be typically smaller than each of the major diameter $MD_{10}$ of the respective first internal thread portion 530 and the third internal thread portion 540 of the coupling sleeve 325.

Alternatively, the dispensing package may comprise the spindle 332 wherein the first external thread portion 335 has a major diameter $MD_1$ and wherein the second external thread portion 337 has a major diameter $MD_2$. The major diameter $MD_2$ of the second external thread portion 337 may be larger than the major diameter $MD_1$ of the first external thread portion 335.

The dispensing package may comprise the coupling sleeve 325 of the movable elevator platform 320, wherein the first internal thread portion 530 has a major diameter $MD_{10}$; and wherein the third internal thread portion 540 has a major diameter $MD_{20}$. The major diameter $MD_{20}$ of the third internal thread portion 540 may be larger than the major diameter $MD_{10}$ of the first internal thread portion 530.

The second internal non-threaded portion 535 may have a diameter $D_{20}$, which may be equal to the major diameter $MD_{20}$ of the third internal thread portion 540. However, as the second external thread portion 337 of the spindle 332 having the major diameter $MD_2$ smaller than the major diameter $MD_{20}$ of the third internal thread portion 540, the external threads of the second external thread portion 337 of the spindle 332 cannot engage with the second internal non-threaded portion 535, having no cross-thread features, as the external threads of the second external thread portion 337 do not tap with the inner surface of the second internal non-threaded portion 535.

In that case, the external threads of the first external thread portion 335 of the spindle 332 can engage with the internal threads of the first internal thread portion 530 of the movable elevator platform 320. Also, the external threads of the second external thread portion 337 of the spindle 332 can engage with the internal threads of the third internal thread portion 540 of the movable elevator platform 320.

A dispensing package 100 may comprise a spindle 332 comprising a first external thread portion 335 having a first pitch P1; and a second external thread portion 337 having a second pitch P2. The second pitch P2 may be larger than the first pitch P1. Also, the first external thread portion 335 may have a major diameter $MD_1$ and wherein the second external thread portion 337 may have a major diameter $MD_2$. The major diameter $MD_2$ of the second external thread portion 337 may be larger than the major diameter $MD_1$ of the first external thread portion 335.

Also, the dispensing package 100 may comprise a movable elevator platform 320 which comprises a coupling sleeve 325 having an inner surface 550. The coupling sleeve 325 may support internal threads having a first internal thread portion 530 having a first pitch p1, a second internal non-threaded portion 535 and a third internal thread portion 540 having a second pitch p2. The first internal thread portion 530 may have a major diameter $MD_{10}$. The third internal thread portion 540 may have a major diameter $MD_{20}$. The major diameter $MD_{20}$ of the third internal thread portion 540 may be larger than the major diameter $MD_{10}$ of the first internal thread portion 530.

The first external thread portion 335 of the screw assembly 330 can engage with the first internal thread portion 530 of the movable elevator platform 320 along the inner surface 550 of the movable elevator platform 320 such that the first pitch p1 of the first internal thread portion 530 and the first pitch P1 of the first external thread portion 335 are the same.

The external threads of the second external thread portion 337 of the screw assembly 330 can engage with the internal threads of the third internal thread portion 540 of the movable elevator platform 320 along the inner surface 550 of the movable elevator platform 320 such that the second pitch p2 of the third internal thread portion 540 is comprised between the first pitch P1 of the first external thread portion 335 and the second pitch P2 of the second external thread portion 337.

Preferably, the second external thread portion 337 of the screw assembly 330 may preferably engage with the third internal thread portion 540 of the movable elevator platform 320 along the inner surface 550 of the movable elevator platform 320 such that the second pitch p2 of the third internal thread portion 540 and the first pitch P1 of the first external thread portion 335 are the same.

FIG. 20 and FIG. 21 illustrate a dispensing packaging 100 comprising a spindle 332 having a first external thread portion 335 comprising a first pitch P1 and a first major diameter $MD_1$ and a second external thread portion 337 comprising a second pitch P2 and a second major diameter $MD_2$. The second pitch P2 may be larger than the first pitch P1. The major diameter $MD_2$ of the second external thread portion 337 may be larger than the major diameter $MD_1$ of the first external thread portion 335.

Also, the dispensing packaging 100 may comprise a coupling sleeve 325 of a movable elevator platform 320 including a first internal thread portion 530 having a first pitch p1 and a major diameter $MD_{10}$; a second internal non-threaded portion 535; and a third internal thread portion 540 having a second pitch p2 and a major diameter $MD_{20}$. The major diameter $MD_{20}$ of the third internal thread portion 540 may be larger than the major diameter $MD_{10}$ of the first internal thread portion 530.

Here, the first pitch p1 of the first internal thread portion 530 and the first pitch P1 of the first external thread portion 335 are the same. Also, the second pitch p2 of the third internal thread portion 540 and the first pitch P1 of the first external thread portion 335 are the same.

Because of the respective larger major diameters of the third internal thread portion 540 and the second external thread portion 337, the empty space will be readily and quickly addressed. As the external threads of the second external thread portion 337 of the spindle 332 having the second pitch P2 cross-threads the internal threads of the third internal thread portion 540 of the coupling sleeve 325 having the second pitch p2 being the first pitch P1, an acceptable torque might be felt by the consumer.

Such execution as illustrated in FIG. 20 and FIG. 21 can be relatively easy to manufacture. The coupling sleeve 325 of the movable elevator platform 320 can be made with one screw having one single major diameter $MD_{10}$ and the pitch of value P1 for the first internal thread portion 530. Then, the second internal non-threaded portion 535 and the third internal thread portion 540 can be made together with a core comprising a first portion, preferably comprising a cylindrical shape, having one single diameter being equal to the major diameter $MD_{20}$ with no internal threads for making the second internal non-threaded portion 535; and a second portion comprising a plurality of internal threads having the major diameter $MD_{20}$ and the pitch of value P1 for making the third internal thread portion 540.

Hence, in order to overcome the slight torque feeling by the consumer, more preferably, the second external thread portion 337 of the screw assembly 330 may preferably engage with the third internal thread portion 540 of the movable elevator platform 320 along the inner surface 550 of the movable elevator platform 320 such that the second pitch p2 of the third internal thread portion 540 and the second pitch P2 of the second external thread portion 337 are the same.

FIG. 22 and FIG. 23 illustrate a dispensing packaging 100 comprising a spindle 332 having a first external thread portion 335 comprising a first pitch P1 and a first major diameter $MD_1$ and a second external thread portion 337 comprising a second pitch P2 and a second major diameter $MD_2$. The second pitch P2 is larger than the first pitch P1. The major diameter $MD_2$ of the second external thread portion 337 is larger than the major diameter $MD_1$ of the first external thread portion 335.

Also, the dispensing packaging 100 may comprise a coupling sleeve 325 of a movable elevator platform 320 including a first internal thread portion 530 having a first pitch p1 and a major diameter $MD_{10}$; a second internal non-threaded portion 535; and a third internal thread portion 540 having a second pitch p2 and a major diameter $MD_{20}$. The major diameter $MD_{20}$ of the third internal thread portion 540 may be larger than the major diameter $MD_{10}$ of the first internal thread portion 530.

Here, the first pitch p1 of the first internal thread portion 530 and the first pitch P1 of the first external thread portion 335 are the same. But now, the second pitch p2 of the third internal thread portion 540 and the second pitch P2 of the second external thread portion 337 are the same.

The execution as illustrated for instance in FIG. 22 and FIG. 23 can be the most convenient one for the consumer. In this execution, the external threads of the first external thread portion 335 match with the internal threads of the first internal thread portion 530. Also, the external threads of the second external thread portion 337 match with the internal threads of the third internal thread portion 540. Almost no resistance is felt by the user when actuating the screw base 331 of the screw assembly 330.

Preferably, when matching in this case, the major diameter of external threads may be typically smaller than the major diameter of the internal threads. Hence, the major diameter $MD_1$ of the first external thread portion 335 of the spindle 332 may be smaller than the major diameter $MD_{10}$ of the first internal thread portion 530 of the coupling sleeve 325. Also, the major diameter $MD_2$ of the second external thread portion 337 of the spindle 332 may be smaller than the major diameter $MD_{20}$ of the third internal thread portion 540 of the coupling sleeve 325.

Figure 24:
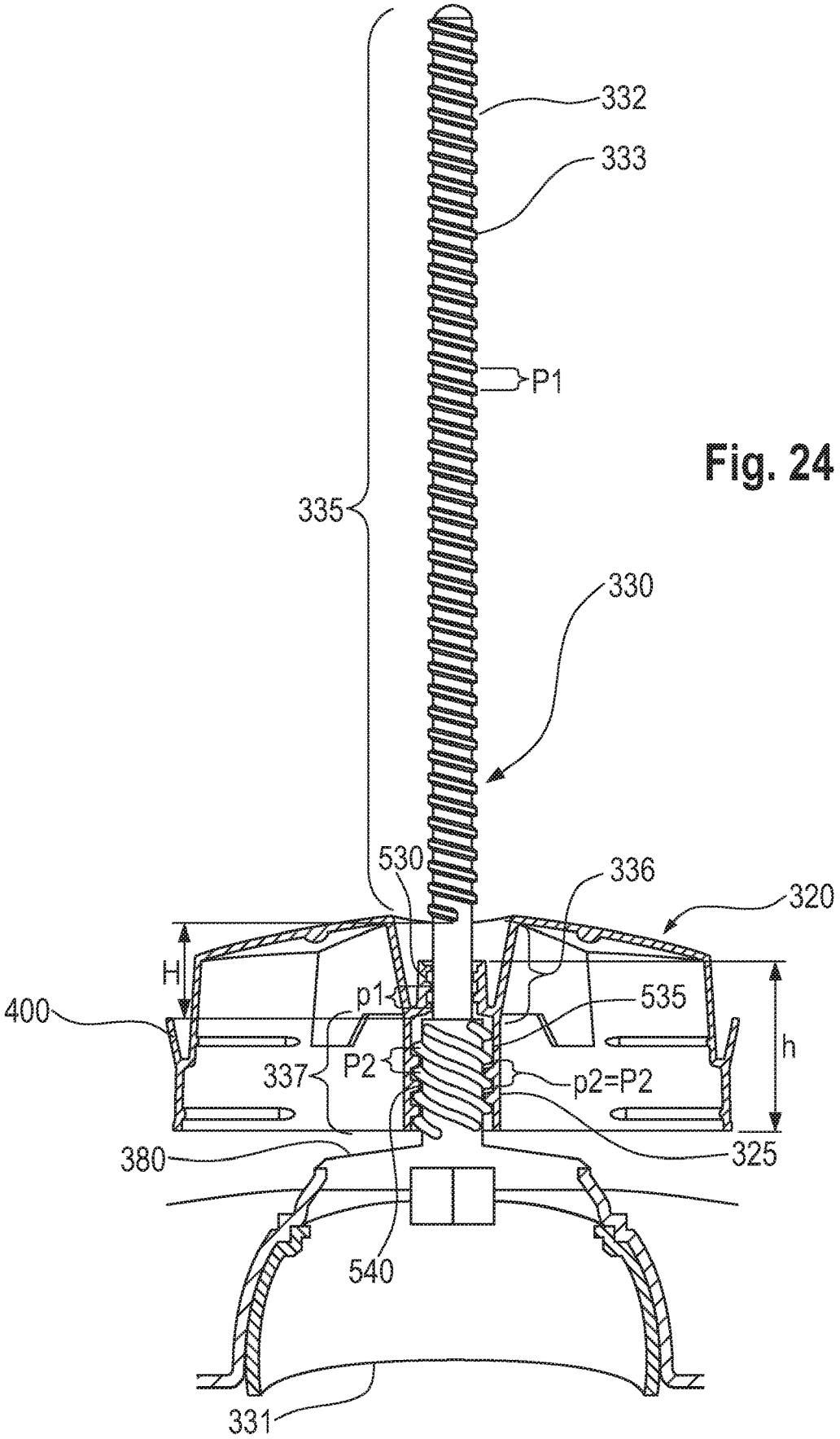
FIG. 24 is a detail, cross sectional view of a screw assembly engaged with a movable elevator platform of the dispensing package according to one or more aspects.

Furthermore, the screw assembly 330 may comprise a spindle 332 including a third non-threaded portion 336 located between the first external thread portion 335 and the second external thread portion 337, as shown in FIG. 24 for illustrating an example.

All embodiments described hereinbefore, for instance in FIGS. 12-23 may preferably include a third non-threaded portion 336 located between the first external thread portion 335 and the second external thread portion 337.

In FIG. 24, the movable elevator platform 320 is located at the proximity of the first end 260 of the jacket, i.e. the bottom opening 260 of the outer jacket or the bottom opening 170 of the product chamber 110. The second external thread portion 337 of the spindle 332 is engaged with the third internal threaded portion 540 of the coupling sleeve 325.

When the user applies some torque at the screw base 331 of the screw assembly 330, the spindle 332 rotates which causes the movable elevator platform 320 to advance in a linear direction along the longitudinal axis L of the dispensing package 100. In FIG. 24, the spindle 332 has a third non-threaded portion 336 which is exaggerated in terms of height. When the second external thread portion 337 of the spindle 332 is almost disengaging with the internal threads of the third internal thread portion 5540 of the coupling sleeve 325, the first external thread portion 335 of the spindle 332 starts engaging with the first internal thread portion 530 of the coupling sleeve 325. The empty space has been overcome at this stage. The first dose of the consumer care product has been then delivered. Now, when the user continues actuating the screw base 331 of the screw assembly 330, further dose will be provided in an accurate manner, in part due to the first pitch P1 of the first external thread portion 335. The presence of the third non-threaded portion 336 allows avoiding the external threads of the respective first and second external thread portions 335, 337 engaging with the corresponding internal threads of the first and third internal thread portion (530, 540), at the same time. The third non-threaded portion 336 can help to avoid the spindle 332 rotating without no advancement of the platform 320 in a linear direction along the longitudinal axis L of the dispensing package 100 towards the top opening 160 of the product chamber 110.

The third non-threaded portion 336 may have preferably a height H as measured along the longitudinal axis L. The coupling sleeve 325 of the movable elevator platform 320 may have a height h as measured along the longitudinal axis L. The height h of the coupling sleeve 325 comprises, or may preferably consist of the height of the first internal thread portion 530, the second internal non-threaded portion 535 and the third internal thread portion 540. The height H of the third non-threaded portion 336 may be above the second pitch P2 of the second external thread portion 337 of the spindle 332 and less than the height h of the coupling sleeve 325 of the movable elevator 320.

The height H of the third non-threaded portion 336 may range from 0.1 inch to 1 inch (from 2.54 mm to 25.4 mm), preferably from 0.2 inch to 0.8 inch (from 5.08 mm to 20.32 mm), more preferably from 0.25 inch to 0.75 inch (from 6.35 mm to 19.05 mm).

Figure 25:
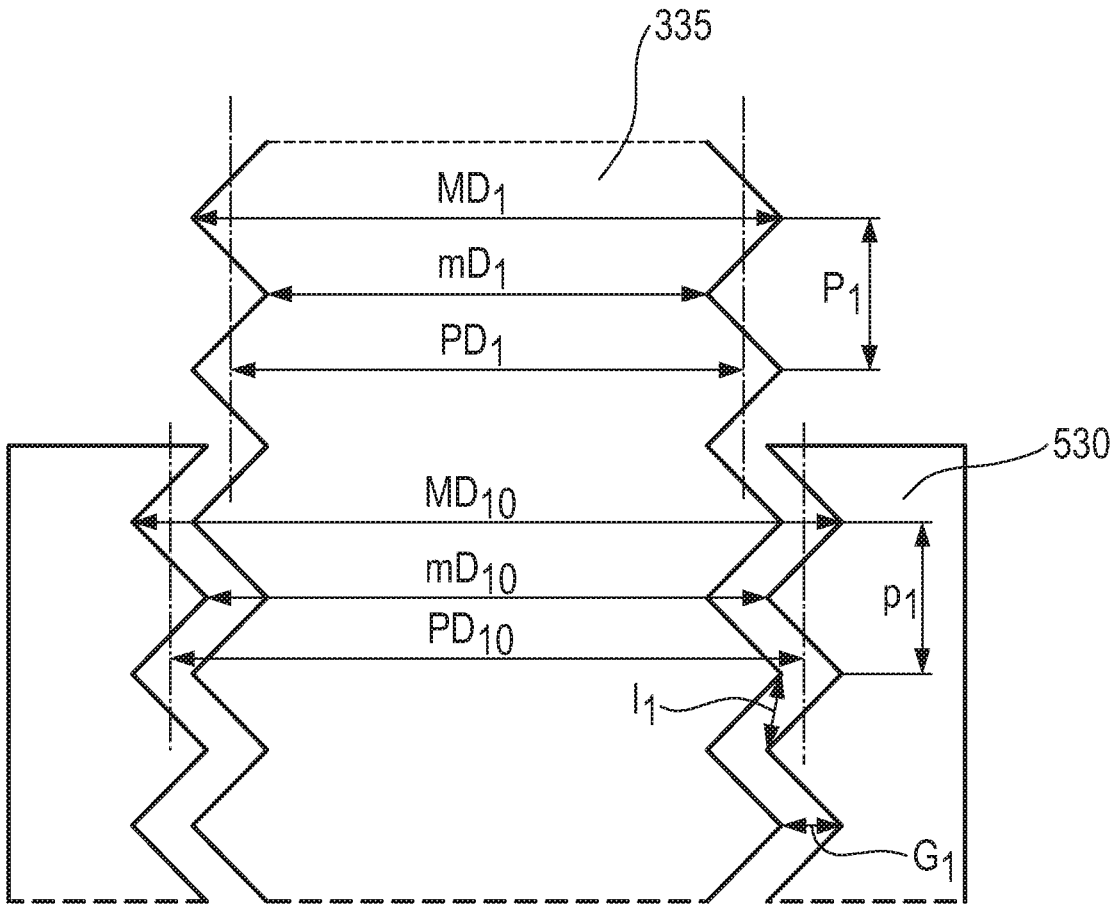
FIG. 25 is a detail, cross sectional view of the first external thread portion engaged with the first internal thread portion of the dispensing package of FIG. 23.

As shown for instance in a FIG. 25, the first external thread portion 335 of the spindle 332 may have a major diameter $MD_1$, a minor diameter $mD_1$ and a pitch diameter $PD_1$. The first internal thread portion 530 of the coupling sleeve 325 of the platform 320 may have a major diameter $MD_{10}$, a minor diameter $mD_{10}$ and a pitch diameter $PD_{10}$.

The major diameter $MD_1$ of the first external thread portion 335 of the spindle 332 may range from 0.02 inch to 1 inch (from 0.508 mm to 25.4 mm), preferably from 0.05 inch to 0.5 inch (from 1.27 mm to 12.70 mm), more preferably from 0.1 inch to 0.3 inch (from 2.54 mm to 7.62 mm).

The minor diameter $mD_1$ of the second external thread portion 337 of the spindle 332 may range from 0.02 inch to 1 inch (from 0.508 mm to 25.4 mm), preferably from 0.05 inch to 0.5 inch (from 1.27 mm to 12.70 mm), more preferably from 0.1 inch to 0.3 inch (from 2.54 mm to 7.62 mm).

The major diameter $MD_{10}$ of the first internal thread portion 530 of the coupling sleeve 325 of the movable elevator platform 320 may range from 0.02 inch to 1 inch (from 0.508 mm to 25.4 mm), preferably from 0.05 inch to 0.5 inch (from 1.27 mm to 12.70 mm), more preferably from 0.1 inch to 0.3 inch (from 2.54 mm to 7.62 mm).

The minor diameter $mD_{10}$ of the first internal thread portion 530 of the coupling sleeve 325 of the movable elevator platform 320 may range from 0.02 inch to 1 inch (from 0.508 mm to 25.4 mm), preferably from 0.05 inch to 0.5 inch (from 1.27 mm to 12.70 mm), more preferably from 0.1 inch to 0.25 inch (from 2.54 mm to 6.35 mm).

When the first pitch p1 of the first internal thread portion 530 and the first pitch P1 of the first external thread portion 335 are the same, the external threads of the first external thread portion 335 match with the internal threads of the first internal thread portion 530.

Then, the major diameter $MD_1$ of the first external thread portion 335 of the spindle 332 may be typically smaller than the major diameter $MD_{10}$ of the first internal thread portion 530 of the coupling sleeve 325. Also, the minor diameter $mD_1$ of the first external thread portion 335 of the spindle 332 may be typically smaller than the minor diameter $mD_{10}$ of the first internal thread portion 530 of the coupling sleeve 325. Also, the pitch diameter $PD_1$ of the first external thread portion 335 of the spindle 332 may be typically smaller than the pitch diameter $PD_{10}$ of the first internal thread portion 530 of the coupling sleeve 325.

As shown for instance in a FIG. 24, the second external thread portion 337 of the spindle 332 may have a major diameter $MD_2$, a minor diameter $mD_2$ and a pitch diameter $PD_2$. The third internal thread portion 540 of the coupling sleeve 325 of the platform 320 may have a major diameter $MD_{20}$, a minor diameter $mD_{20}$ and a pitch diameter $PD_{20}$.

Figure 26:
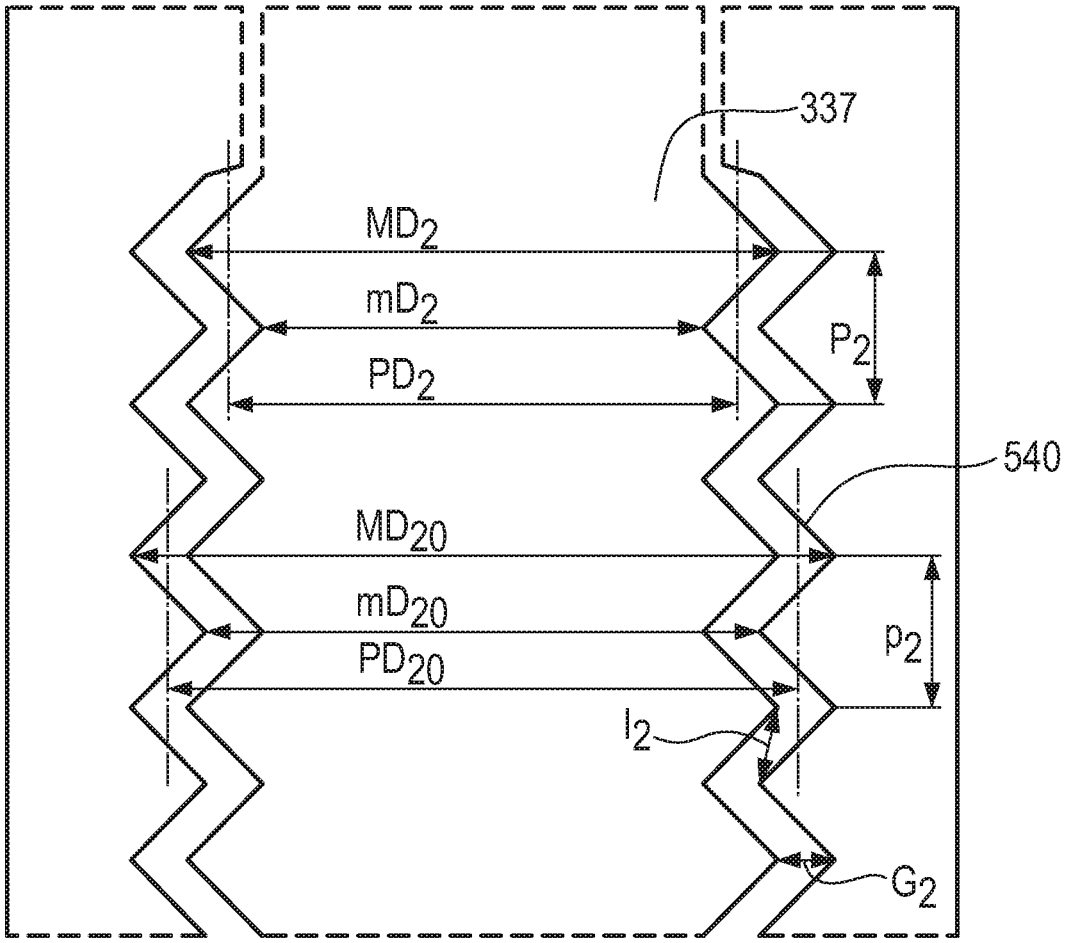
FIG. 26 is a detail, cross sectional view of the second external thread portion engaged with the third internal thread portion of the dispensing package of FIG. 23.

In FIG. 26, which is an illustrative example, the third internal thread portion 540 may comprise a plurality of internal threads. Alternatively, the third internal thread portion 540 may comprise one internal thread. The following ranges may apply for both alternatives.

The major diameter $MD_2$ of the second external thread portion 337 of the spindle 332 may range from 0.1 inch to 1 inch (from 2.54 mm to 25.4 mm), preferably from 0.2 inch to 0.8 inch (from 5.08 mm to 20.32 mm), more preferably from 0.25 inch to 0.5 inch (from 6.35 mm to 12.7 mm).

The minor diameter $mD_2$ of the second external thread portion 337 of the spindle 332 may range from 0.02 inch to 1 inch (from 0.508 mm to 25.4 mm), preferably from 0.05 inch to 0.5 inch (from 1.27 mm to 12.70 mm), more preferably from 0.1 inch to 0.2 inch (from 2.54 mm to 5.08 mm).

The major diameter $MD_{20}$ of the third internal thread portion 540 of the coupling sleeve 325 of the movable elevator platform 320 may range from 0.1 inch to 1 inch (from 2.54 mm to 25.4 mm), preferably from 0.2 inch to 0.8 inch (from 5.08 mm to 20.32 mm), more preferably from 0.25 inch to 0.5 inch (from 6.35 mm to 12.7 mm).

The minor diameter $mD_{20}$ of the third internal thread portion 540 of the coupling sleeve 325 of the movable elevator platform 320 may range from 0.02 inch to 1 inch (from 0.508 mm to 25.4 mm), preferably from 0.05 inch to 0.5 inch (from 1.27 mm to 12.70 mm), more preferably from 0.1 inch to 0.25 inch (from 2.54 mm to 6.35 mm).

When the second pitch p2 of the third internal thread portion 540 and the second pitch P2 of the second external thread portion 337 are the same, the external threads of the second external thread portion 337 match with the internal threads of the third internal thread portion 540.

Then, the major diameter $MD_2$ of the second external thread portion 337 of the spindle 332 may be typically smaller than the major diameter $MD_{20}$ of the third internal thread portion 540 of the coupling sleeve 325. Also, the minor diameter $mD_2$ of the second external thread portion 337 of the spindle 332 may be typically smaller than the minor diameter $mD_{20}$ of the third internal thread portion 540 of the coupling sleeve 325. Also, the pitch diameter $PD_2$ of the second external thread portion 337 of the spindle 332 may be typically smaller than the pitch diameter $PD_{20}$ of the third internal thread portion 540 of the coupling sleeve 325.

The engagement between the spindle 332 of the screw assembly 330 with the coupling sleeve 325 of the movable elevator platform 320 may be further defined.

The first external thread portion 335 of the screw assembly 330 and the first internal thread portion 530 of the movable elevator platform 320 may comprise a first gap G1 (see FIG. 25). The first gap G1 is the distance between a crest of an external thread of the first external thread portion 335 and a nest of the proximate internal thread of the first internal thread portion 530, wherein the external and internal threads are coaxial to an axis perpendicular to the longitudinal axis. The first gap G1 may be from 0.001 inch (25.4 μm) to 0.020 inch (0.51 mm), preferably from 0.002 inch (50.8 μm) to 0.010 inch (0.25 mm), more preferably from 0.002 inch (50.8 μm) to 0.05 inch (1.27 mm).

The second external thread portion 337 of the screw assembly 330 and the third internal thread portion 540 of the movable elevator platform 320 may comprise a second gap G2 (See FIG. 26). The second gap G2 is the distance between a crest of an external thread of the second external thread portion 337 and a nest of the proximate internal thread of the third internal thread portion 540, wherein the external and internal threads are coaxial to an axis perpendicular to the longitudinal axis. The second gap G2 may be from 0.001 inch (25.4 μm) to 0.020 inch (0.51 mm), preferably from 0.002 inch (50.8 μm) to 0.010 inch (0.25 mm), more preferably from 0.005 inch (0.12 mm) to 0.010 inch (0.25 mm).

The first external thread portion 335 of the screw assembly 330 and the first internal thread portion 530 of the movable elevator platform 320 may comprise a first interference Nominal $I_1$ (see FIG. 25). The first interference Nominal $I_1$ is the distance between a crest of an external thread of the first external thread portion 335 and an adjacent crest of the proximate internal thread of the first internal thread portion 530, wherein the external and internal threads are coaxial to an axis perpendicular to the longitudinal axis. The first interference Nominal $I_1$ may be from 0.000 inch (0 mm) to 0.15 inch (3.85 mm), preferably from 0.005 inch (0.12 mm) to 0.030 inch (0.76 mm).

The second external thread portion 337 of the screw assembly 330 and the third internal thread portion 540 of the movable elevator platform 320 may comprise a second interference Nominal $I_2$ (see FIG. 26). The second interference Nominal $I_2$ is the distance between a crest of an external thread of the second external thread portion 337 and an adjacent crest of the proximate internal thread of the third internal thread portion 540, wherein the external and internal threads are coaxial to an axis perpendicular to the longitudinal axis. The second interference Nominal $I_2$ may be from 0.000 inch (0 mm) to 0.15 inch (3.85 mm), preferably from 0.005 inch (0.12 mm) to 0.030 inch (0.76 mm).

Optional Aspects of the Screw Assembly

Figure 27:
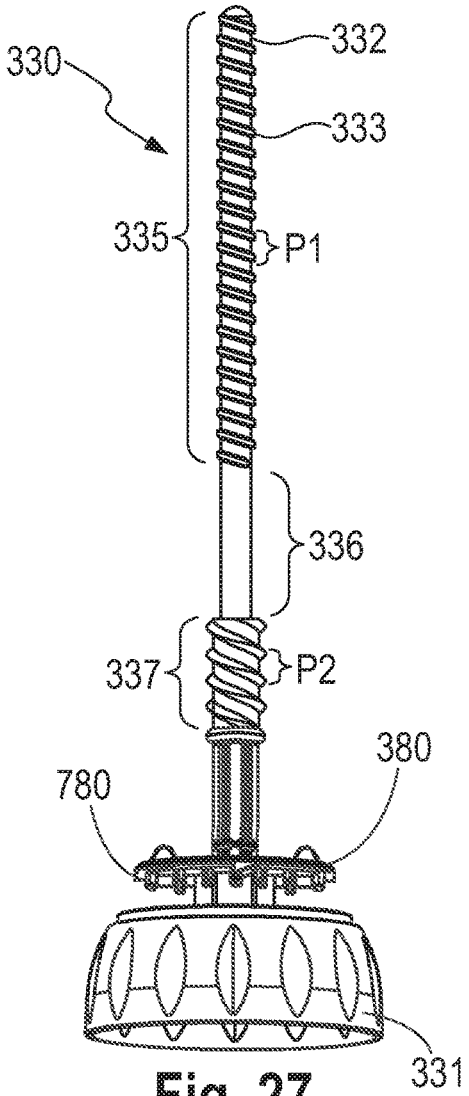
FIG. 27 is a perspective, front view of a screw assembly of a dispensing package according to one or more aspects.
Figure 28:
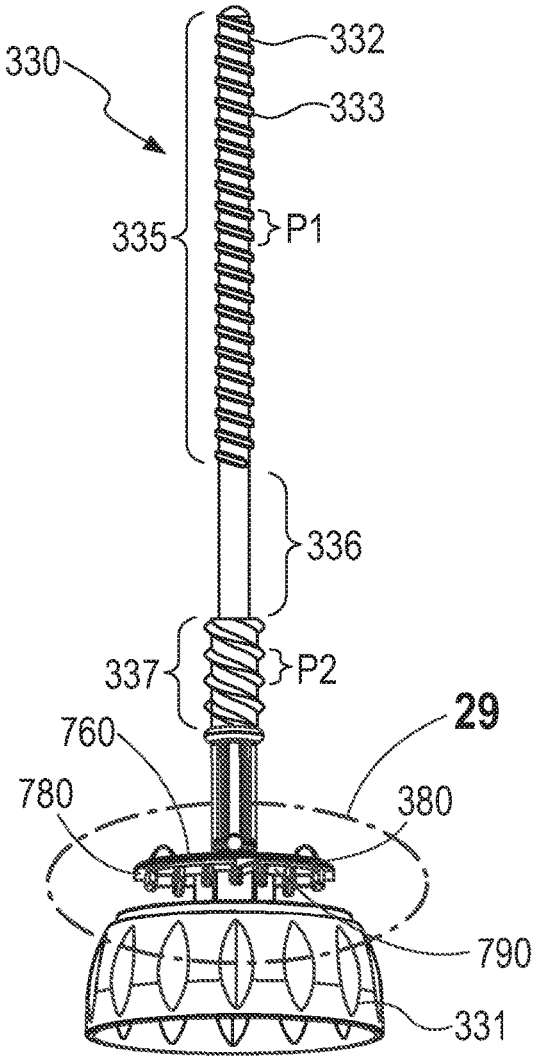
FIG. 28 is a perspective, back view of the screw assembly of FIG. 27.
Figure 29:
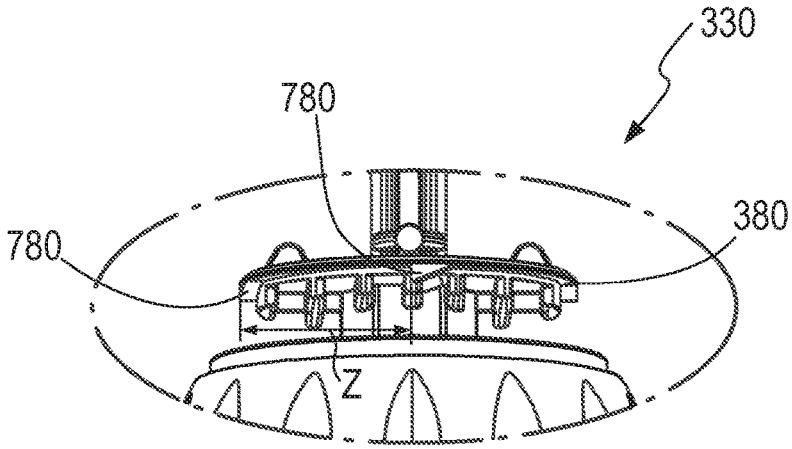
FIG. 29 is an enlarged view of an area within FIG. 28.
Figure 30:
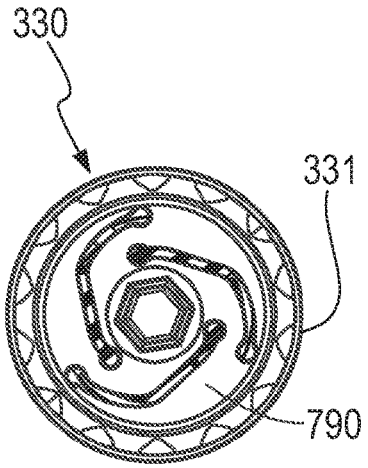
FIG. 30 is a bottom view of the screw assembly of FIG. 27.

As shown for instance in FIGS. 27 and 28, the screw assembly 330 may include a ratchet platform 380. The ratchet platform 380 may have a diameter from 10 mm to 40 mm (from 0.39 inch to 1.57 inch). The ratchet platform 380 may preferably have a diameter between 10 and 30 mm (0.39-1.18 inch). The ratchet platform 380 may be mounted to the screw assembly 330 or molded as a single part within the screw assembly 330. Because the ratchet platform 380 is fixed to the screw assembly 330, rotating the screw base 331 will likewise rotate the ratchet platform 380. The ratchet platform 380 may include a plurality of pawls 780. As shown in FIG. 29, the pawls 780 may have a spacing Z between each pawl 780. The size of the pawl 780, the number of pawls 780, and the spacing Z between the pawls 780 may be engineered so that no more than one pawl 780 is operatively associated with any given face 740 when the screw base 331 is not being engaged by a user. The spacing Z may be from 10 degrees to 360 degrees, preferably from 90 degrees to 180 degrees, more preferably about 90 degrees. The ratchet platform 380 may include from 1 to 40 pawls 780, preferably from 1 to 20 pawls 780, more preferably from 1 to 12 pawls 780. The ratchet 700 may not include any pawls 780. As shown in FIG. 30, when the ratchet platform 380 is included, the screw base 331 need not have an internal open configuration that allows for bottom filling such as when a closed end 790 is included because such a closed end 790 may restrict bottom filling.

Figure 31:
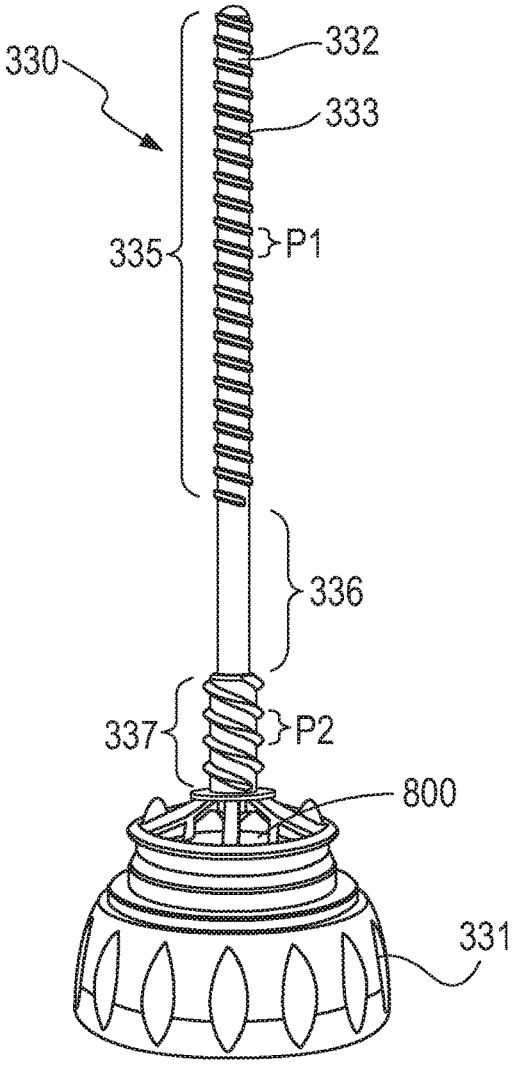
FIG. 31 is a perspective, front view of another screw assembly of a dispensing package according to one or more aspects.
Figure 32:
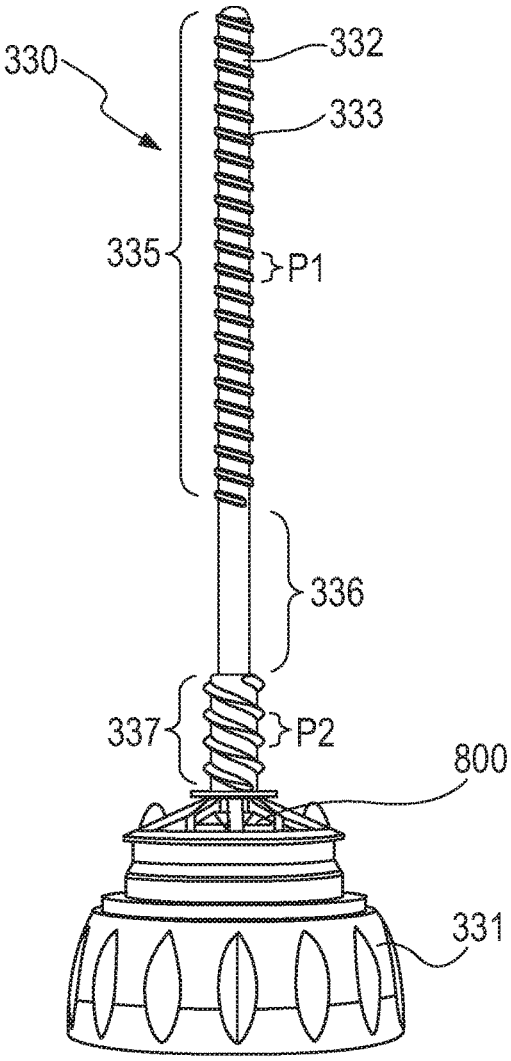
FIG. 32 is a back view of the screw assembly of FIG. 31.
Figure 33:
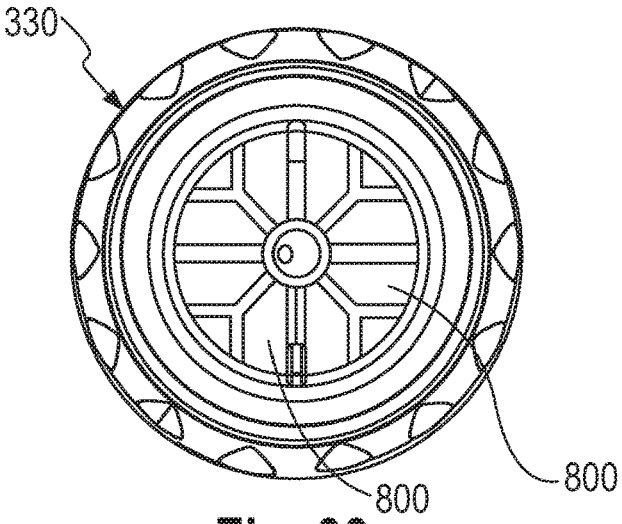
FIG. 33 is a top view of the screw assembly of FIG. 31.
Figure 34:
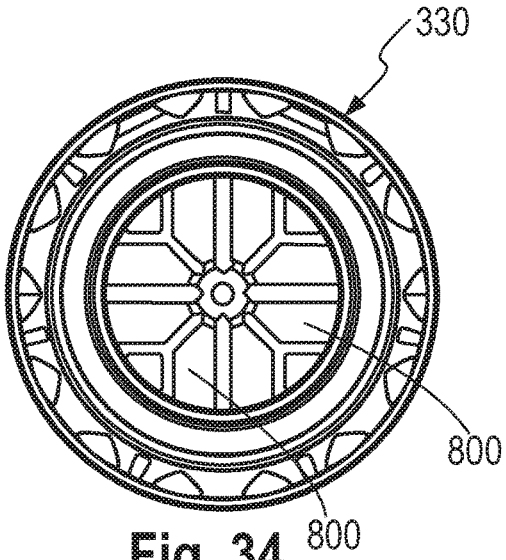
FIG. 34 is a bottom view of the screw assembly of FIG. 31.

As shown in FIGS. 31 and 32, the screw assembly 330 may not include a ratchet platform 380. The screw base 331 of the screw assembly 330 may be engineered to have an internal open configuration that allows for bottom filling. The screw base 331 may include one or more apertures 800 to allow for bottom filling when the screw assembly 330 is to be incorporated into the dispensing package 100 that will be bottom filled. As shown in FIGS. 33 and 34, the screw base 331 may include numerous apertures 800 that should be engineered to provide little or no obstruction so as to have an internal open configuration that allows for bottom filling while also maintaining the structural integrity and stiffness between the screw base 331 and the spindle 332.

Optional Aspects of the Ratchet

Figure 35:
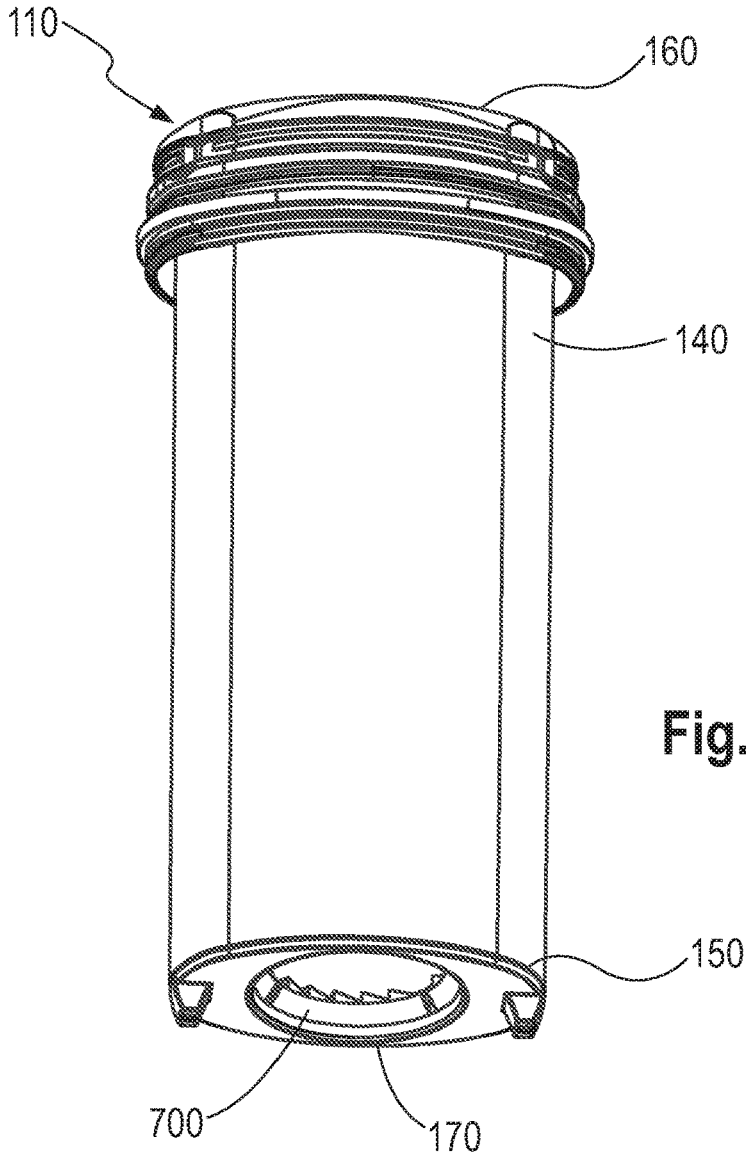
FIG. 35 is a perspective, front view of a jacket, e.g. a product chamber of a dispensing package according to one or more aspects.

The mechanism for axially advancing the movable elevator platform 320 may include the screw assembly 330 and a ratchet 700 non-removably incorporated into the lower end 240 of the outer jacket 200 or at the lower end 150 of the product chamber 110, as shown in FIG. 35. The ratchet 700 at a lower end 240 of the outer jacket 200 or at the lower end 150 of the product chamber 110 may be molded as a single part within the outer jacket 200 or the product chamber 110, as depicted in FIGS. 35 and 36.

Although the outer jacket 200 or the product chamber 110 may include a non-removable ratchet 700, the screw assembly 330 included in the dispensing package 100 may vary depending on the product form and the method of filing. The dispensing package 100 may include a screw assembly 330 that includes at least one pawl 780 or may include a screw assembly 330 that does not include at least one pawl 780, but has a screw base 331 that allows for bottom filling, as depicted in FIGS. 31-34.

Figure 36:
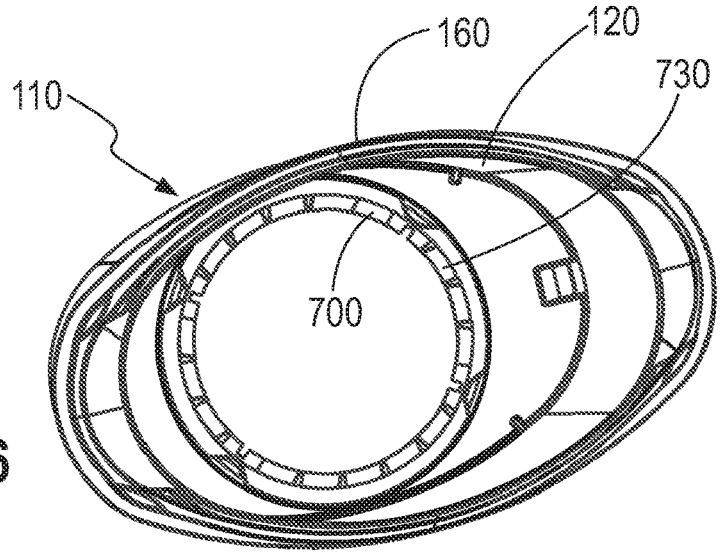
FIG. 36 is an enlarged view of an area within FIG. 35.

As shown in FIGS. 35 and 36, the jacket, e.g. the product chamber 110 may include a ratchet 700 located at the lower end 150 of the product chamber 110 or the jacket. The ratchet 700 may be designed to surround the bottom opening 170. The bottom opening 170 may be large enough to allow for bottom filling. The diameter of the bottom opening 170 may be 22.79 mm (0.90 inch) or greater. The diameter of the bottom opening 170 may range from 10 mm to 50 mm (from 0.39 inch to 1.97 inch).

Figure 37:
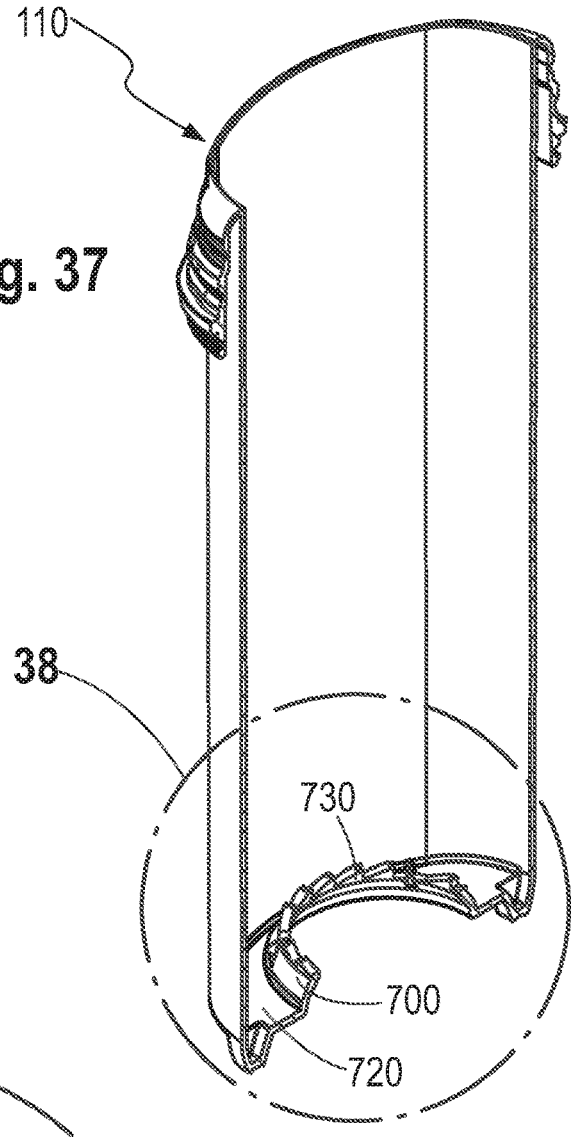
FIG. 37 is a cross-sectional, perspective, side view of the jacket of FIG. 35.
Figure 38:
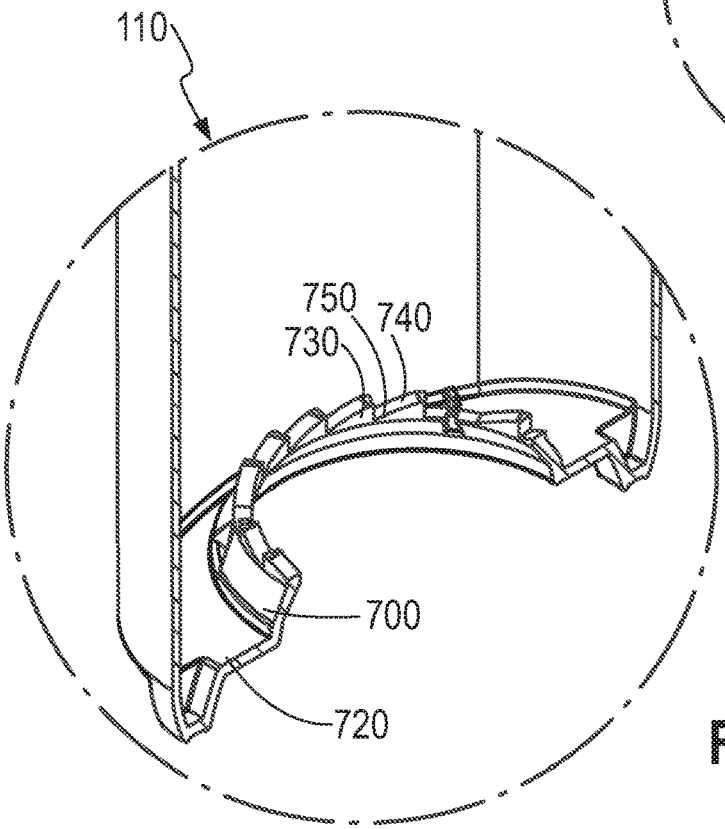
FIG. 38 is an enlarged, cross-sectional, perspective, side view of the jacket of FIG. 37.

As shown in FIGS. 37 and 38, a plurality of the one-way ratchet teeth 730 may be rigidly affixed to the circumference of the ratchet 700. Two-way ratchet teeth 730 may be used. As shown in FIGS. 37 and 38, the ratchet 700 may be raised above the interior floor 720 of the product chamber 110. The ratchet 700 may include from 8 to 32 ratchet teeth 730, although the number of ratchet teeth 730 may be adapted to provide the desired dose/function. The ratchet 700 includes from 12 to 20 ratchet teeth 730. The ratchet teeth 730 may include a face 740. The length of the face 740 may be from 0.5 mm to 5 mm in length (from 0.019 inch to 0.19 inch).

The ratchet teeth 730 may have a height, as measured from the base to the highest point, of 0.254 mm to 3 mm (from 0.01 inch to 0.12 inch), preferably from 0.51 mm to 2.0 mm (from 0.02 inch to 0.078 inch). The ratchet teeth 730 may be positioned in close proximity to each other so that the pawl 780 can move to the subsequent ratchet tooth 730 with ease. The ratchet teeth 730 may also have a lead angle 750 which may be from 10 to 80 degrees, preferably from 15 to 50 degrees, more preferably from 18 to 25 degrees. Even more preferably, the lead angle 750 may be 21.5 degrees.

Optional Aspects of the Movable Elevator Platform

The dispensing package 100 comprises a movable elevator platform 320 which is movably engaged with the spindle 332 of the screw assembly 330. As shown in FIGS. 39-48, the movable elevator platform 320 comprises a coupling sleeve 325 having an inner surface 550. The coupling sleeve 325 is coaxial to the longitudinal axis L of the dispensing package 100.

Figure 39:
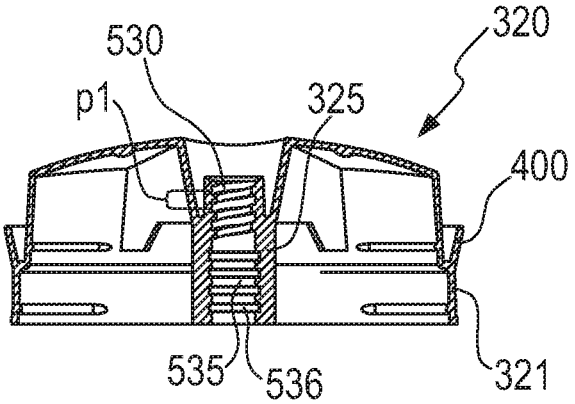
FIG. 39 is a cross sectional view of a movable elevator platform according to one or more aspects.
Figure 40:
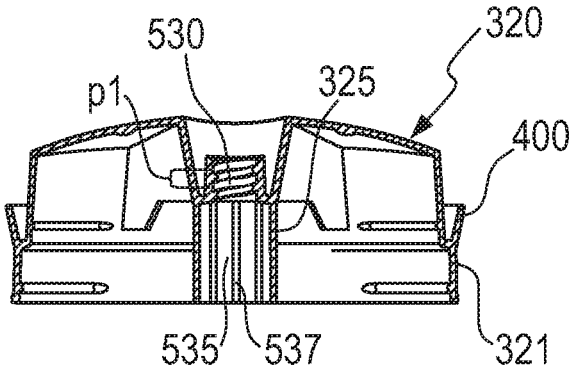
FIG. 40 is a cross sectional view of another movable elevator platform according to one or more aspects.
Figure 41:
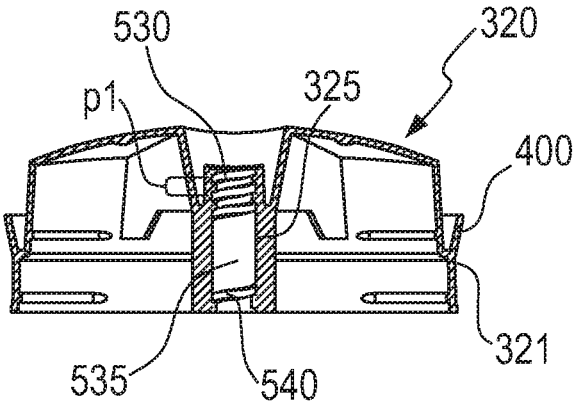
FIG. 41 is a cross sectional view of another movable elevator platform according to one or more aspects.
Figure 42:
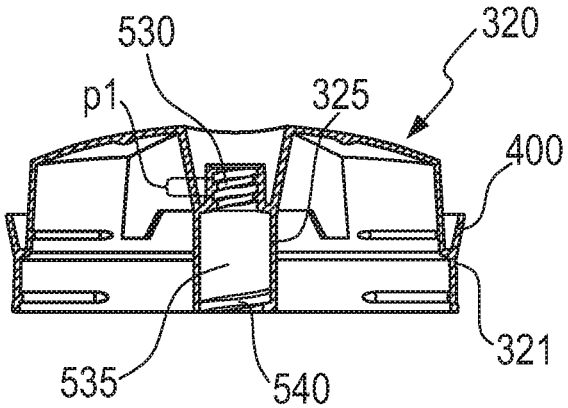
FIG. 42 is a cross sectional view of another movable elevator platform according to one or more aspects.

The coupling sleeve 325 supports internal threads having a first internal thread portion 530 having a first pitch p1 and a second internal non-threaded portion 535 (FIGS. 39 and 40). In FIG. 39, the second internal non-threaded portion 535 comprises a plurality of horizontal ribs as the one or more cross-thread features 536, forming a plurality of circular ribs parallel to each other and protruding outwards the coupling sleeve 325 in a direction perpendicular to the longitudinal axis L. In FIG. 40, the second internal non-threaded portion 535 comprises a plurality of vertical ribs as the one or more cross-thread features 536, protruding outwards the coupling sleeve 325 and extending along the longitudinal axis L.

Alternatively, the coupling sleeve 325 supports internal threads having a first internal thread portion 530 having a first pitch p1, a second internal non-threaded portion 535 and a third internal thread portion 540 comprising one or a plurality of internal threads (FIGS. 41-46).

When the third internal thread portion 540 comprises a plurality of internal threads, the third internal thread portion 540 may have the first pitch p1 or a second pitch p2.

The first pitch p1 may range from 0.025 inch to 0.200 inch (from 0.635 mm to 5.08 mm), preferably from 0.030 inch to 0.150 inch (from 0.762 mm to 3.81 mm), more preferably from 0.050 inch to 0.125 inch (from 1.27 mm to 3.175 mm).

The second pitch p2 may range from 0.150 inch to 0.750 inch (from 3.81 mm to 19.05 mm), preferably from 0.175 inch to 0.600 inch (from 4.445 to 15.24 mm), more preferably from 0.200 inch to 0.500 inch (from 5.08 mm to 12.7 mm).

Figure 43:
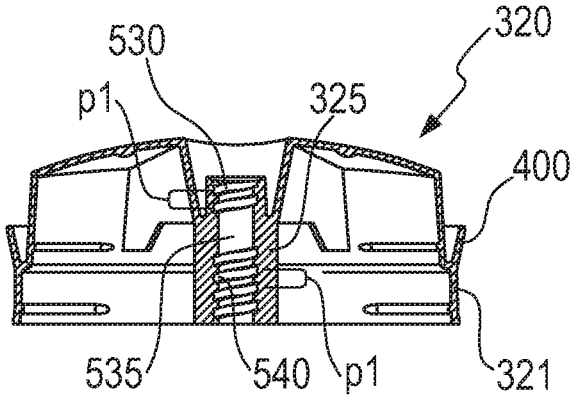
FIG. 43 is a cross sectional view of another movable elevator platform according to one or more aspects.
Figure 45:
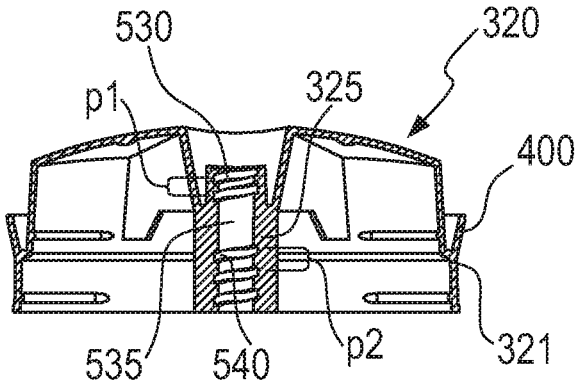
FIG. 45 is a cross sectional view of another movable elevator platform according to one or more aspects.

As shown in FIG. 43, the coupling sleeve 325 supports internal threads having a first internal thread portion 530 and a third internal thread portion 540 having the same first pitch p1. Alternatively, as shown in FIG. 45, the coupling sleeve 325 supports internal threads having a first internal thread portion 530 having a first pitch p1 and a third internal thread portion 540 having a second pitch p2. The second pitch p2 is larger than the first pitch p1.

Figure 44:
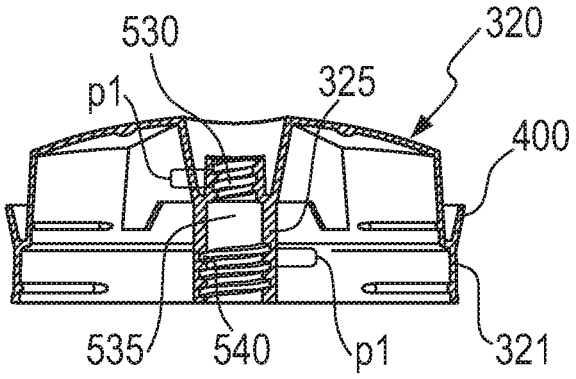
FIG. 44 is a cross sectional view of another movable elevator platform according to one or more aspects.

Alternatively, as shown in FIG. 44, the coupling sleeve 325 supports internal threads having a first internal thread portion 530 having a first major diameter $MD_{10}$ and a first pitch p1 and a third internal thread portion 540 having a second major diameter $MD_{20}$ and the first pitch p1. The second major diameter $MD_{20}$ is larger than the first major diameter $MD_{10}$.

Figure 46:
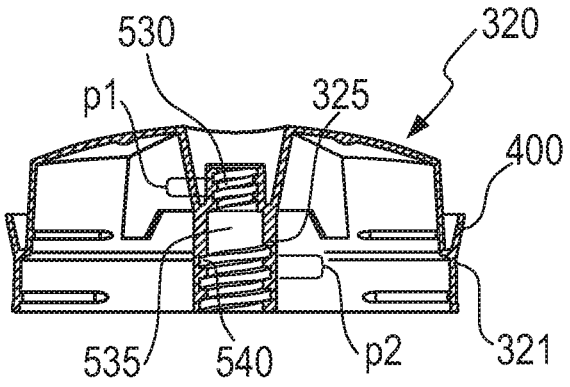
FIG. 46 is a cross sectional view of another movable elevator platform according to one or more aspects.
Figure 47:
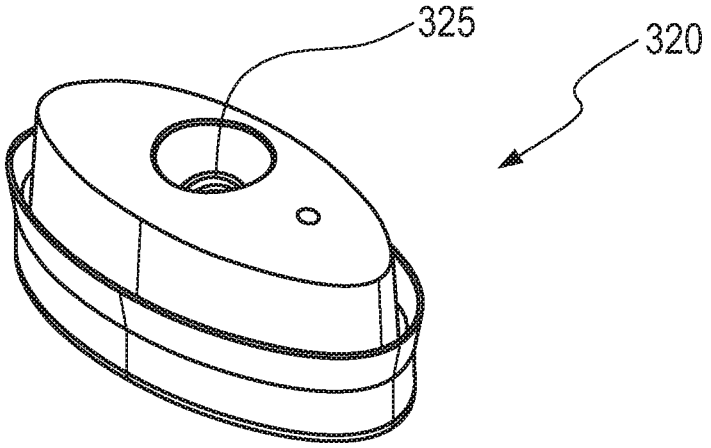
FIG. 47 is a perspective, front view of a movable elevator platform according to one or more aspects.
Figure 48:
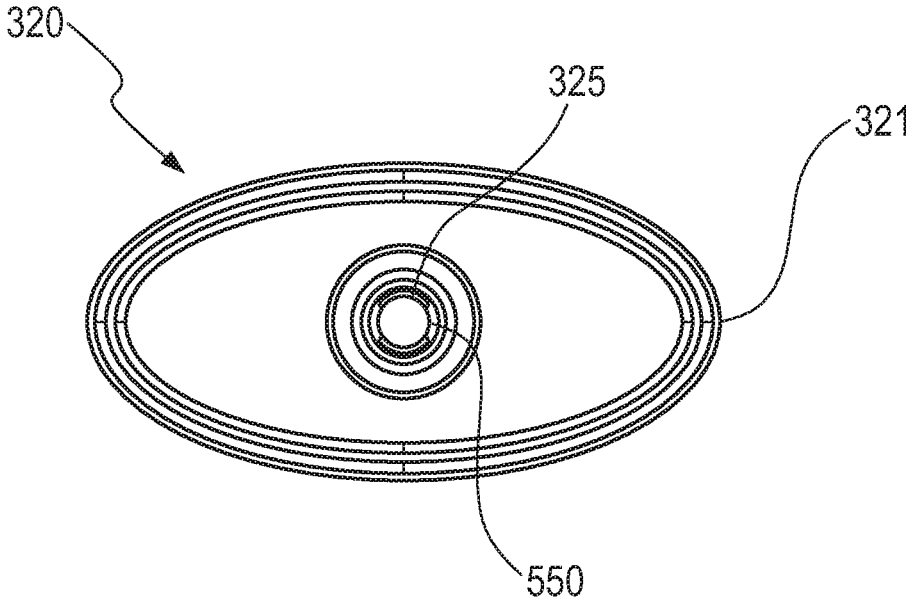
FIG. 48 is a top view of the movable elevator platform of FIG. 47.

Alternatively, as shown in FIG. 46, the coupling sleeve 325 supports internal threads having a first internal thread portion 530 having a first major diameter $MD_{10}$ and a first pitch p1 and a third internal thread portion 540 having a second major diameter $MD_{20}$ and a second pitch p2. The second major diameter $MD_{20}$ is larger than the first major diameter $MD_{10}$. The second pitch p2 is larger than the first pitch p1.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. A dispensing package comprising:

a longitudinal axis;

one or more jackets, wherein the one or more jackets comprise a first end, a second end opposite the first end;

a screw assembly; and a movable elevator platform;

wherein the screw assembly comprises:

a screw base disposed adjacent to the first end and rotatably associated with the one or more jackets;

a spindle that supports external threads, wherein the spindle extends from the screw base through the first end into the one or more jackets coaxial to the longitudinal axis of the dispensing package;

wherein the spindle comprises:

a first external thread portion having a first pitch; and a second external thread portion having a second pitch;

wherein the second pitch is larger than the first pitch;

wherein the movable elevator platform is movably engaged with the spindle of the screw assembly and comprises a coupling sleeve having an inner surface, wherein the coupling sleeve is coaxial to the longitudinal axis of the dispensing package, wherein the coupling sleeve supports internal threads that have:

a first internal thread portion having a first pitch;

a second internal non-threaded portion, wherein the second internal non-threaded portion comprises one or more cross-thread features, selected from the group consisting of a smooth surface, horizontal ribs, vertical ribs and combinations thereof;

wherein the first external thread portion of the screw assembly can engage with the first internal thread portion of the movable elevator platform along the inner surface of the movable elevator platform such that the first pitch of the first internal thread portion and the first pitch of the first external thread portion are the same;

wherein the second external thread portion of the screw assembly can cross-thread with the one or more cross-thread features of the second internal non-threaded portion of the movable elevator platform along the inner surface of the movable elevator platform.

2. The dispensing package according to claim 1, wherein the first external thread portion has a major diameter;

wherein the second external thread portion has a major diameter;

wherein the major diameter of the second external thread portion is larger than the major diameter of the first external thread portion;

wherein the first internal thread portion has a major diameter;

wherein the second internal non-threaded portion has a diameter, wherein the diameter is the diameter of the coupling sleeve at the second internal non-threaded portion having no cross-thread features, wherein the diameter is equal to the major diameter;

wherein the one or more cross-thread features of the second internal non-threaded portion has a diameter which is larger than the diameter;

such that the external threads of the first external thread portion of the spindle can engage with the internal threads of the first internal thread portion of the movable elevator platform; and such that the external threads of the second external thread portion of the spindle can cross-thread with the one or more cross-thread features of the second internal non-threaded portion along the inner surface of the movable elevator platform.

3. The dispensing package according to claim 2, wherein the major diameter of the first external thread portion is smaller than the major diameter of the respective first internal thread portion; and the major diameter of the second external thread portion of the spindle is larger than the diameter of the second internal non-threaded portion of the coupling sleeve and smaller than the diameter of the one or more cross-thread features of the second internal non-threaded portion.

4. The dispensing package according to claim 1, wherein the first external thread portion has a major diameter;

wherein the second external thread portion has a major diameter;

wherein the major diameter of the second external thread portion is larger than the major diameter of the first external thread portion;

wherein the first internal thread portion has a major diameter;

wherein the second internal non-threaded portion has a diameter wherein the diameter is the diameter of the coupling sleeve at the second internal non-threaded portion having no cross-thread features;

wherein the diameter of the second internal non-threaded portion is larger than the major diameter of the first internal thread portion;

wherein the one or more cross-thread features of the second internal non-threaded portion has a diameter which is larger than the diameter;

such that the external threads of the first external thread portion of the spindle can engage with the internal threads of the first internal thread portion of the movable elevator platform; and such that the external threads of the second external thread portion of the spindle can cross-thread with the one or more cross-thread features of the second internal non-threaded portion of the movable elevator platform.

5. The dispensing package according to claim 4, wherein the major diameter of the first external thread portion of the spindle is smaller than the major diameter of the first internal thread portion of the coupling sleeve; and wherein the major diameter of the second external thread portion of the spindle is larger than the diameter of the second internal non-threaded portion of the coupling sleeve and smaller than the diameter of the one or more cross-thread features of the second internal non-threaded portion.

6. A dispensing package comprising:

a longitudinal axis;

one or more jackets, wherein the one or more jackets comprise a first end, a second end opposite the first end;

a screw assembly; and a movable elevator platform;

wherein the screw assembly comprises:

a screw base disposed adjacent to the first end and rotatably associated with the one or more jackets;

a spindle that supports external threads, wherein the spindle extends from the screw base through the first end into the one or more jackets coaxial to the longitudinal axis of the dispensing package;

wherein the spindle comprises:

a first external thread portion having a first pitch; and a second external thread portion having a second pitch;

wherein the second pitch is larger than the first pitch;

wherein the movable elevator platform is movably engaged with the spindle of the screw assembly and comprises a coupling sleeve having an inner surface, wherein the coupling sleeve is coaxial to the longitudinal axis of the dispensing package, wherein the coupling sleeve supporting internal threads has:

a first internal thread portion having a first pitch;

a second internal non-threaded portion;

a third internal thread portion comprising one or a plurality of internal threads, wherein the second internal non-threaded portion is between the first and the third internal thread portions;

wherein the first external thread portion of the screw assembly can engage with the first internal thread portion of the movable elevator platform along the inner surface of the movable elevator platform such that the first pitch of the first internal thread portion and the first pitch of the first external thread portion are the same;

wherein the second external thread portion of the screw assembly can engage with the third internal thread portion of the movable elevator platform along the inner surface of the movable elevator platform.

7. The dispensing package according to claim 6, wherein the third internal thread portion comprises a plurality of internal threads, wherein the third internal thread portion has a second pitch, wherein the second external thread portion of the screw assembly can engage with the third internal thread portion of the movable elevator platform along the inner surface of the movable elevator platform, such that the second pitch of the third internal thread portion is comprised between the first pitch of the first external thread portion and the second pitch of the second external thread portion.

8. The dispensing package according to claim 7, wherein the second external thread portion of the screw assembly can engage with the third internal thread portion of the movable elevator platform along the inner surface of the movable elevator platform such that the second pitch of the third internal thread portion and the first pitch of the first external thread portion are the same.

9. The dispensing package according to claim 7, wherein the second external thread portion of the screw assembly can engage with the third internal thread portion of the movable elevator platform along the inner surface of the movable elevator platform such that the second pitch of the third internal thread portion and the second pitch of the second external thread portion are the same.

10. The dispensing package according to claim 6, wherein the first external thread portion has a major diameter;

wherein the second external thread portion has the major diameter;

wherein the first internal thread portion has a major diameter;

wherein the third internal thread portion has the major diameter;

such that the external threads of the first external thread portion of the spindle can engage with the internal threads of the first internal thread portion of the movable elevator platform; and such that the external threads of the second external thread portion of the spindle can engage with the internal threads of the third internal thread portion of the movable elevator platform.

11. The dispensing package according to claim 10, wherein each of the major diameter of the first external thread portion and the second external thread portion of the spindle is smaller than each of the major diameter of the respective first internal thread portion and the third internal thread portion of the coupling sleeve.

12. The dispensing package according to claim 6, wherein the first external thread portion has a major diameter;

wherein the second external thread portion has a major diameter;

wherein the major diameter of the second external thread portion is larger than the major diameter of the first external thread portion;

wherein the first internal thread portion has a major diameter;

wherein the third internal thread portion has a major diameter;

wherein the major diameter of the third internal thread portion is larger than the major diameter of the first internal thread portion;

such that the external threads of the first external thread portion of the spindle can engage with the internal threads of the first internal thread portion of the movable elevator platform; and such that the external threads of the second external thread portion of the spindle can engage with the internal threads of the third internal thread portion of the movable elevator platform.

13. The dispensing package according to claim 12, wherein the major diameter of the first external thread portion of the spindle is smaller than the major diameter of the first internal thread portion of the coupling sleeve; and wherein the major diameter of the second external thread portion of the spindle is smaller than the major diameter of the third internal thread portion of the coupling sleeve.

14. The dispensing package according to claim 6, wherein the spindle of the screw assembly comprises a third non-threaded portion located between the first external thread portion and the second external thread portion.

15. The dispensing package according to claim 14, wherein the third non-threaded portion has a height as measured along the longitudinal axis;

wherein the coupling sleeve of the movable elevator platform has a height as measured along the longitudinal axis; and wherein the height of the third non-threaded portion is above the second pitch of the second external thread portion of the spindle and less than the height of the coupling sleeve of the movable elevator platform.

* * * * *